US011992094B2

(12) United States Patent
Kim et al.

(10) Patent No.: US 11,992,094 B2
(45) Date of Patent: May 28, 2024

(54) STRING WINDING AND UNWINDING APPARATUS

(71) Applicant: TYRENN CO., LTD., Seoul (KR)

(72) Inventors: Sug Whan Kim, Gimpo-si (KR); Jun Young Kim, Gimpo-si (KR)

(73) Assignee: TYRENN CO., LTD., Seoul (KR)

( * ) Notice: Subject to any disclaimer, the term of this patent is extended or adjusted under 35 U.S.C. 154(b) by 0 days.

(21) Appl. No.: 18/108,062

(22) Filed: Feb. 10, 2023

(65) Prior Publication Data

US 2023/0180896 A1 Jun. 15, 2023

Related U.S. Application Data

(62) Division of application No. 17/587,043, filed on Jan. 28, 2022, now Pat. No. 11,653,718, which is a division of application No. 16/351,782, filed on Mar. 13, 2019, now Pat. No. 11,234,490, which is a division of application No. 14/831,978, filed on Aug. 21, 2015, now Pat. No. 10,264,852.

(30) Foreign Application Priority Data

Jan. 14, 2015 (KR) ..... 10-2015-0006932
Jan. 14, 2015 (KR) ..... 10-2015-0006934

(51) Int. Cl.
*A43C 11/16* (2006.01)
*B65H 75/44* (2006.01)

(52) U.S. Cl.
CPC ..... *A43C 11/165* (2013.01); *B65H 75/4431* (2013.01); *B65H 2701/35* (2013.01); *B65H 2701/537* (2013.01)

(58) Field of Classification Search
CPC ..... A44C 11/165; A44C 11/16; A44C 11/00; A44C 11/004; B65H 75/4431; B65H 2701/35; B65H 2701/537; Y10T 24/2183
See application file for complete search history.

(56) References Cited

U.S. PATENT DOCUMENTS 6,502,286 B1 * 1/2003 Dubberke ..... A43C 7/00 24/712.1
7,367,522 B2 * 5/2008 Chen ..... A43C 7/00 242/378.1
9,072,341 B2 * 7/2015 Jungkind ..... A43C 11/165
9,486,039 B2 * 11/2016 Ha ..... A42B 1/22
9,629,417 B2 * 4/2017 Cavanagh ..... A43C 11/165
9,681,705 B2 * 6/2017 Trudel ..... A43C 7/00
9,700,101 B2 * 7/2017 Lovett ..... A43C 11/008
9,706,814 B2 * 7/2017 Converse ..... A61F 5/0123
9,717,305 B2 * 8/2017 Midorikawa ..... A43C 11/165
9,737,115 B2 * 8/2017 Soderberg ..... A43C 1/06
9,743,714 B2 * 8/2017 Hammerslag ..... A43C 11/004
(Continued)

*Primary Examiner* — Jonathan Malikasim
*Assistant Examiner* — Rowland Do
(74) *Attorney, Agent, or Firm* — LEX IP MEISTER, PLLC

(57) ABSTRACT

An apparatus for convenient tightening and loosening of strings such as those found in shoelaces of footwear is provided. The apparatus includes a rotating portion within a base portion. A cover portion, when operated in a first position, provides a ratchet movement that allows rotation in a tightening direction while preventing movement in a loosening direction. When the cover is moved to a second position, the ratchet mechanism disengages, and the strings can then be easily loosened.

4 Claims, 44 Drawing Sheets

(56) References Cited

U.S. PATENT DOCUMENTS

| | | | | |
|---|---|---|---|---|
| 2010/0251524 | A1* | 10/2010 | Chen | A43C 11/165 24/713.2 |
| 2011/0266384 | A1* | 11/2011 | Goodman | B65H 75/4431 29/434 |
| 2013/0025100 | A1* | 1/2013 | Ha | A43C 11/165 24/712.9 |
| 2013/0092780 | A1* | 4/2013 | Soderberg | A43C 11/165 242/397 |
| 2014/0097283 | A1* | 4/2014 | So | A44B 99/00 242/404 |
| 2014/0359981 | A1* | 12/2014 | Cotterman | A43C 11/20 24/712.9 |
| 2016/0198801 | A1* | 7/2016 | Kim | B65H 75/4431 24/68 C |
| 2016/0213099 | A1* | 7/2016 | Ha | A43C 11/20 |
| 2016/0262496 | A1* | 9/2016 | Midorikawa | A43C 11/165 |

* cited by examiner

STRING WINDING AND UNWINDING APPARATUS

CROSS-REFERENCES TO RELATED APPLICATION

This application is a Divisional Application of U.S. patent application Ser. No. 17/587,043 filed on Jan. 28, 2022, which is a Divisional Application of U.S. patent application Ser. No. 16/351,782 filed on Mar. 13, 2019, which is a Divisional Application of U.S. patent application Ser. No. 14/831,978 filed on Aug. 21, 2015, which claims priority to Korean Patent Application No. 10-2015-0006932 filed on Jan. 14, 2015 and Korean Patent Application No. 10-2015-0006934 filed on Jan. 14, 2015, the contents of which are incorporated herein by reference.

BACKGROUND OF THE INVENTION

1. Field of the Invention

The present disclosure relates to a string winding and unwinding apparatus and, more particularly, to a string winding and unwinding apparatus having a simple configuration and facilitating maintenance and repair.

2. Background of the Invention

In general, shoes, bags (or sacks), backpacks, or clothes include a tightening/loosening unit using strings, or the like. For example, in shoes (footwear), strings are provided to be connected in a zigzag manner, and as the strings are pulled to be tightened, shoes may be tightly attached to the feet of users.

However, it is very cumbersome to loosen or tighten strings each time a user puts on or takes off shoes, and thus, generally, when a user wears shoes, he or she does not fully pull and tighten strings so that the shoes may not be completely tightly attached to his or her feet. In this case, when the shoes are intended to be completely tightly attached to the user's feet for exercise, or the like, the user should pull to tighten the strings, and thereafter, the user may loosen the strings, involving user inconvenience. In addition, when the tightened strings are loosened while the user is walking or doing exercise, the user should tighten the strings again.

SUMMARY OF THE INVENTION

Embodiments of the present invention provide an apparatus for convenient tightening and loosening of strings such as those found in shoelaces of footwear. The apparatus includes a rotating portion within a base portion. A cover portion, when operated in a first position, provides a ratchet movement that allows rotation in a tightening direction while preventing movement in a loosening direction. When the cover is moved to a second position, the ratchet mechanism disengages, and the shoelaces can then be easily loosened. In some embodiments, a restoring string or spring provides assistance in the loosening of shoelaces by assisting in moving the rotating portion in a loosening direction.

In a first aspect, embodiments of the present invention provide a string winding apparatus, comprising a base unit, the base unit comprising a housing and having a lateral aperture in the housing, a middle unit coupled to the base unit, a rotating unit positioned within the base unit, wherein the rotating unit is configured and disposed to be rotatable with respect to the base unit, and wherein the rotating unit comprises a upper surface with a first engaging portion formed thereon and allowing a string to be wound around an outer circumferential surface thereof or unwound therefrom through rotation; and a cover unit coupled to the middle unit, wherein the cover unit is configured and disposed to be rotatable with respect to the middle unit, and wherein the cover unit comprises a second engaging portion configured and disposed to engage with the first engaging portion of the rotating unit.

In a second aspect, embodiments of the present invention provide a string winding apparatus comprising: a base unit having a base plate and a lower housing positioned on an upper surface of the base plate and having a lateral aperture; a middle unit having a upper housing coupled to the lower housing, an upper stoppage portion positioned within the upper housing, and a lower stoppage portion positioned within the upper housing and disposed to be closer to the base plate than the upper stoppage portion; a rotating unit being at least partially positioned within the lower housing so as to be rotatable with respect to the base unit, and allowing a string to be wound around an outer circumferential surface thereof or unwound therefrom through rotation; and a cover unit coupled to the middle unit so as to be rotatable with respect to the middle unit, having a responsive stoppage portion protruding in a radial direction, varied in distance to the base unit according to a relative position of the responsive stoppage portion with respect to the upper stoppage portion and the lower stoppage portion so as to be engaged with the rotating unit or separated from the rotating unit, and rotated together with the rotating unit when engaged therewith.

In a third aspect, embodiments of the present invention provide a string winding apparatus comprising: a base unit having a base plate and a lower housing positioned on an upper surface of the base plate; a rotating unit being at least partially positioned within the lower housing so as to be rotatable with respect to the base unit, and allowing a string to be wound around an outer circumferential surface thereof or unwound therefrom through rotation; a cover unit varied in distance to the base unit so as to be engaged with the rotating unit or separated from the rotating unit, and rotated together with the rotating unit when engaged therewith; and a restoring unit configured and disposed to move the rotating unit in an unwinding direction when the cover unit is separated from the rotating unit in a wound state.

In a fourth aspect, embodiments of the present invention provide a string winding apparatus, comprising: a base unit, the base unit comprising a housing and having a lateral aperture in the housing; a middle unit coupled to the base unit, the middle unit comprising a partition with a plurality of responsive protrusions thereon; a rotating unit positioned within the base unit, wherein the rotating unit is configured and disposed to be rotatable with respect to the base unit, and wherein the rotating unit comprises a upper surface with a first engaging portion formed thereon and allowing a string to be wound around an outer circumferential surface thereof or unwound therefrom through rotation; a cover unit coupled to the middle unit, wherein the cover unit comprises a central shaft and is configured and disposed to be rotatable with respect to the middle unit, and wherein the rotating unit further comprises a first wing part and a second wing part, wherein a space is formed between the first wing part and the second wing part, wherein the space is configured and disposed to store the string; and wherein the cover unit comprises a second engaging portion on the central shaft that is configured and disposed to engage with the first engaging portion of the rotating unit; and wherein the string winding apparatus comprises a first stage defined by a height of the cover unit, and a second stage defined by a distance between the first wing part and the second wing part, and wherein a reverse rotation prevention portion is disposed in the first stage, a stoppage portion is disposed in the first stage, and a string winding portion is disposed in the second stage.

In a fifth aspect, embodiments of the present invention provide a string winding apparatus, comprising: a middle-base composite unit, the base unit comprising a housing and having a lateral aperture in the housing; a rotating-coverrotating-cover composite unit positioned within the middle-base composite unit, the rotating-cover composite unit comprising a partition with a plurality of responsive protrusions thereon, and wherein the rotating-cover composite unit is configured and disposed to be rotatable with respect to the middle-base composite unit, wherein the rotating-cover composite unit further comprises a first wing part and a second wing part, wherein a space is formed between the first wing part and the second wing part, wherein the space is configured and disposed to store a string that is allowed to be wound around an outer circumferential surface thereof or unwound therefrom through rotation; and wherein the string winding apparatus comprises a single stage defined by a distance between a top surface of the cover unit and the first wing part of the rotating-cover composite unit, and wherein a reverse rotation prevention portion, a stoppage portion, and a string winding portion are disposed in the single stage.

BRIEF DESCRIPTION OF THE DRAWINGS

The accompanying drawings, which are included to provide a further understanding of embodiments of the present invention and are incorporated in and constitute a part of this specification, illustrate exemplary embodiments and together with the description serve to explain the principles of embodiments of the invention.

In the drawings.

DETAILED DESCRIPTION OF THE INVENTION

Figure 1:
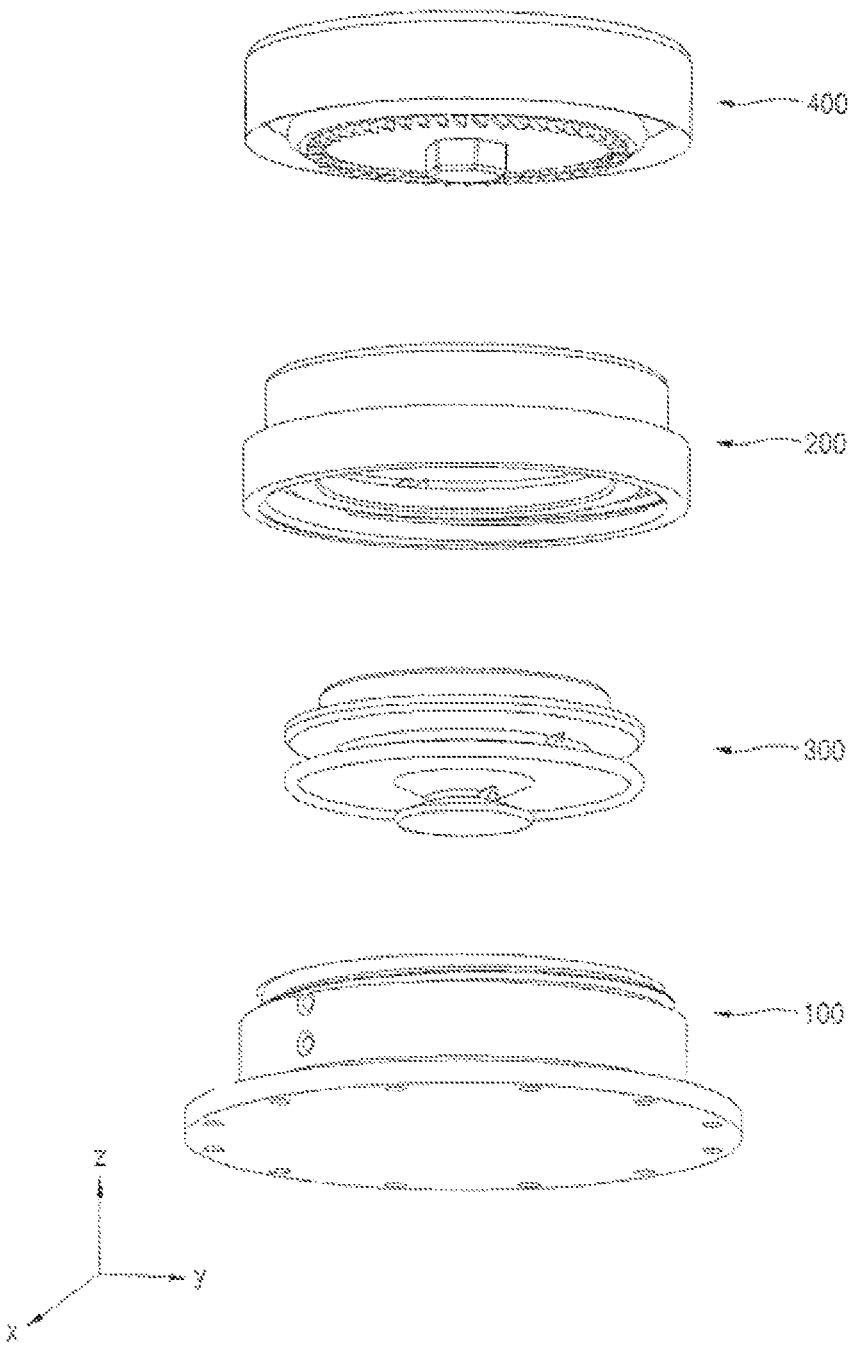
FIG. 1 is an exploded perspective view schematically illustrating a string winding and unwinding apparatus according to an embodiment of the present disclosure.

The present invention will now be described fully hereinafter with reference to the accompanying drawings, in which preferred embodiments of the invention are shown. Like numbers refer to like elements throughout. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure.

Illustrative embodiments will now be described more fully herein with reference to the accompanying drawings, in which embodiments are shown. This disclosure may, however, be embodied in many different forms and should not be construed as limited to the embodiments set forth herein. Rather, these embodiments are provided so that this disclosure will be thorough and complete and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Reference throughout this specification to "one embodiment," "an embodiment," "embodiments," "exemplary embodiments," "some embodiments," or similar language means that a particular feature, structure, or characteristic described in connection with the embodiment is included in at least one embodiment of the present invention. Thus, appearances of the phrases "in one embodiment," "in an embodiment," "in embodiments", "in some embodiments", and similar language throughout this specification may, but do not necessarily, all refer to the same embodiment. It will be understood that one skilled in the art may cross embodiments by "mixing and matching" one or more features of one embodiment with one or more features of another embodiment.

The terms "overlying" or "atop", "positioned on, "positioned atop", or "disposed on", "underlying", "beneath" or "below" mean that a first element, such as a first structure (e.g., a first layer) is present on a second element, such as a second structure (e.g. a second layer) wherein intervening elements, such as an interface structure (e.g. interface layer) may be present between the first element and the second element. When various components such as layer, film, region, and plate are referred to as being "on" another component, the component may be directly formed on the other component or substrate or indirectly formed with an intervening component therebetween.

In the embodiments described hereinafter, x axis, y axis and z axis may be construed in a broad sense, rather than being limited to a Cartesian coordinate system. For example, x axis, y axis and z axis may be perpendicular to each other or may designate other directions not perpendicular to each other.

Figure 2:
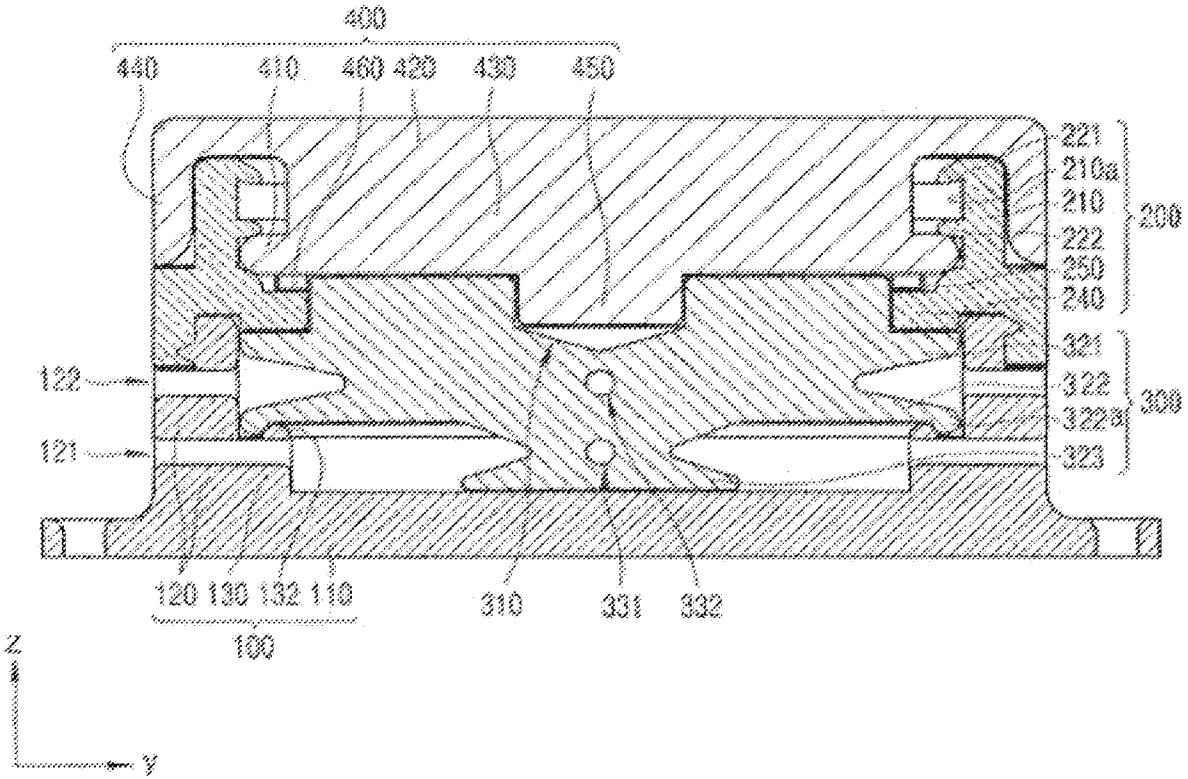
FIG. 2 is a cross-sectional view schematically illustrating a coupled state of the string winding and unwinding apparatus of FIG. 1.

FIG. 1 is an exploded perspective view schematically illustrating a string winding and unwinding apparatus according to an embodiment of the present disclosure, and FIG. 2 is a cross-sectional view schematically illustrating a coupled state of the string winding and unwinding apparatus of FIG. 1.

As illustrated in FIGS. 1 and 2, the string winding and unwinding apparatus according to the present embodiment includes a base unit 100, a middle unit 200 coupled to the base unit 100, a rotating unit 300 positioned within the base unit 100 and/or the middle unit 200 so as to be rotatable with respect to the base unit 100, and a cover unit 400 coupled to the middle unit 200 so as to be rotatable with respect to the middle unit 200.

Figure 3:
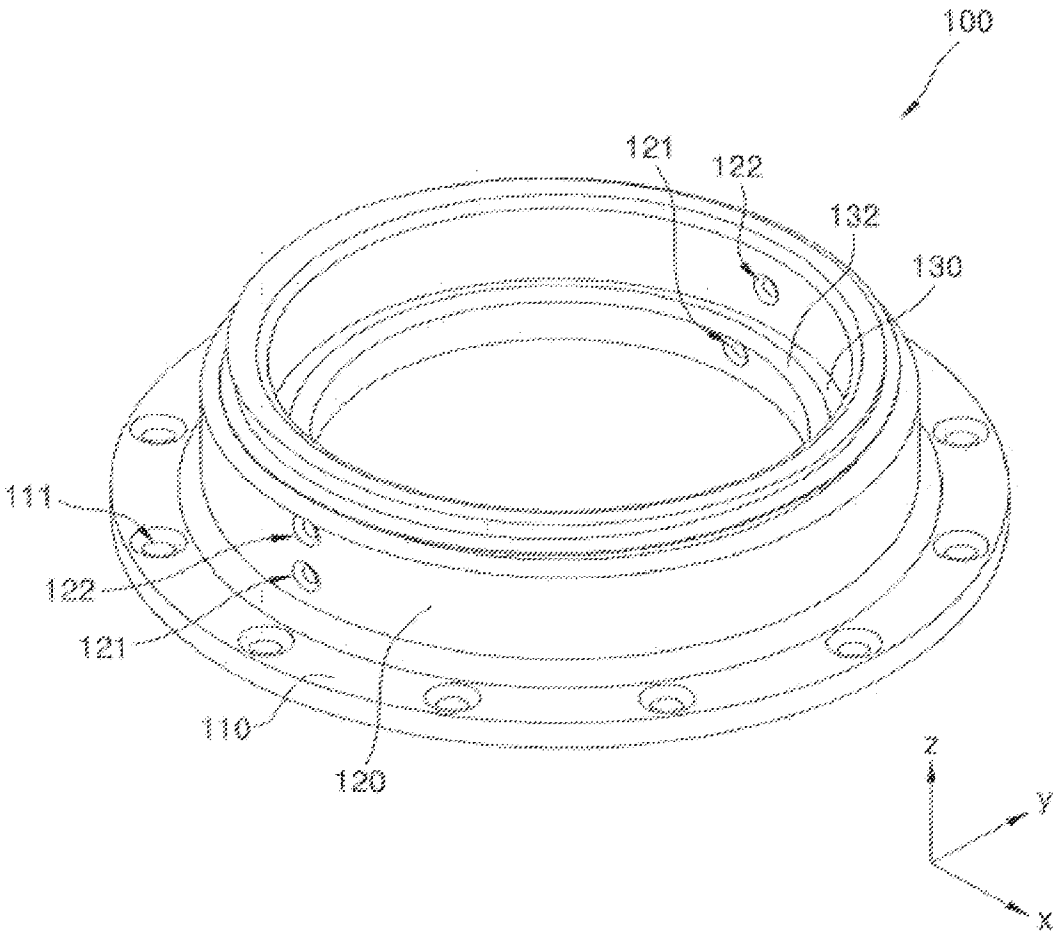
FIG. 3 is a perspective view schematically illustrating a base unit of FIG. 1.

FIG. 3 is a perspective view schematically illustrating the base unit 100 of FIG. 1. As illustrated in FIG. 3, the base unit 100 includes a base plate 110 having a plate shape such as a disc and a cylindrical lower housing 120, for example. However, a shape of the base plate 110 is not limited to the disc shape and the base plate 110 may have various other plate shapes. Here, the cylindrical shape may be understood as a shape similar to a hollow cylinder. The lower housing 120 is positioned in an upper surface of the base plate 110 (+z direction). The base plate 110 and the lower housing 120 may be integrally formed by a resin, or the like.

The lower housing 120 has a second lateral aperture 122. A non-limiting example of an aperture is a hole or through-hole. In some embodiments, the lower housing 120 may have a first lateral aperture 121 as illustrated in FIG. 3. Here, the first lateral aperture 121 may be positioned to be closer to the base plate 110 than the second lateral aperture 122. Thus, the second lateral aperture can be at a different elevation (z direction) than the first lateral aperture. It is illustrated that the lower housing 120 has two first lateral apertures 121 substantially facing each other and also may have two second lateral apertures 122, but these are merely illustrative and at least one first lateral aperture 121 and at least one second lateral aperture 122 may exhibit functions thereof. In FIG. 3, it is illustrated that the first lateral apertures 121 are positioned to be aligned in the y axis direction and the second lateral apertures 122 are also positioned to be aligned in the y axis direction, but these are merely illustrative and the first lateral apertures 121 and the second lateral apertures 122 may exhibit functions thereof as long as they are positioned to be aligned substantially, regardless of direction. In FIG. 3, it is illustrated that the first lateral apertures 121 and the second lateral apertures 122 are positioned abreast up and down, but the present disclosure is not limited thereto. For example, the first lateral apertures 121 may be positioned to be aligned substantially in the y axis direction as illustrated in FIG. 3, while the second lateral apertures 122 may be positioned to be aligned substantially in the x axis direction unlike those illustrated in FIG. 3.

Apertures 111 having a central axis in a z axis direction may be formed in an outer portion of the lower housing 120 of the base plate 110 of the base unit 100. The apertures 111 serve to allow fasteners to pass therethrough to fix the base plate 110 to footwear, or the like, when the string winding and unwinding apparatus according to the present embodiment is installed in the footwear, for example.

The base unit 100 may further have a rotation support portion 130 protruding from an inner surface of the lower housing 120 in a direction toward the center of the lower housing 120. A rotation support protrusion portion 132 may be formed in an upper surface of the rotation support portion 130 and may protrude upwardly (+z direction). The rotation support portion 130 and the rotation support protrusion portion 132 may serve to support smooth rotation of the rotating unit 300 when the rotating unit 300 rotates with respect to the base unit 100. This will be described hereinafter.

Figure 4:
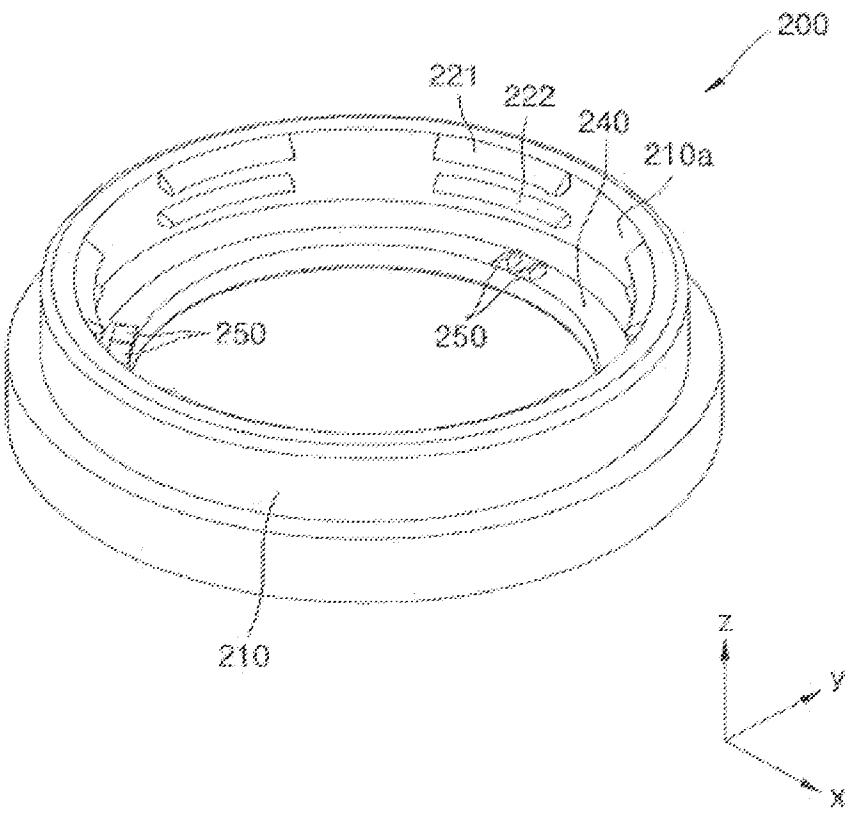
FIG. 4 is a perspective view schematically illustrating a middle unit of FIG. 1.

As illustrated in FIG. 4, the middle unit 200 has a cylindrical upper housing 210, an inwardly directed upper stoppage portion 221, and an inwardly directed lower stoppage portion 222. The upper stoppage portion 221 and/or the lower stoppage portion 222 may have slight elasticity or flexibility within a range in which an overall shape thereof is not changed. The cylindrical upper housing 210 understood as having a shape similar to a hollow cylinder may be coupled to the lower housing 120 of the base unit 100. Both the upper stoppage portion 221 and the lower stoppage portion 222 may be positioned on an inner circumferential surface 210*a* of the upper housing 210 toward the center of the upper housing 210. In particular, both the upper stoppage portion 221 and the lower stoppage portion 222 may be convex in a direction away from the inner circumferential surface 210*a* of the upper housing 210. That is, the upper stoppage portion 221 and the lower stoppage portion 222 may have a convex shape protruding in a direction toward the center of the upper housing 210. Here, the lower stoppage portion 222 is positioned to be closer to the base plate 110 (−z direction) than the upper stoppage portion 221.

The middle unit 200 may have a partition 240 as necessary. The partition 240 may be positioned to be closer to the base plate 110 than the lower stoppage portion 222 and protrudes inwardly from the upper housing 210. A responsive protrusion 250 may be positioned on a surface of the partition 240 in a direction (+z direction) of the lower stoppage portion 222. Functions of the partition 240 and/or the responsive protrusion 250 will be described hereinafter.

The upper housing 210, the upper stoppage portion 221, the lower stoppage portion 222, the partition 240, and/or the responsive protrusion 250 may be formed of a resin, or the like, as one body. Alternatively, as described hereinafter, a portion of the components may be separately formed and coupled to the upper housing 210, and in such a case, the portion of the components may be formed of various materials including a resin, a plastic, or a metal.

Figure 5:
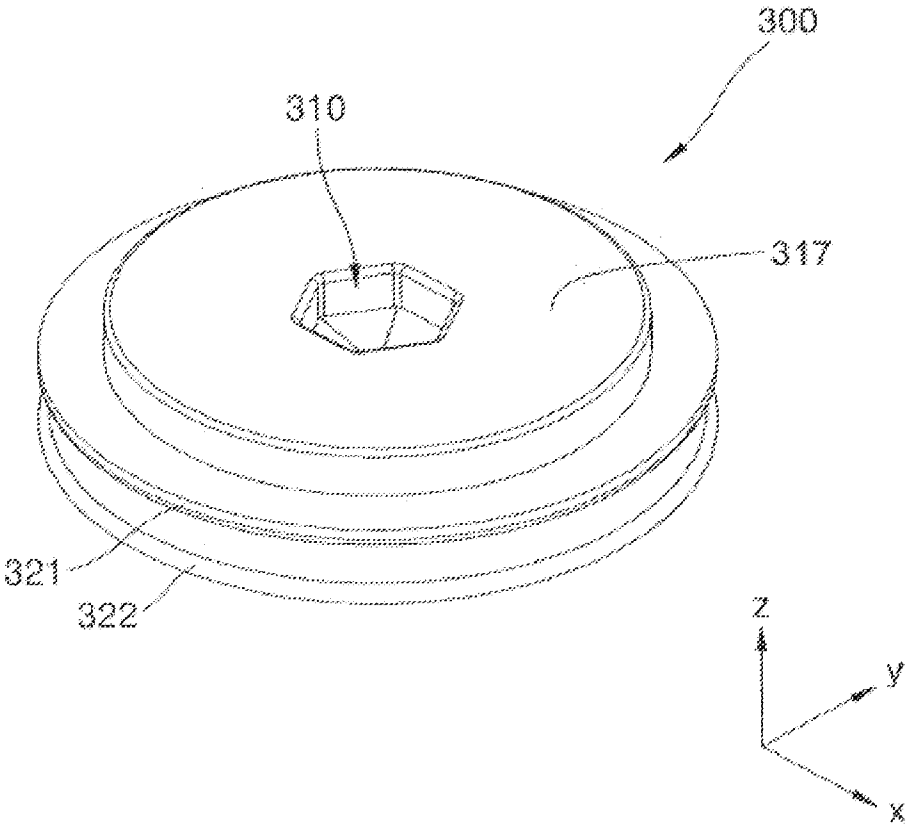
FIG. 5 is a perspective view schematically illustrating a rotating unit of FIG. 1.
Figure 6:
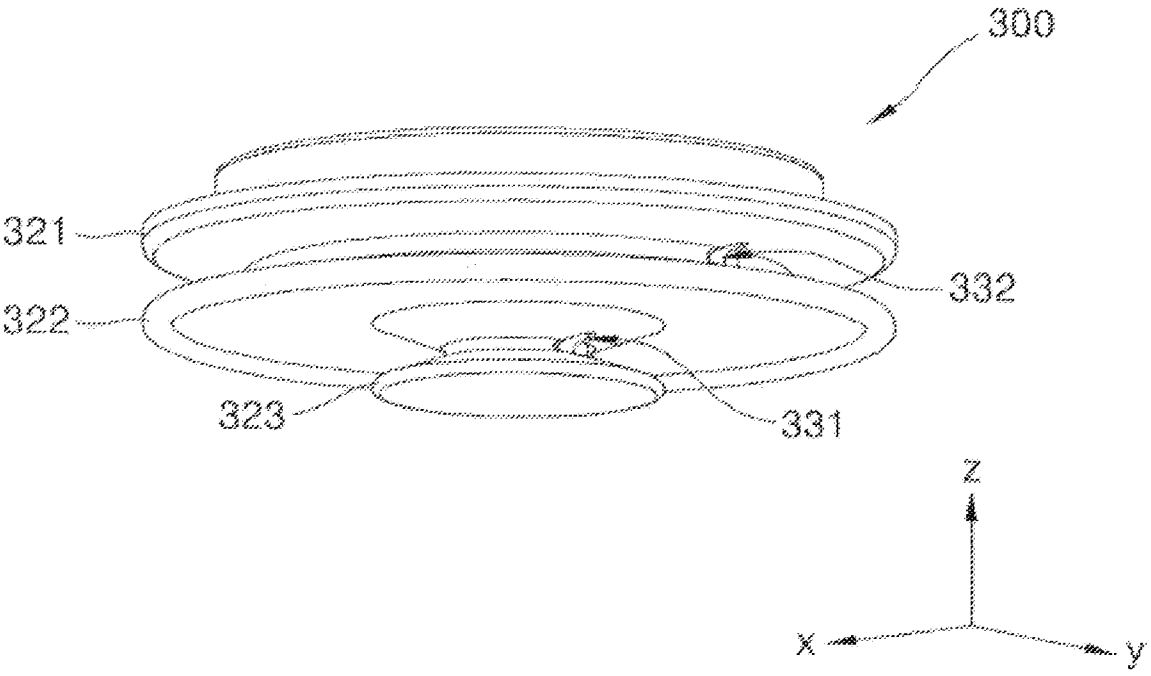
FIG. 6 is a bottom perspective view schematically illustrating the rotating unit of FIG. 5.

FIG. 5 is a perspective view schematically illustrating the rotating unit 300 of FIG. 1, and FIG. 6 is a bottom perspective view schematically illustrating the rotating unit 300 of FIG. 5. As illustrated in FIGS. 5 and 6, the rotating unit 300 is positioned within the lower housing 120 of the base unit 100 and disposed to be rotatable with respect to the base unit 100. Here, when the rotating unit 300 is positioned within the lower housing 120, it means that at least a portion of the rotating unit 300 is positioned within the lower housing 120, and thus, here, various modifications may be implemented such that a portion of the rotating unit 300 is positioned within the upper housing 210 above the lower housing 120, or the like.

As illustrated in FIG. 5, the rotating unit 300 has a first engaging portion 310 in an upper surface 317 thereof (+z direction). In FIG. 5, it is illustrated that the first engaging portion 310 has a concave recess shape but the first engaging portion 310 may be modified to have a convex protrusion shape. When the first engaging portion 310 is engaged with a second engaging portion 450 (to be described hereinafter) of the cover unit 400, the rotating unit 300 may be rotated together with the cover unit 400. Here, in order to prevent slipping between the rotating unit 300 and the cover unit 400 while the first engaging portion 310 and the second engaging portion 450 are engaged with each other, the first engaging portion 310 and the second engaging portion 450 may have various shapes such as a polygonal shape, an oval shape, or an asymmetrically distorted circular shape in an x-y plane. Alternatively, the first engaging portion 310 and the second engaging portion 450 may be configured as one or more pairs of pins and pin apertures in the x-y plane such that the rotating unit 300 and the cover unit 400 may be engaged with each other as the one or more pairs of pins and pin apertures are engaged.

As illustrated in FIGS. 5 and 6, the rotating unit 300 may have a first wing part 321 positioned in a upper portion thereof and protruding in a radial direction and a second wing part 322 positioned in a lower portion thereof (in the −z direction) so as to be closer to the base plate 110 than the first wing part 321 and protruding in the radial direction, like the first wing part 321. In a space between the first wing part 321 and the second wing part 322, a string may be wound around an outer circumferential surface of the rotating unit 300 according to a rotation direction of the rotating unit 300. That is, the first wing part 321 and the second wing part 322 may serve to limit the space in which the string is to be positioned when wound according to the direction in which the rotating unit 300 rotates.

If necessary, as illustrated in FIG. 6, the rotating unit 300 may additionally include a third wing part 323 positioned in a lower portion thereof so as to be even closer (in the −z direction) to the base plate 110 than the second wing part 322 and protruding in the radial direction, like the second wing part 322. The third wing part 323 may have a flat lower surface, whereby the rotating unit 300 may stably rotate with respect to the base plate 110 of the base unit 100 in a state in which at least a portion of the lower surface of the third wing part 323 is in contact with an upper surface (+z direction) of the base plate 110 or in a state in which at least a portion of the lower surface of the third wing part 323 is in close proximity to the upper surface of the base plate 110 if not in contact therewith.

As illustrated in FIG. 6, the rotating unit 300 may have a first aperture 331 positioned below the second wing part 322 (−z direction) and penetrating through the rotating unit 300 at an orientation perpendicular to the rotational shaft (z axis of the rotating unit). The first aperture 331 may correspond to the first lateral apertures 121 of the base unit 100. Here, when the first aperture 331 corresponds to the first lateral apertures 121, it means that a height of the first aperture 331 from the base plate 110 and a height of the first lateral apertures 121 from the base plate 110 are substantially equal.

As illustrated in FIG. 6, the rotating unit 300 may have a second aperture 332 penetrating through the rotating unit 300 in a space between the first wing part 321 and the second wing part 332. The second aperture 332 may correspond to the second lateral apertures 122 of the base unit 100. Here, when the second aperture 332 corresponds to the second lateral apertures 122, it means that a height of the second aperture 332 from the base plate 110 and a height of the second lateral apertures 122 from the base plate 110 are substantially equal.

A string (not shown) of footwear, or the like, may pass through any one of the second lateral apertures 122 of the base unit 100, penetrate through the second aperture 332 of the rotating unit 300, and subsequently pass through the other of the second lateral apertures 122. In another embodiment of the present disclosure, after the string passes through the second aperture 332 of the rotating unit 300, the string may be fixed within the base unit 100. Accordingly, when the rotating unit 300 in a state of being engaged with the cover unit 400 rotates in one direction, the string may be wound around the rotating unit 300. In detail, the string is wound in the space between the first wing part 321 and the second wing part 322. In this manner, the string may be wound in the footwear, or the like. Here, although a ratchet protrusion 460 (described further in FIG. 7) and the responsive protrusion 250 meet each other, wedge shapes of the ratchet protrusion 460 and the responsive protrusion 250 allow the cover unit 400 to rotate in one direction, and when the rotation of the cover unit 400 in one direction is stopped, the wedge shapes of the ratchet protrusion 460 and the responsive protrusion 250 limit rotations of the cover unit 400 and the rotating unit 300 in the other direction, i.e., the opposite direction, in the stopped position. Thus, the ratchet protrusions are unidirectional ratchet protrusions, and enable rotational motion in one direction while preventing rotational motion in the opposite direction. In this state, when the rotating unit 300 is separated from the cover unit 400, the ratchet protrusion 460 and the responsive protrusion 250 are also separated, releasing the wound state, and thus, the rotating unit 300 may rotate in the other direction, the opposite direction of the one direction, by virtue of elastic restoring force of the string itself, and accordingly, the string, which has been wound around the rotating unit 300, may be unwound from an outer circumferential surface of the rotating unit 300.

However, the present disclosure is not limited thereto and the rotating unit 300 may not have the second aperture 332. In this case, one end of the string of the footwear, or the like, may pass through any one of the second lateral apertures 122 of the base unit 100 so as to be fixed to the rotating unit 300 and the other end of the string of the footwear, or the like, may pass through the other of the second lateral aperture 122 of the base unit 100 so as to be fixed to the rotating unit 300. In this case, in order to fix the one end and the other end of the string, the rotating unit 300 may have at least one fixing protrusion portion configured for string fixing.

When rotating, the rotating unit 300 rotates relatively with respect to the base unit 100, and thus, it is preferred to increase rotation stability of the rotating unit 300. To this end, the rotation support portion 130 and the rotation support protrusion portion 132 of the base unit 100 may interact with the second wing part 322 of the rotating unit 300. For example, the rotating unit 300 may have a rotation protrusion portion **322*a* (described further in FIG. 20) protruding downwardly (−z direction) from an end of the second wing part 322 in the radial direction, and a portion of a lower surface (−z direction) of the second wing part 322 adjacent to the rotation protrusion portion 322*a* may be configured to be in close proximity to or may be in contact with the rotation support protrusion portion 132 of the base unit 100, whereby when the rotating unit 300 rotates, a position of a rotational central axis of the rotating unit 300 may be uniform, rather than being moved relatively with respect to the base unit 100**.

The rotating unit 300 may be formed of a resin and/or a metal.

Figure 7:
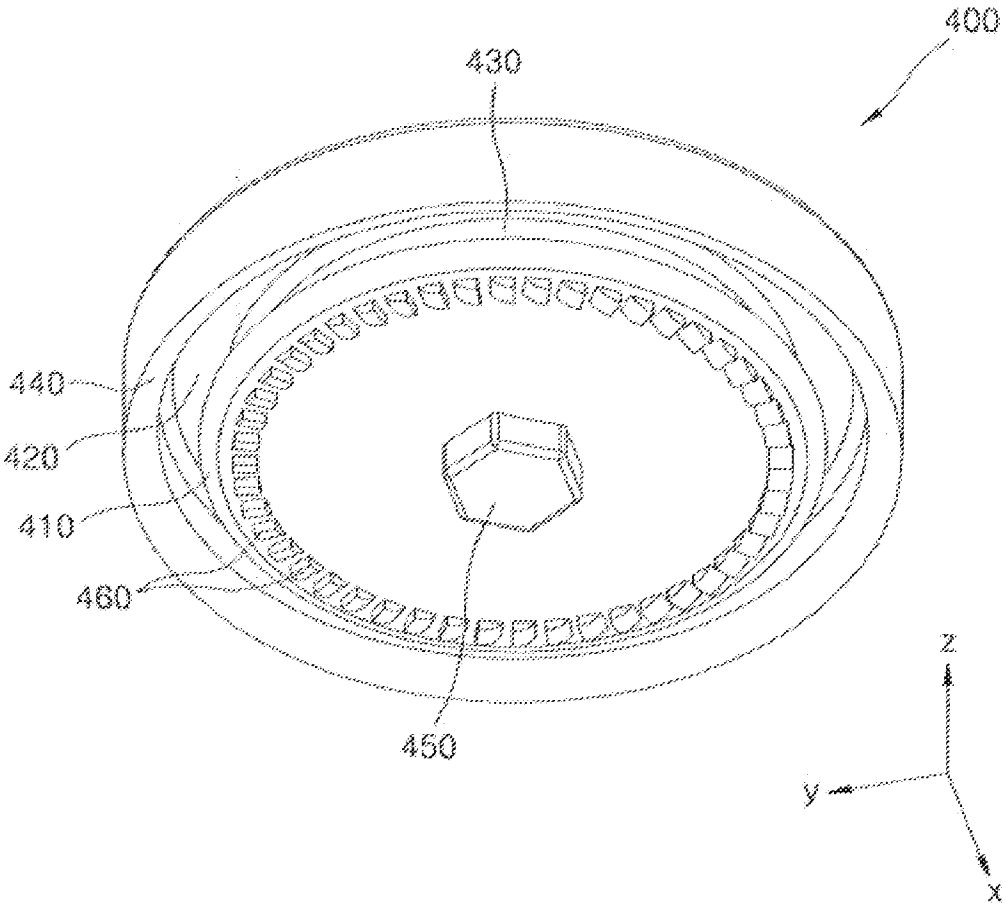
FIG. 7 is a bottom perspective view schematically illustrating a cover unit of FIG. 1.

FIG. 7 is a bottom perspective view schematically illustrating the cover unit of FIG. 1. As illustrated in FIG. 7, the cover unit 400 may be coupled to the middle unit 200 such that it is rotatable with respect to the middle unit 200. Also, as mentioned above, when the cover unit 400 is engaged with the rotating unit 300, the cover unit 400 may rotate in one direction together with the rotating unit 300.

The cover unit 400 has a responsive stoppage portion 410 protruding in a radial direction. As the responsive stoppage portion 410 of the cover unit 400 performs a mutual grasping operation with the upper stoppage portion 221 and/or the lower stoppage portion 222 of the middle unit 200, the cover unit 400 may be rotatably coupled to the middle unit 200. In addition, according to a relative position of the responsive stoppage portion 410 with respect to the upper stoppage portion 221 and the lower stoppage portion 222, the cover unit 400 may be varied in distance to the base unit 100 so as to be engaged with the rotating unit 300 or separated from the rotating unit 300.

In detail, as the responsive stoppage portion 410 is positioned in a first space between the lower stoppage portion 222 and the partition 240 or positioned in a second space between the upper stoppage portion 221 and the lower stoppage portion 222, a distance of the cover unit 400 to the base unit 100 may be varied. When the responsive stoppage portion 410 is positioned in the first space, the cover unit 400 may be engaged with the rotating unit 300 and rotate together with the rotating unit 300 in one direction, and when the responsive stoppage portion 410 is positioned in the second space, the cover unit 400 may be separated from the rotating unit 300 and the ratchet protrusion 460 and the responsive protrusion 250 are separated accordingly, and thus, the rotating unit 300 may rotate in one direction or in the other direction, opposite to the one direction, regardless of movement of the cover unit 400.

As illustrated in FIG. 7, the cover unit 400 has the second engaging portion 450 formed on a lower surface thereof in a direction (−z direction) toward the rotating unit 300. In FIG. 7, it is illustrated that the second engaging portion 450 has a concave protrusion shape. However, the second engaging portion 450 may have a concave recess shape. That is, the second engaging portion 450 may be modified according to shapes of the first engaging portion 310 of the rotating unit 300. When the second engaging portion 450 is engaged with the first engaging portion 310 of the rotating unit 300 described above, the rotating unit 300 may be rotated together with the cover unit 400. Here, in order to prevent slipping between the rotating unit 300 and the cover unit while the first engaging portion 310 and the second engaging portion 450 are engaged with each other, shapes of cross-sections of the first engaging portion 310 and the second engaging portion 450 in the x-y plane may have various shapes such as a polygonal shape, an oval shape, or an asymmetrically distorted circular shape, or may have a configuration of a pin and a pin aperture. Other modified examples of the engaging portions will be described in detail with reference to FIGS. 18 and 19.

As illustrated in FIG. 7, the cover unit 400 may have a central shaft 430 and the responsive stoppage portion 410 may be understood as a disk-shaped end portion extending from the central shaft 430 in a radial direction. A cover plate 420 may be positioned above (+z direction) the central shaft 430. A lateral plate 440 may be understood as a portion bent at substantially 90 degrees from the edge of the cover plate 420. When the cover unit 400 is coupled to the middle unit 200, the lateral plate 440 may cover at least a portion of an outer circumferential portion of the middle unit 200 as illustrated in FIG. 2. In FIG. 2, it is illustrated that the lateral plate 220 covers most of the outer circumferential surface of the upper housing 210 of the middle unit 200.

A variety of these components of the cover unit 400 may be formed of a resin, plastic, and/or a metal, as one body. Alternatively, a portion of the components of the cover unit 400 may be separately formed and coupled to the central shaft 430, and in this case, such a portion of the components may be formed of a resin, plastic, or a metal. In the string winding and unwinding apparatus according to the present embodiment, as mentioned above, when the responsive stoppage portion 410 is positioned in the first space below the lower stoppage portion 222, the cover unit 400 may be engaged with the rotating unit 300 and rotated together with the rotating unit 300 in one direction, and accordingly, the string may be wound on the outer circumferential surface of the rotating unit 300. When the responsive stoppage portion 410 is positioned between the upper stoppage portion 221 and the lower stoppage portion 222, the rotating unit 300 may be rotated in the other direction, opposite to the one direction, i.e., an unwinding direction, regardless of movement of the cover unit 400 as the cover unit 400 is separated from the rotating unit 300, and accordingly, the string wound around the outer circumferential surface of the rotating unit 300 may be unwound. That is, the string may be easily wound and unwound according to relative positions of the responsive stoppage portion 410 of the cover unit 400 and the upper stoppage portion 221 and the lower stoppage portion 222 of the middle unit 200.

In order to select winding and unwinding of the string, the user may need to control relative positions of the responsive stoppage portion 410 of the cover unit 400 and the upper stoppage portion 221 and the lower stoppage portion 222 of the middle unit 200.

That is, the user needs to control the responsive stoppage portion 410 of the cover unit 400 positioned in the first space below the lower stoppage portion 222 to be moved so as to be positioned in the second space between the upper stoppage portion 221 and the lower stoppage portion 222, or control the responsive stoppage portion 410 of the cover unit 400 positioned in the second space between the upper stoppage portion 221 and the lower stoppage portion 222 to be moved so as to be positioned in the first space below the lower stoppage portion 222. During the controlling process, an impact may be applied to the upper stoppage portion 221 and/or the lower stoppage portion 222 of the middle unit 200, and a repeated use thereof may result in damage to the upper stoppage portion 221 and the lower stoppage portion 222.

However, in the string winding and unwinding apparatus according to the present embodiment, when the upper stoppage portion 221 and/or the lower stoppage portion 222 of the middle unit 200 are damaged, only the middle unit 200 may need to be replaced, while leaving the base unit 100, the rotating unit 300, and the cover unit 400 as is, and thus, maintenance and repair may be easily and rapidly performed. In addition, in the string winding and unwinding apparatus according to the present embodiment, since maintenance and repair is performed by simply replacing a screw-fit component or inserting a replacement unit without the necessity of a specialized skill or without having to use a specific tool, users may directly easily perform maintenance and repair.

Meanwhile, in the string winding and unwinding apparatus according to the present embodiment, a smooth coating may be formed on surfaces of the upper stoppage portion 221 and/or the lower stoppage portion 222 and/or the responsive stoppage portion 410 or elasticity and/or flexibility may be provided thereto in order to reduce a possibility of damage due to frictional force during a usage process.

During the aforementioned controlling process, an impact may be applied to the responsive stoppage portion 410 of the cover unit 400, rather than to the upper stoppage portion 221 and/or the lower stoppage portion 222 of the middle unit 200, and thus, the responsive stoppage portion 410 of the cover unit 400 may be damaged due to repeated use thereof. Such a problem may be solved by allowing the responsive stoppage portion 410 to have elasticity.

However, in the case of the string winding and unwinding apparatus according to the present embodiment, when the responsive stoppage portion 410 of the cover unit 400 is damaged, only the cover unit 400 may be simply replaced, while leaving the base unit 100, the middle unit 200, and the rotating unit 300 as is, and thus, maintenance and repair may be easily and rapidly performed.

Figure 8:
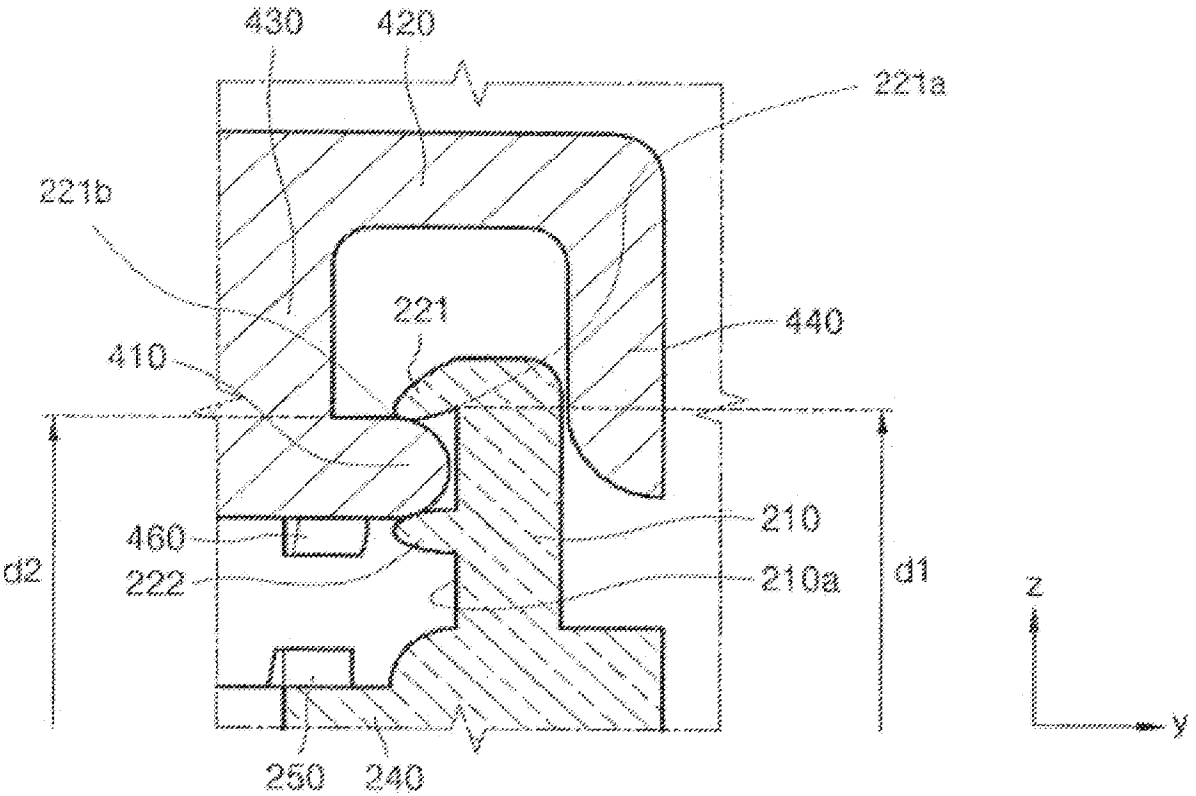
FIG. 8 is a cross-sectional view of a portion of the string winding and unwinding apparatus of FIG. 1.

FIG. 8 is a cross-sectional view of a portion of the string winding and unwinding apparatus of FIG. 1. Similarly, FIG. 2, a cross-sectional view of the string winding and unwinding apparatus of FIG. 1, illustrates a state in which the responsive stoppage portion 410 is positioned in the first space below the lower stoppage portion 222 so the cover unit 400 is engaged with the rotating unit 300, and in this state, the string may be wound according to rotation of the cover unit 400 and the rotating unit 300 in one direction. In FIG. 8, the response stoppage portion 410 is positioned in the second space between the upper stoppage portion 221 and the lower stoppage portion 222 so the cover unit 400 is spaced apart from the rotating unit 300, releasing winding of the string. In this state, the rotating unit 300 may be able to rotate in the other direction (an unwinding, or releasing direction), an opposite direction of the one direction (winding direction), regardless of the cover unit 400, the string may be unwound.

As illustrated in FIG. 8, a distance d2 between a second portion 221*b* of the upper stoppage portion 221 away from the upper housing 210 and the base plate 110 may be shorter than a distance d1 between a first portion 221*a* of the upper stoppage portion 221 adjacent to the upper housing 210 and the base plate 110.

As described above, in order to select winding and unwinding of the string, the user needs to control relative positions of the responsive stoppage portion 410 of the cover unit 400 and the upper stoppage portion 221 and the lower stoppage portion 222 of the middle unit 200. In a state in which the responsive stoppage portion 410 is positioned in the second space between the upper stoppage portion 221 and the lower stoppage portion 222, the user may press the cover unit 400 in a direction toward the base unit 100 such that the responsive stoppage portion 410 is moved to be positioned in the first space below the lower stoppage portion 222. Conversely, in a state in which the responsive stoppage portion 410 of the cover unit 400 is positioned in the first space below the lower stoppage portion 222, the user may pull the cover unit 400 in a direction (+z direction) away from the base unit 100 such that the responsive stoppage portion 410 is moved to be positioned in the second space between the upper stoppage portion 221 and the lower stoppage portion 222. During this process, in order to prevent the cover unit 400 from being separated from the middle unit 200, as illustrated in FIG. 8, the distance d2 between the second portion (end portion in the direction toward the central shaft 430) of the upper stoppage portion 221 away from the upper housing 210 and the base plate 110 is shorter than the distance d1 between the first portion of the upper stoppage portion 221 adjacent to the upper housing 210 and the base plate 110. For example, the upper stoppage portion 221 may have a shape of drooping in a direction toward the base plate 110 so that the upper stoppage portion 221 is closer to the base plate 110 as it is away from the inner circumferential surface 210*a* of the upper housing 210. However, the present disclosure is not limited thereto and the upper stoppage portion 221 may have a shape that does not droop toward the base plate 110.

Meanwhile, in order to control the response stoppage portion 410 positioned in the second space between the upper stoppage portion 221 and the lower stoppage portion 222 to move to be positioned in the first space below the lower stoppage portion 222, the user may press the cover unit 400 in a direction toward the base unit 100. According to circumstances, it may be necessary to prevent the cover unit 400 from excessively moving toward the base unit 100. This may be implemented by using the partition 240 of the middle unit 200.

As described above, the partition 240 is positioned to be closer to the base plate 110 than the lower stoppage portion 222, and may have a shape protruding in an inward direction (direction toward the central shaft 430) from the upper housing 210. When the responsive stoppage portion 410 of the cover unit 400 is positioned in the space below the lower stoppage portion 222, an excessive movement of the responsive stoppage portion 410 in the direction toward the base unit 100 may be effectively prevented by the partition 240.

When the responsive stoppage portion 410 is positioned in the first space below the lower stoppage portion 222, the cover unit 400 is engaged with the rotating unit 300, and in this case, the cover unit 400 and the rotating unit 300 may rotate only in one preset direction according to operations of the ratchet protrusion 460 and the responsive protrusion 250. In detail, surfaces of the ratchet protrusion 460 and the responsive protrusion 250 that meet each other in the winding direction are surfaces that meet each other at a gentle sloped angle so as to mutually overstride, while surfaces of the ratchet protrusion 460 and the responsive protrusion 250 that meet each other in the opposite direction of the winding direction are vertical surfaces standing in the +z direction, and thus, rotation is not possible in the opposite direction, namely, in the winding releasing direction. This is because, if the rotating unit 300 rotates in the other direction, regardless of a user's intention, the string wound on the rotating unit 300 may be unwound irrespective of the user intention.

As described above, the responsive protrusion 250 may be positioned on a surface of the partition 240 in a direction (+z direction) of the lower stoppage portion 222. Here, when the cover unit 400 may have the ratchet protrusion 460 (please refer to FIG. 7) in one direction, and when the responsive stoppage portion 410 is positioned in the first space below the lower stoppage portion 222, the responsive protrusion 250 may be engaged with the ratchet protrusion 460. When the responsive protrusion 250 is engaged with the ratchet protrusion 460, the cover unit 400 may rotate only in one preset direction with respect to the middle unit 200, and thus, the rotating unit 300 engaged with the cover unit 400 may also rotate only in one preset direction.

In the case of the responsive protrusion 250 having such a shape as that illustrated in FIG. 4 and the ratchet protrusion 460 having such a shape as that illustrated in FIG. 7, in a state in which the responsive stoppage portion 410 is positioned in the first space below the lower stoppage portion 222, the cover unit 400 may rotate only in a clockwise direction (i.e., the winding direction) when the user views the cover unit 400 in the −z direction. Here, as illustrated in FIG. 8, when the response stoppage portion 410 is positioned in the second space between the upper stoppage portion 221 and the lower stoppage portion 222, the responsive protrusion 250 may be separated from the ratchet protrusion 460.

Figure 9:
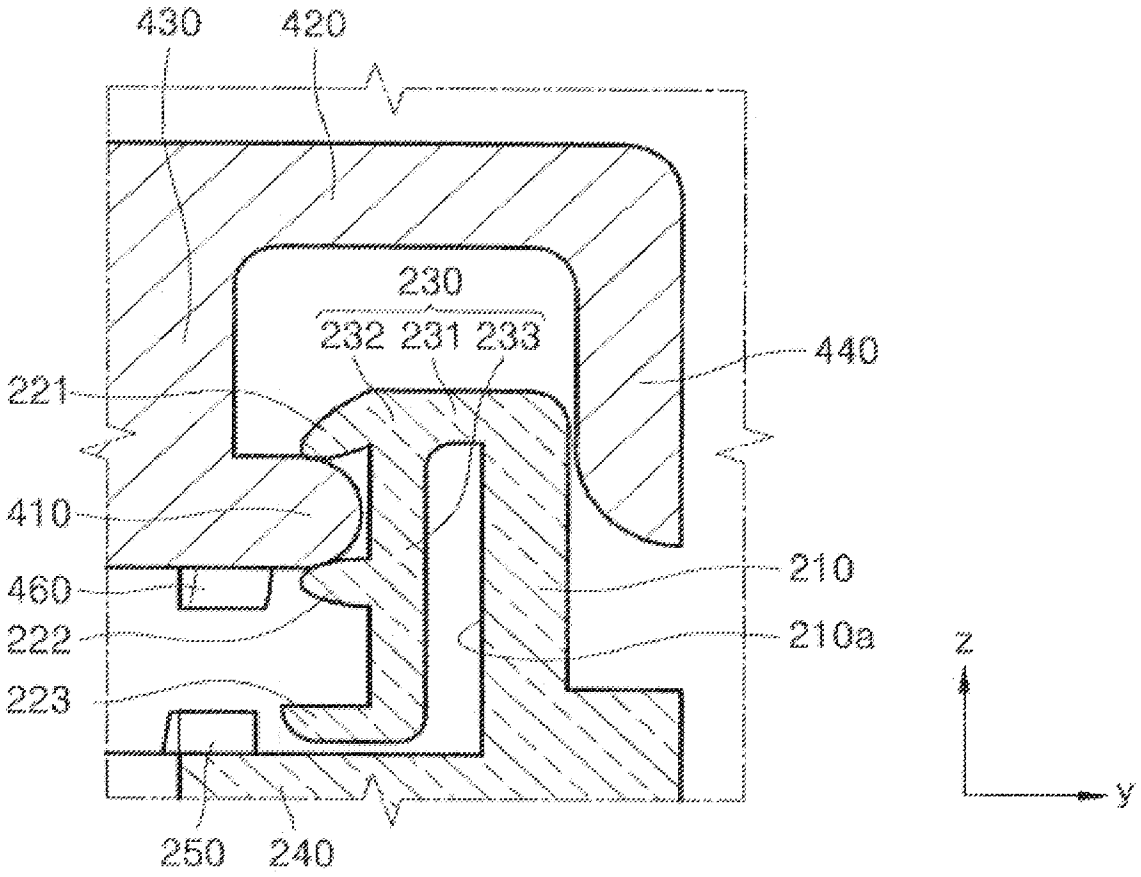
FIG. 9 is a cross-sectional view of a portion of a string winding and unwinding apparatus according to another embodiment of the present disclosure.

FIG. 9 is a cross-sectional view of a portion of a string winding and unwinding apparatus according to another embodiment of the present disclosure. As illustrated in FIG. 9, the string winding and unwinding apparatus according to the present embodiment, the middle unit 200 may have a stoppage support portion 230.

The stoppage support portion 230 may have a shape extending from the upper housing 210 inwardly (direction toward the central shaft 430) and bent such that a space is present between the stoppage support portion 230 and the inner circumferential surface 210*a* of the upper housing 210. In detail, the stoppage support portion 230 may have a first portion 231 extending inwardly from the upper housing 210, a second portion 233 extending in a direction (−z direction) intersecting the first portion 231, and a bent portion 232 between the first portion 231 and the second portion 233. Thus, a space may be present between the second portion 233 of the stoppage support portion 230 and the inner circumferential surface 210*a* of the upper housing 210. The stoppage support portion 230 may be integrated with the upper housing 210 as illustrated in FIG. 9. The upper stoppage portion 221 and the lower stoppage portion 222 may be positioned on a surface of the stoppage support portion 230 in a direction (direction toward the central shaft 430) away from the upper housing 210. The upper stoppage portion 221 and the lower stoppage portion 222 may be integrated with the stoppage support portion 230 as illustrated in FIG. 9 or may be installed as separate components.

When the user presses the cover unit 400 in a direction toward the base unit 100 or when the user pulls the cover unit 400 away from the base unit 100, the responsive stoppage portion 410 positioned in the second space between the upper stoppage portion 221 and the lower stoppage portion 222 may move to the first space below the lower stoppage portion 222. Here, since the space is present between the stoppage support portion 230 and the inner circumferential surface 210*a* of the upper housing 210 as described above, when the responsive stoppage portion 410 moves, the stoppage support portion 230 may be slightly bent to move in a direction toward the inner circumferential surface 210*a* of the upper housing 210, and thereafter, when the movement of the responsive stoppage portion 410 is completed, the stoppage support portion 230 may return to its original position. Accordingly, damage to the responsive stoppage portion 410, the upper stoppage portion 221 and/or the lower stoppage portion 222 due to the movement of the responsive stoppage portion 410 may be effectively prevented, and in addition, ease of manipulation of the cover unit 400 by the user may be further enhanced.

In addition to the upper stoppage portion 221 and the lower stoppage portion 222, as illustrated in FIG. 9, a third (additional) stoppage portion 223 may be positioned on the stoppage support portion 230 such that the additional stoppage portion 223 is closer to the base plate 110 than the lower stoppage portion 222. Like the upper stoppage portion 221 and the lower stoppage portion 222, the additional stoppage portion 223 may be positioned on a surface of the stoppage support portion 230 in a direction (direction toward the central shaft 430) away from the upper housing 210. The additional stoppage portion 223 may serve to limit the first space below the lower stoppage portion 222 together with the lower stoppage portion 222. The additional stoppage portion 223 may limit a movement of the responsive stoppage portion 410 in a direction toward the base plate 110, thus serving to prevent the cover unit 400 from excessively moving in the direction toward the base unit 100. However, without the additional stoppage portion 223, the space between the lower stoppage portion 222 and the partition 240 may serve to limit the first space. This is no different in the embodiments or modified examples thereof described above and/or described hereinafter.

Figure 10:
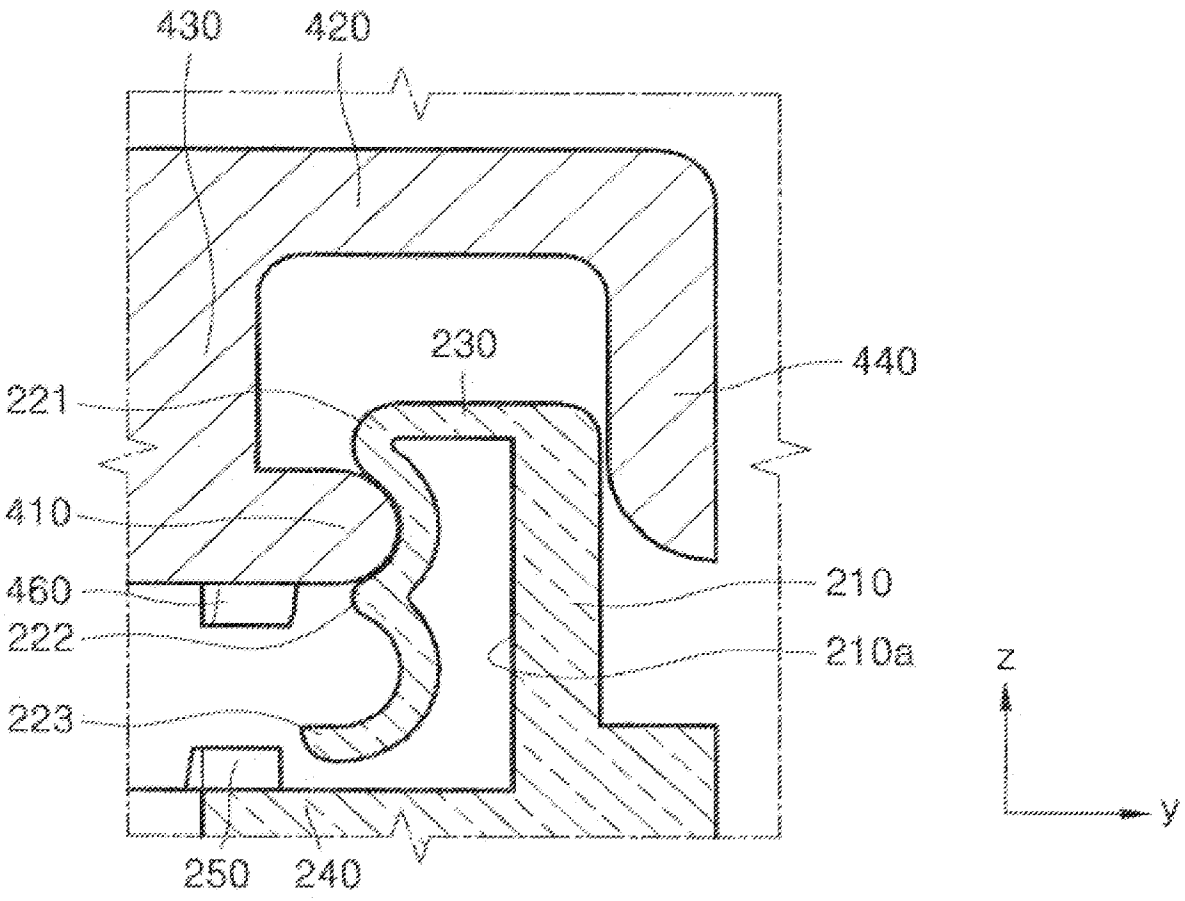
FIG. 10 is a cross-sectional view of a portion of a string winding and unwinding apparatus according to another embodiment of the present disclosure.

FIG. 10 is a cross-sectional view of a portion of a string winding and unwinding apparatus according to another embodiment of the present disclosure. In the string winding and unwinding apparatus according to the present embodiment, the stoppage support portion 230 has a shape extending inwardly (direction toward the central shaft 430) from the upper housing 210. The stoppage support portion 230 extends inwardly from the upper housing 210 such that a space is present between the stoppage support portion 230 and the inner circumferential surface 210*a* of the upper housing 210, and has a shape of being bent a plurality of times. In detail, the stoppage support portion 230 is bent a plurality of times such that at least two portions thereof are convex in a direction (direction toward the central shaft 430) away from the upper housing 210. The upper stoppage portion 221 and the lower stoppage portion 222 may be understood as the convex portions of the stoppage support portion 230. As illustrated in FIG. 10, the stoppage support portion 230 may be integrated with the upper housing 210.

When the user presses the cover unit 400 in a direction toward the base unit 100 or when the user pulls the cover unit 400 away from the base unit 100, the responsive stoppage portion 410 positioned in the second space between the upper stoppage portion 221 and the lower stoppage portion 222 may move to the first space below the lower stoppage portion 222. Here, since the space is present between the stoppage support portion 230 and the inner circumferential surface 210*a* of the upper housing 210 as described above, when the responsive stoppage portion 410 moves, the stoppage support portion 230 may be slightly bent to move in a direction toward the inner circumferential surface 210*a* of the upper housing 210, and thereafter, when the movement of the responsive stoppage portion 410 is completed, the stoppage support portion 230 may return to its original position. Accordingly, damage to the responsive stoppage portion 410, the upper stoppage portion 221 and/or the lower stoppage portion 222 due to the movement of the responsive stoppage portion 410 may be effectively prevented, and in addition, ease of manipulation of the cover unit 400 by the user may be further enhanced.

As illustrated in FIG. 10, in the stoppage support portion 230 having a shape of being bent a plurality of times, an end portion thereof in a direction toward the base plate 110 may have a shape of being oriented in a direction (direction toward the central shaft 430) away from the inner circumferential surface 210*a* of the upper housing 210. The end portion may be understood as the additional stoppage portion 223 as described above with reference to FIG. 9. That is, the end portion may serve to limit the first space below the lower stoppage portion 222 together with the lower stoppage portion 222. The additional stoppage portion 223 may limit a movement of the responsive stoppage portion 410 in a direction toward the base plate 110, thus serving to prevent the cover unit 400 from excessively moving in the direction toward the base unit 100.

Figure 11:
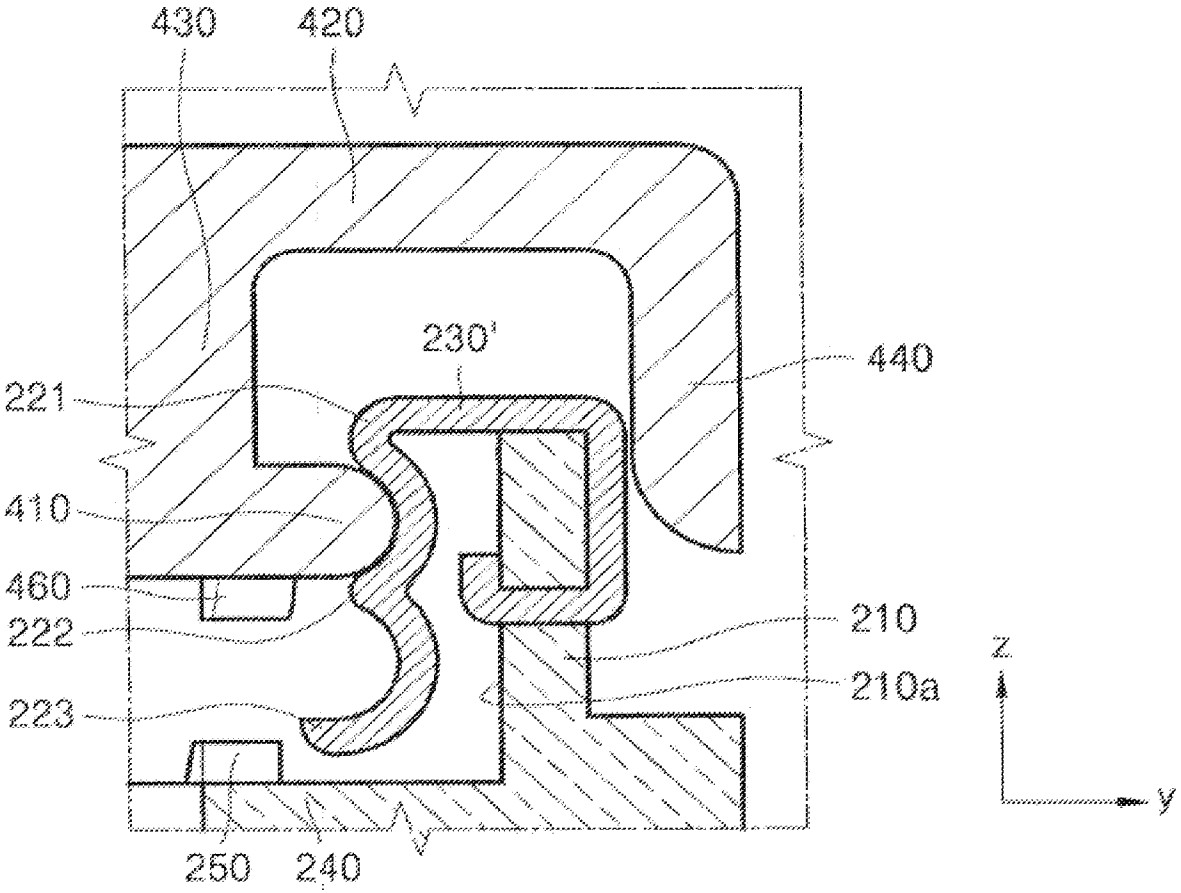
FIG. 11 is a cross-sectional view of a portion of a string winding and unwinding apparatus according to another embodiment of the present disclosure.

In FIG. 10, the stoppage support portion 230 having a shape which is bent a plurality of times, which extends in an inward direction from the upper housing 210, is integrated with the upper housing 210, but the present disclosure is not limited thereto. For example, as illustrated in FIG. 11, a cross-sectional view of a portion of the string winding and unwinding apparatus according to another embodiment of the present disclosure, the middle unit 200 of the string winding and unwinding apparatus according to the present embodiment may have a flexure 230' as a separate component. The flexure 230' may be installed in a aperture penetrating through the upper housing 210 or a recess. In FIG. 11, it is illustrated that the flexure 230' is fixed to the upper housing 210 as a portion thereof is inserted into a aperture penetrating through the upper housing 210. Most of the flexure 230' is positioned at an inner side of the upper housing 210. That is, when the flexure 230' is fixed to the upper housing 210, most of the flexure 230' is positioned at the inner side of the upper housing 210 except for a portion thereof used to be fixed to the upper housing 210.

The flexure 230' may have a shape similar to that of the stoppage support portion 230 having a shape of being bent a plurality of times described above with reference to FIG. 10. That is, the flexure 230' may have a bent shape such that a space is present between the flexure 230' and the inner circumferential surface 210*a* of the upper housing 210. In detail, the flexure 230' may be bent a plurality of times such that at least two convex portions are present in a direction (direction toward the central shaft 430) away from the upper housing 210. The upper stoppage portion 221 and the lower stoppage portion 222 may be understood as the convex portions of the flexure 230'. The flexure 230' may be formed using a resin, plastic, or a metal plate, and preferably, the flexure 230' has elasticity.

When the user presses the cover unit 400 in a direction toward the base unit 100 or when the user pulls the cover unit 400 away from the base unit 100, the responsive stoppage portion 410 positioned in the second space between the upper stoppage portion 221 and the lower stoppage portion 222 may move to the first space below the lower stoppage portion 222. Here, since the space is present between the flexure 230' and the inner circumferential surface 210*a* of the upper housing 210 as described above, when the responsive stoppage portion 410 moves, the flexure 230' may be slightly moved in a direction toward the inner circumferential surface 210*a* of the upper housing 210, and thereafter, when the movement of the responsive stoppage portion 410 is completed, the flexure 230' may return to its original position. Accordingly, damage to the responsive stoppage portion 410, the upper stoppage portion 221 and/or the lower stoppage portion 222 due to the movement of the responsive stoppage portion 410 may be effectively prevented, and in addition, ease of manipulation of the cover unit 400 by the user may be further enhanced. In addition, when the flexure 230' is damaged due to repeated use thereof by the user, only the flexure 230' may be replaced, remarkably enhancing ease of maintenance and repair of the string winding and unwinding apparatus.

As illustrated in FIG. 11, the flexure 230' having the shape of being bent a plurality of times, an end portion thereof in a direction toward the base plate 110 may have a shape of being oriented in a direction (direction toward the central shaft 430) away from the inner circumferential surface 210*a* of the upper housing 210. The end portion may be understood as the additional stoppage portion 223 as described above with reference to FIG. 9. That is, the end portion may serve to limit the first space below the lower stoppage portion 222. The additional stoppage portion 223 may limit a movement of the responsive stoppage portion 410 in a direction toward the base plate 110, thus serving to prevent the cover unit 400 from excessively moving in the direction toward the base unit 100.

Also, in the embodiments of FIGS. 8 through 10, the upper stoppage portion and the lower stoppage portion may be configured using separate components, like the embodiment of FIG. 11.

Figure 12:
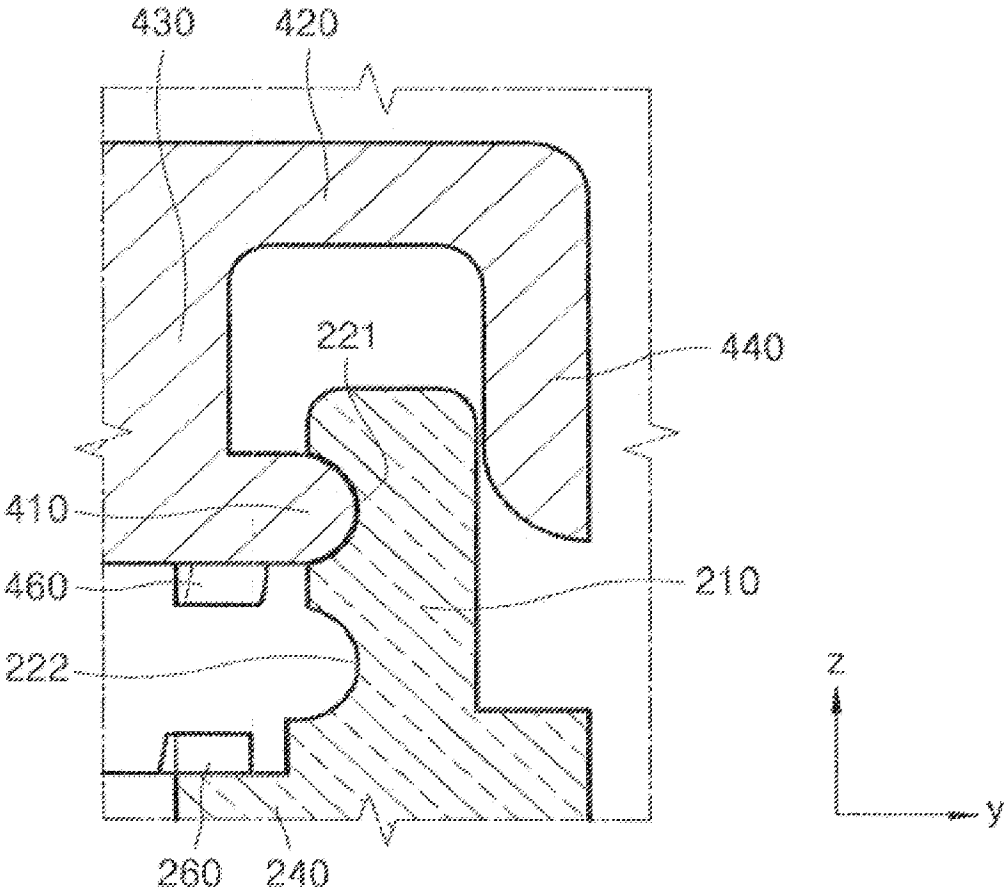
FIG. 12 is a cross-sectional view of a portion of a string winding and unwinding apparatus according to another embodiment of the present disclosure.

FIG. 12 is a cross-sectional view of a portion of a string winding and unwinding apparatus according to another embodiment of the present disclosure. As illustrated in FIG. 12, in the string winding and unwinding apparatus according to the present embodiment, the upper stoppage portion 221 and the lower stoppage portion 222 may have a shape of being concavely recessed from the surface of the upper housing 210. That is, the upper stoppage portion 221 and the lower stoppage portion 222 may be understood as concave portions formed on the inner circumferential surface 210*a* of the upper housing 210. In this case, when at least a portion of the responsive stoppage portion 410 is positioned within the lower stoppage portion 222, the cover unit 400 is engaged with the rotating unit 300, and when at least a portion of the responsive stoppage portion 410 is positioned within the upper stoppage portion 221, the cover unit 400 may be separated from the rotating unit 300.

In the string winding and unwinding apparatus according to the present embodiment, when the responsive stoppage portion 410 positioned within the upper stoppage portion 221 moves to be positioned within the lower stoppage portion 222 or when the responsive stoppage portion 410 positioned within the lower stoppage portion 222 moves to be positioned within the upper stoppage portion 221, the movement of the responsive stoppage portion 410 needs to be facilitated. To this end, at least a portion of the responsive stoppage portion 410 may be flexible. Specifically, at least an end portion of the responsive stoppage portion 410 (in the direction toward the upper housing 210) may be flexible. For example, the end portion of the responsive stoppage portion 410 may include rubber or a leaf spring so as to be flexible. The configuration in which at least a portion of the responsive stoppage portion 410 is flexible may also be applied to all of the embodiments described above with reference to the drawings, embodiments to be described hereinafter, or modified examples thereof, as well as to the case of the present embodiment.

Figure 13:
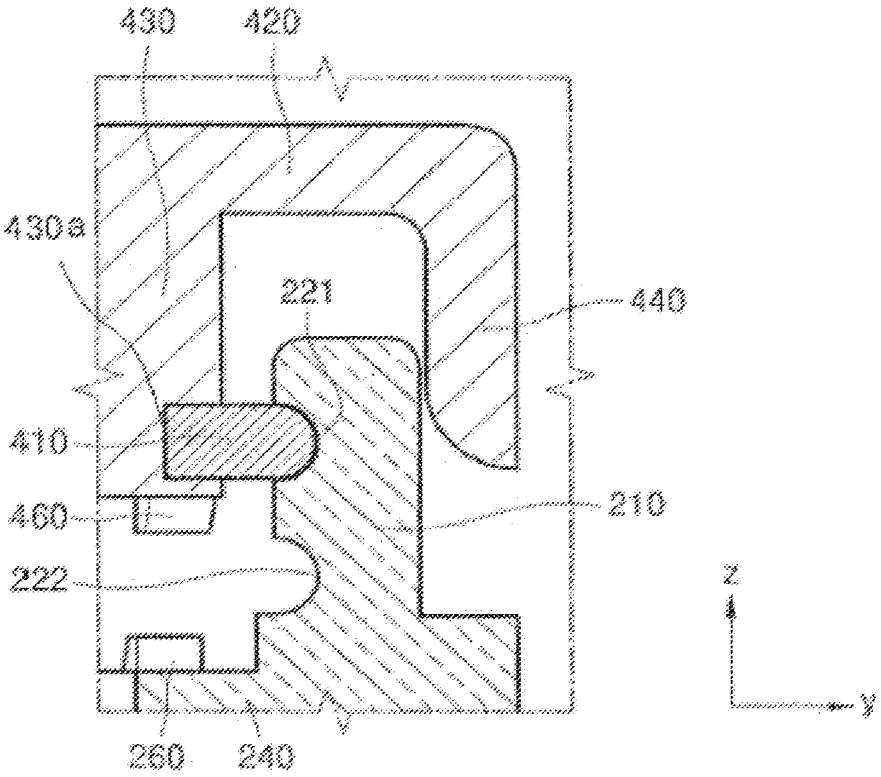
FIG. 13 is a cross-sectional view of a portion of a string winding and unwinding apparatus according to another embodiment of the present disclosure.

Alternatively, as illustrated in FIG. 13, a cross-sectional view of a portion of the string winding and unwinding apparatus according to another embodiment, a recess 430*a* may be formed on an outer surface of the central shaft 430 of the cover unit 400, and the responsive stoppage portion 410 may be press-fit to the recess 430*a*. Also, in this case, at least a portion of the responsive stoppage portion 410 may be formed to be flexible. Specifically, an end portion (in the direction toward the upper housing 210) of the responsive stoppage portion 410 may be formed to be flexible. For example, the responsive stoppage portion 410 or the end portion of the responsive stoppage portion 410 may include rubber or a leaf spring so as to be flexible. The configuration in which the recess 430*a* is formed on an outer surface of the central shaft 430 of the cover unit 400 and the responsive stoppage portion 410 is press-fit to the recess 430*a* may also be applied to all of the embodiments described above with reference to the drawings, embodiments to be described hereinafter, or modified examples thereof, as well as to the case of the present embodiment. Here, for reference, the configuration in which the recess 430*a* is formed on an outer surface of the central shaft 430 may be understood as including a configuration in which a aperture penetrating through the central shaft 430 is formed. This is because, a portion of the aperture may be construed as a recess of the outer surface of the central shaft 430.

As described above, when the cover unit 400 is engaged with the rotating unit 300, the ratchet protrusion 460 and the responsive protrusion 250 are engaged with each other, and when the cover unit 400 is separated from the rotating unit 300, the ratchet protrusion 460 and the responsive protrusion 250 are separated from each other.

In FIGS. 1 through 13 referred to which describe the embodiments so far, it is illustrated that the ratchet protrusion 460 is positioned on a lower surface of the cover unit 400 in the direction (−z direction) toward the base plate 110 and the responsive protrusion 250 is formed in the middle unit 200 and protrudes in the +z direction toward the cover unit 400. In detail, in FIGS. 1 through 13, it is illustrated that the ratchet protrusion 460 is positioned on a lower surface of the central shaft 430 in the direction (−z direction) toward the base plate 110 or on a lower surface of the responsive stoppage portion 410 in the direction (−z direction) of the base plate 110 and the responsive protrusion 250 is positioned on an upper surface of the partition 240 in the direction (+z direction) of the cover unit 400. However, the present disclosure is not limited thereto.

Figure 14:
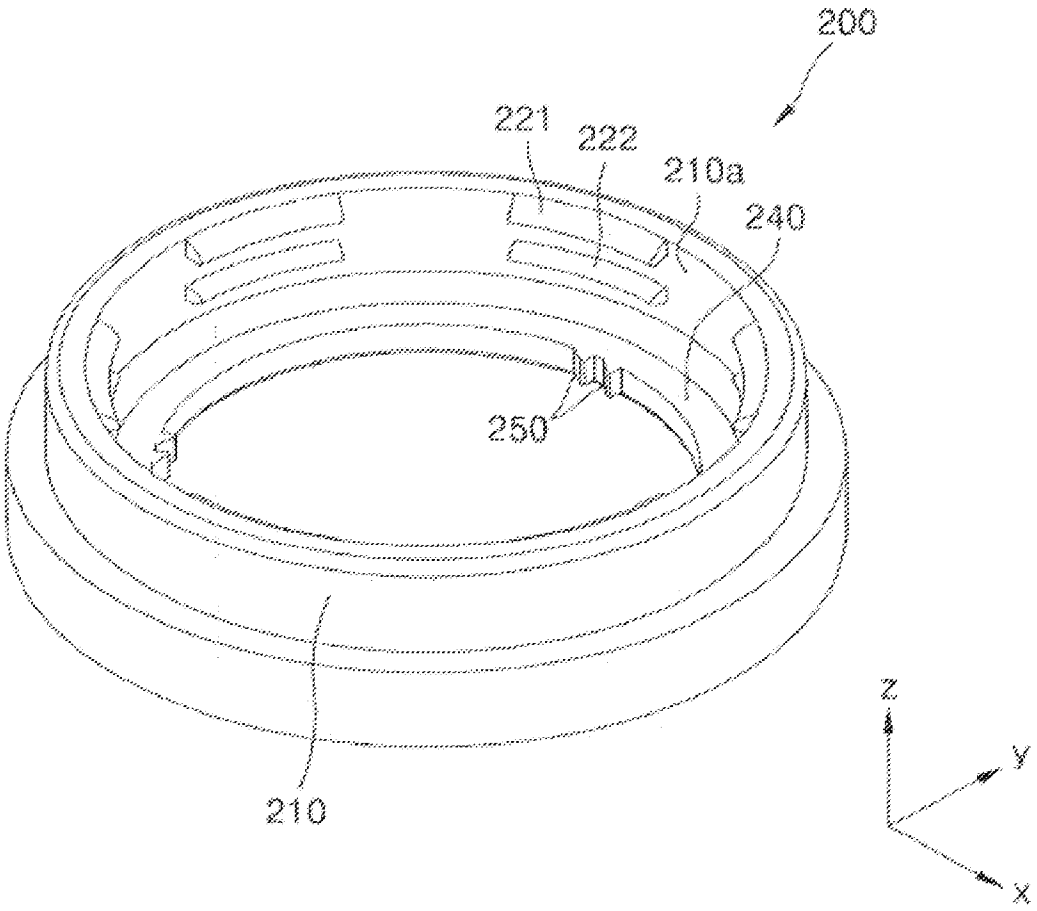
FIG. 14 is a perspective view schematically illustrating a middle unit of a string winding and unwinding apparatus according to another embodiment of the present disclosure.
Figure 15:
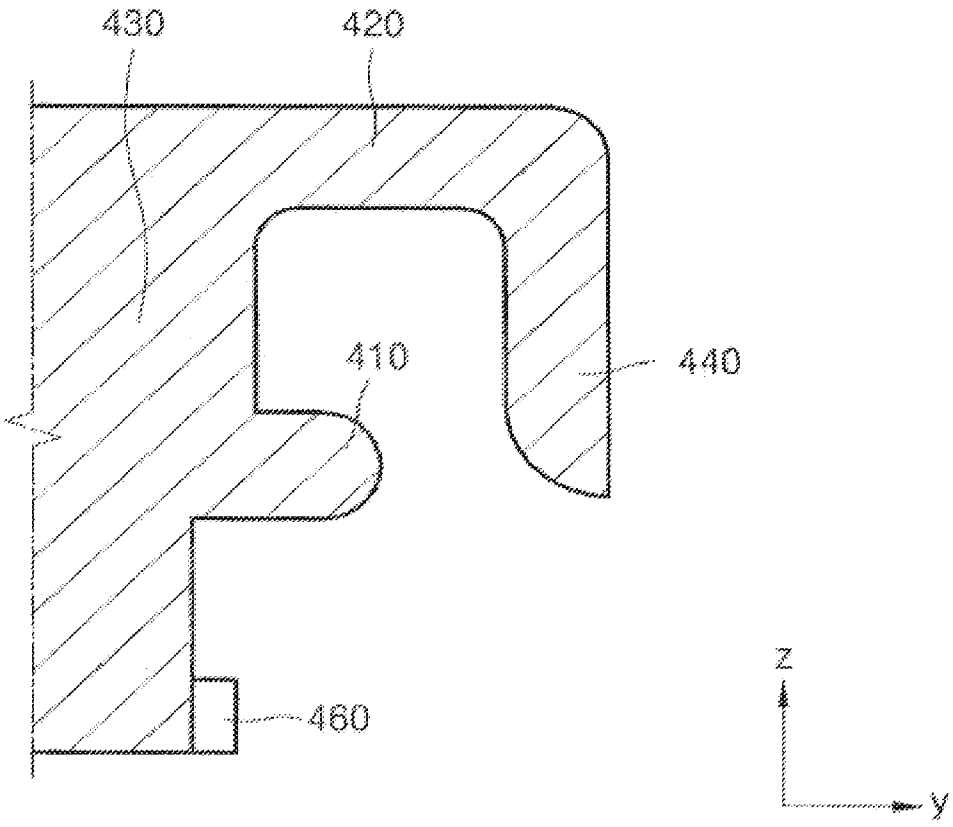
FIG. 15 is a cross-sectional view of a portion of a cover unit that may be used together with the middle unit of FIG. 14.

For example, as illustrated in FIG. 14, a perspective view schematically illustrating the middle unit 200 of the string winding and unwinding apparatus according to another embodiment of the present disclosure, the responsive protrusion 250 may be positioned on an inner surface of the partition 240 in a direction toward the center of the upper housing 210. In this case, as illustrated in FIG. 15, a cross-sectional view of a portion of the cover unit 400 that may be used together with the middle unit 200 of FIG. 14, the ratchet protrusion 460 may also be positioned on a side surface of the central shaft 430 of the cover unit 400, namely, on an outer side surface of the central shaft 430 of the cover unit 400 in a direction toward the upper housing 210, so that the ratchet protrusion 460 may be engaged with the responsive protrusion 250 or may be separated therefrom. To this end, as illustrated in FIG. 15, the central shaft 430 of the cover unit 400 may extend further than the position of the responsive stoppage portion 410 in a downward direction (−z direction).

In the embodiments described so far, the examples in which both the ratchet protrusion 460 and the responsive protrusion 250 protrude convexly have been described, but any one of the ratchet protrusion 460 and the responsive protrusion 250 may have a concavely recessed shape. That is, any configuration may belong to the technical concept of the present invention as long as a ratchet protrusion and a response protrusion are fit to each other, surfaces thereof that meet in a winding direction meet at a gentle sloped angle so as to mutually overstride, and surfaces thereof that meet in a winding releasing direction meet at an angle similar to that of at least a vertical wall so movement thereof is limited.

Figure 16:
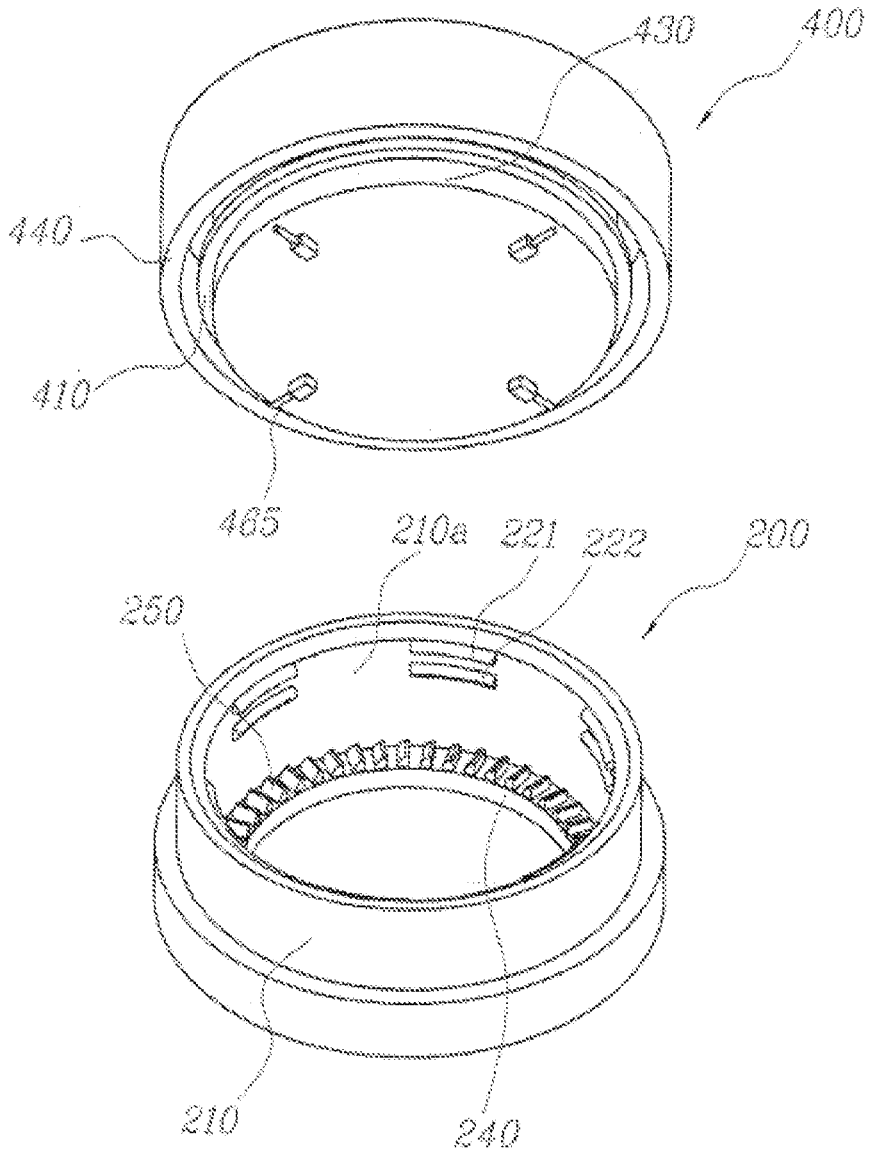
FIG. 16 is a perspective view illustrating a reverse rotation preventing portion according to another embodiment of the present disclosure.

According to another embodiment of the present disclosure illustrated in FIG. 16, an elastic bar 465, instead of the ratchet protrusion 460, is installed in the cover unit 400. Meanwhile, the responsive protrusion 250 of the middle unit 200 is formed to protrude toward the cover unit 400 from the partition 240 of the middle unit 200. A plurality of responsive protrusions 250 are continuously formed along the partition 240 formed to have a circular shape, a gentle sloped surface is formed on one surface thereof to allow the elastic bar 465 of the cover unit 400 to overstride thereon so as to be rotated in a direction in which the string is wound, and a vertical surface or a sloped surface more tilted in the winding direction is formed on the other surface thereof such that the string cannot rotate reversely in an unwinding direction. The use of the configuration of the elastic bar 465, instead of the ratchet protrusion 460, may prevent reverse rotation of the cover unit 400 through only one or some elastic bars 465, reduce frictional wear due to the elastic deformation of the elastic bar 465, and thus may be used many times before wearing out.

Figure 17:
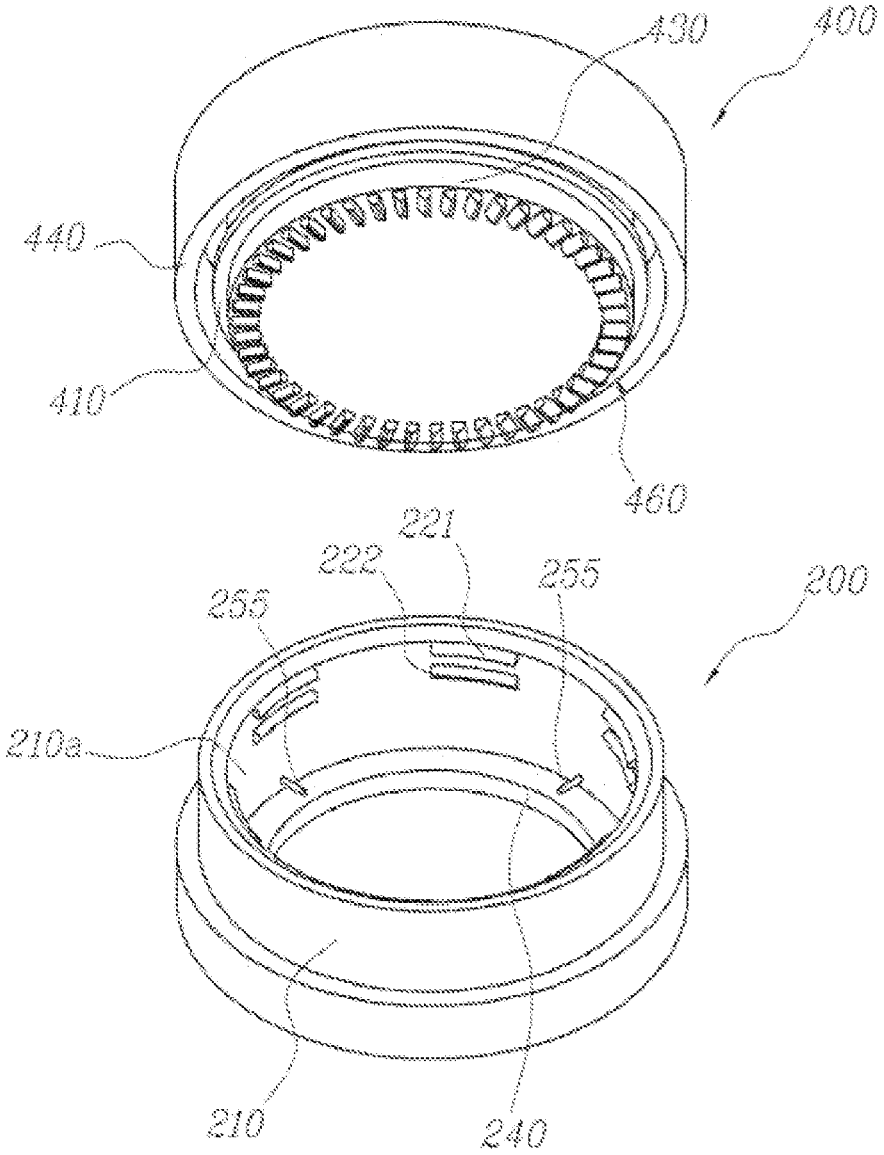
FIG. 17 is a perspective view illustrating a reverse rotation preventing portion according to another embodiment of the present disclosure.

According to another embodiment of the present disclosure illustrated in FIG. 17, an elastic bar 255, instead of the responsive protrusion 250, is installed in the middle unit 200. Here, the ratchet protrusion 460 of the cover unit 400 is formed on the lower surface of the cover unit 400 in a direction (−z direction) toward the base plate 110 in the same manner as those described above with reference to FIGS. 1 through 13. The ratchet protrusion 460 of the cover unit 400 has a gentle sloped surface formed on one surface thereof so as to rotate in a direction in which the string is wound and a vertical surface, or a sloped surface more tilted in the winding direction, formed on the other surface thereof so as not to reversely rotate in a direction in which the string is unwound. The use of the configuration of the elastic bar 255, instead of the responsive protrusion 250, as in the present embodiment allows the ratchet protrusion 460 to smoothly overstride on the elastic bar 255 due to elastic deformation of the elastic bar 255, ensuring a smooth operation and enhancing durability.

Figure 18:
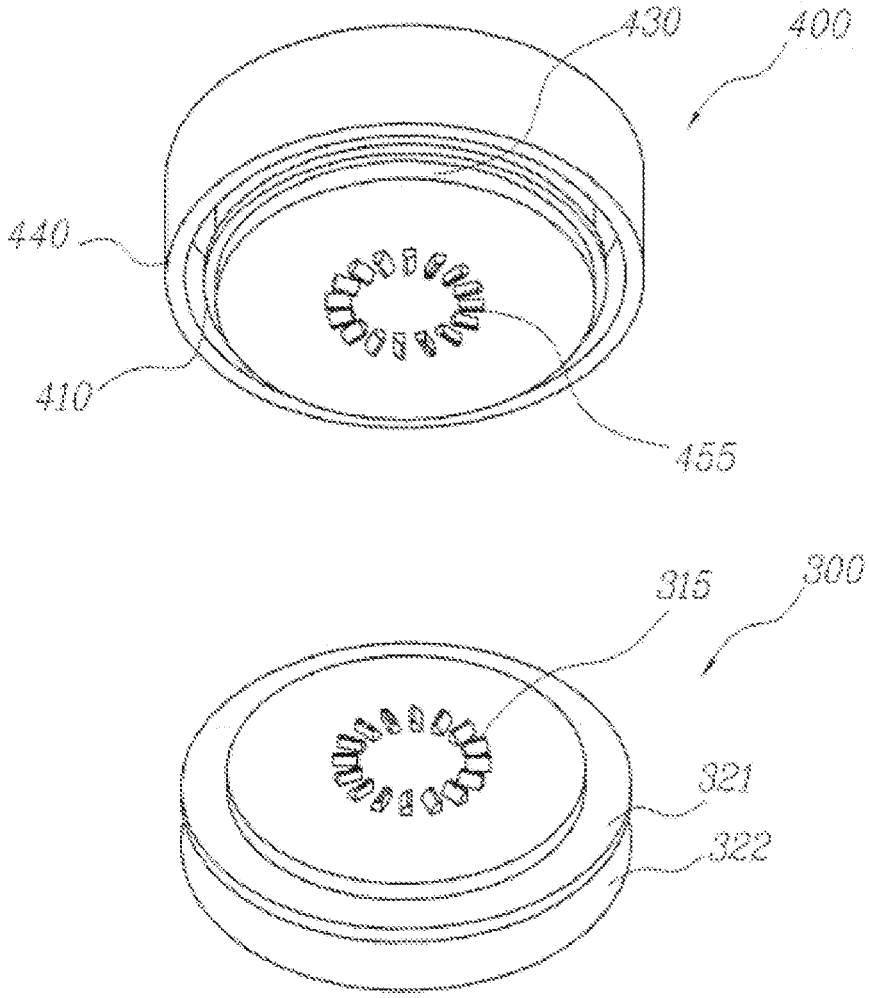
FIG. 18 is a perspective view illustrating an engaging portion according to another embodiment of the present disclosure.
Figure 19:
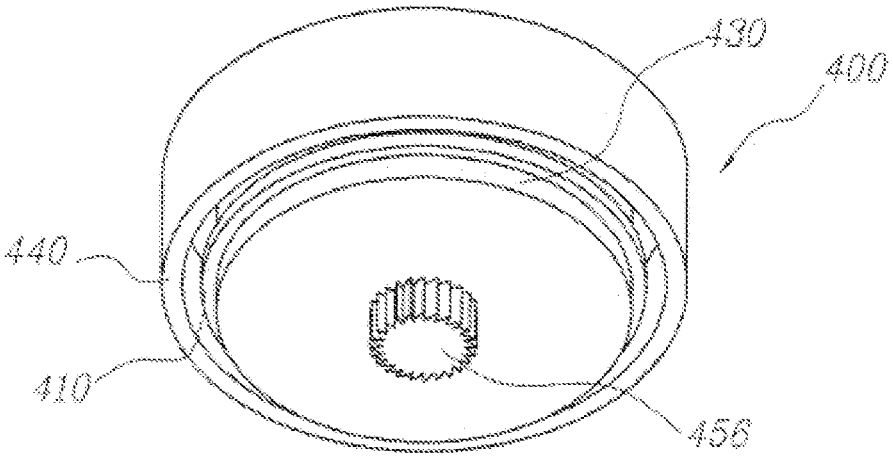
FIG. 19 is a perspective view illustrating an engaging portion according to another embodiment of the present disclosure.
Figure 19:
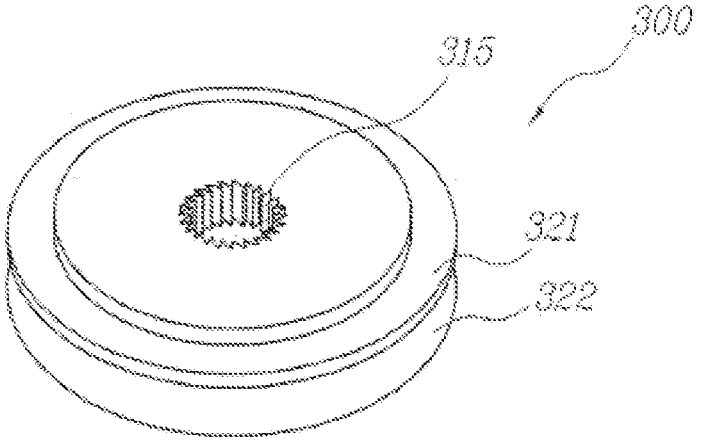

FIGS. 18 and 19 are views illustrating modified examples of the first engaging portion 310 of the rotating unit 300 and the second engaging portion 450 of the cover unit 400 illustrated in FIGS. 1 through 13.

According to another embodiment of the present disclosure illustrated in FIG. 18, a first engaging portion 315 of the rotating unit 300 and a second engaging portion 455 of the cover unit 400 are configured as ratchet protrusions having a sloped surface and a vertical surface in mutually opposite directions. According to this configuration, in the direction in which the string is wound, the vertical surfaces of the second engaging portion 455 of the cover unit 400 and the first engaging portion 315 of the rotating unit 300 are tightly attached, and thus, the mutual vertical surfaces cannot overstride on each other, and in the direction in which the string is unwound, the gentle sloped surfaces thereof are tightly attached, and thus, the gentle sloped surfaces overstride on each other so as to rotate. In other words, the engaging portions are configured in a direction opposite to the directions of the sloped surface and vertical surface of the reverse rotation preventing portion described above with reference to FIGS. 16 and 17. The reason for the configuration of the engaging portions is because the cover unit 400 and the rotating unit 300 should be engaged with each other to rotate together when the engaging portions are rotated in the direction in which the string is wound. According to another embodiment of the present disclosure, in the embodiment of FIG. 18, any one of the first engaging portion 455 of the cover unit 400 and the first engaging portion 315 of the rotating unit 300 may be configured as an elastic bar as illustrated in FIGS. 16 and 17. Also, in the embodiment of FIG. 18, any one of the first engaging portion 455 of the cover unit 400 and the first engaging portion 315 of the rotating unit 300 may be configured as a protrusion and the other may be configured as a recess to which the protrusion may be press-fit.

According to another embodiment of the present disclosure illustrated in FIG. 19, the first engaging portion 315 has a recess shape having a serrated sloped surface formed along an inner circumferential surface, and the second engaging portion 456 of the cover unit 400 has a bar shape having a serrated sloped surface formed along an outer circumferential surface. According to the configuration of the first engaging portion 310 having a hexagonal recess and the second engaging portion 450 having a hexagonal bar shape, when the cover unit 400 is pressed (in the −z direction), if the hexagonal corners of the first engaging portion 310 and the second engaging portion 450 do not fit to each other, angles should be repeatedly adjusted to align them. In contrast, according to the present embodiment illustrated in FIG. 19, when the cover unit 400 is pressed (in the −z direction), since a probability that adjacent sawteeth are engaged is high, compared with the hexagonal shape, aligning may be easily performed. In addition, the uppermost end of the sloped surface of the recess having the serrated shape forming the first engaging portion 315 of the rotating unit 300 may be cut away in a chamfered manner and the lowermost end of the sloped surface of the bar having the serrated shape forming the second engaging portion 455 of the cover unit 400 may be cut away in a chamfered manner, and in this state, when the cover unit 400 is pressed (in the −z direction), the first engaging portion 316 and the second engaging portion 455 may be smoothly engaged with each other, eliminating the necessity of aligning.

Although not shown in FIGS. 18 and 19, according to another embodiment of the present disclosure, the engaging portions between the cover unit 400 and the rotating unit 300 may be configured as a unidirectional clutch bearing.

Figure 20:
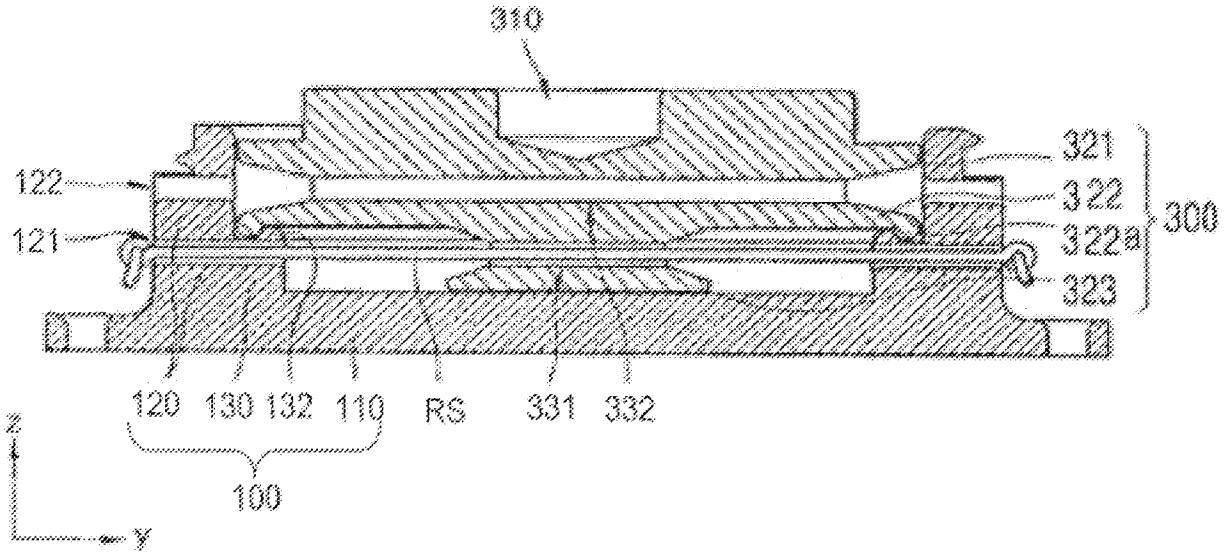
FIG. 20 is a cross-sectional view schematically illustrating a base unit, a rotating unit, and a restoring unit of the string winding and unwinding apparatus of FIG. 1.

FIG. 20 is a cross-sectional view schematically illustrating the base unit 100, the rotating unit 300, and a restoring unit of the string winding and unwinding apparatus according to an embodiment of the present disclosure. As illustrated in FIG. 20, the string winding and unwinding apparatus according to the present embodiment may include an elastic member. Such an elastic member may be a restoring string (RS) including a material such as resin, plastic, and/or a metal and having elasticity including rubber and/or a spring. In addition to the restoring string RS, any object may also be used as the elastic member as long as the object has elasticity. For example, a spring such as a tension spring may also be used as the restoring string. Hereinafter, for the purposes of description, a case in which the restoring unit has the restoring string RS will be described. The restoring string RS may sequentially pass through one of the first lateral apertures 121, the first aperture 331, and the other of the first lateral apertures 121. That is, the restoring string RS may pass through the first aperture 331 of the rotating unit 300, and in addition, both ends of the restoring string RS may pass through the first lateral apertures 121 so as to be fixed to the base unit 100. For example, one end of the restoring string RS may pass through the first lateral aperture 121 and may subsequently be knotted on the outer side of the lower housing 120, and the other end thereof may also pass through the first lateral aperture 121 and may subsequently be knotted on the outer side of the lower housing 120. Alternatively, both ends of the restoring string RS may meet on an outer side of the base unit 100 so as to be knotted. One end and the other end of the restoring string RS may be fixed to the base unit 100, or one end thereof may be fixed to the base unit 100 and the other end thereof may be fixed to the rotating unit 300.

In this manner, the restoring string RS may pass through the first aperture 331 of the rotating unit 300 and may be fixed to the base unit 100 through various methods. Accordingly, when the rotating unit 300 is engaged with the cover unit 400 and rotated in one direction so the string of footwear, or the like, is wound around the outer circumferential surface of the rotating unit 300, the restoring string RS having elasticity may also extend in length and may be wound around the rotating unit 300. In this state, when the rotating unit 300 is separated from the cover unit 400, the rotating unit 300 is automatically rotated in the unwinding direction by the elasticity of the restoring string RS. The restoring string RS provides a restoring force which serves to help unwind the strings (e.g. shoelaces). Thus, the user may not need to directly turn the rotating unit 300 in the other direction in order to loosen the string of the footwear, or the like, and thus, user convenience may remarkably be enhanced.

For reference, FIGS. 1 through 3 illustrate that the base unit 100 has the first lateral apertures 121, but the present disclosure is not limited thereto. For example, the base unit 100 may have a recess or a protrusion portion at an inner side thereof, without the first lateral apertures 121, and both ends of the restoring string RS may be fixed to the recess or the protrusion portion within the base unit 100. At least one end of the restoring string RS may be fixed to the base unit 100 and the other end thereof may be fixed to the rotating unit 300 or may be fixed to the opposite side of the base unit 100 across the rotating unit 300.

As illustrated in FIG. 6, the rotating unit 300 may have the second aperture 332 penetrating through the rotating unit 300 in a space between the first wing part 321 and the second wing part 322. As illustrated in FIG. 6, the second aperture 332 may be positioned to be farther from the base plate 110 than the first aperture 331 in the z+ direction. The second aperture 332 may correspond to the second lateral apertures 122 of the base unit 100. Here, when the second aperture 332 corresponds to the second lateral apertures 122, it means that a height of the second aperture 332 from the base plate 110 and a height of the second lateral apertures 122 from the base plate 110 are substantially equal.

A string (not shown) of footwear, or the like, may pass through any one of the second lateral apertures 122 of the base unit 100, penetrate through the second aperture 332 of the rotating unit 300, and subsequently pass through the other of the second lateral apertures 122. Accordingly, when the rotating unit 300 in a state of being engaged with the cover unit 400 rotates in one direction, the string may be wound around the rotating unit 300. In detail, the string is wound in the space between the first wing part 321 and the second wing part 322. In this manner, the string may be wound in the footwear, or the like. Here, although a ratchet protrusion 460 and the responsive protrusion 250 meet each other, wedge shapes of the ratchet protrusion 460 and the responsive protrusion 250 allow the cover unit 400 to rotate in one direction, and when the rotation of the cover unit 400 in one direction is stopped, the wedge shapes of the ratchet protrusion 460 and the responsive protrusion 250 limit rotations of the cover unit 400 and the rotating unit 300 in the other direction, i.e., the opposite direction, in the stopped position. In this state, when the rotating unit 300 is separated from the cover unit 400, the ratchet protrusion 460 and the responsive protrusion 250 are also separated, releasing the wound state, and thus, the rotating unit 300 may rotate in the other direction (the loosening/unwinding direction) by virtue of restoring force of the restoring string RS, and accordingly, the string, which has been wound around the rotating unit 300, may be unwound from an outer circumferential surface of the rotating unit 300.

However, the present disclosure is not limited thereto and the rotating unit 300 may not have the second aperture 332. In this case, one end of the string of the footwear, or the like, may pass through any one of the second lateral apertures 122 of the base unit 100 so as to be fixed to the rotating unit 300 and the other end of the string of the footwear, or the like, may pass through the other of the second lateral aperture 122 of the base unit 100 so as to be fixed to the rotating unit 300. In this case, in order to fix the one end and the other end of the string, the rotating unit 300 may have at least one fixing protrusion portion (not shown) or a fixing recess portion (not shown) configured for string fixing.

When rotating, the rotating unit 300 rotates relatively with respect to the base unit 100, and thus, it is preferred to increase rotation stability of the rotating unit 300. To this end, the rotation support portion 130 and the rotation support protrusion portion 132 of the base unit 100 may interact with the second wing part 322 of the rotating unit 300. For example, the rotating unit 300 may have a rotation protrusion portion 322*a* protruding downwardly (−z direction) from an end of the second wing part 322 in the radial direction, and a portion of a lower surface (−z direction) of the second wing part 322 adjacent to the rotation protrusion portion 322*a* may be configured to be in close proximity to or may be in contact with the rotation support protrusion portion 132 of the base unit 100, whereby when the rotating unit 300 rotates, a position of a rotational central axis of the rotating unit 300 may be uniform, rather than being moved relatively with respect to the base unit 100.

The rotating unit 300 may be formed of a resin, plastic, and/or a metal.

Figure 21:
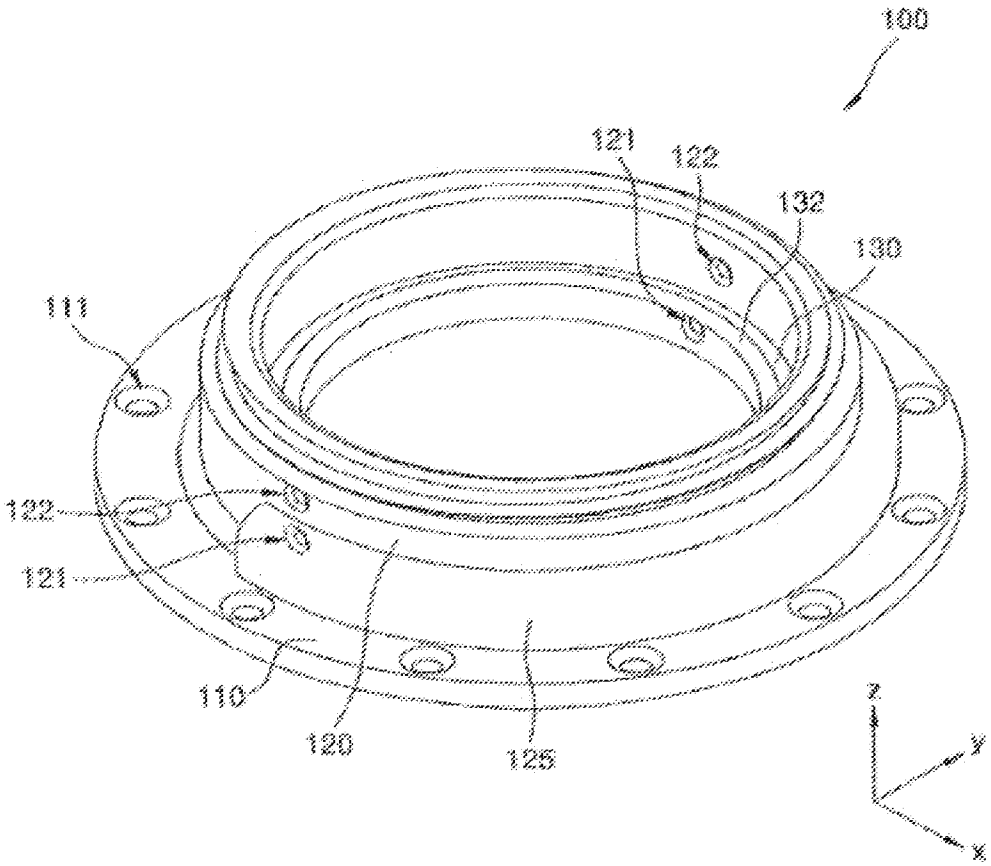
FIG. 21 is a perspective view schematically illustrating a base unit of a string winding and unwinding apparatus according to another embodiment of the present disclosure.

FIG. 21 is a cross-sectional view schematically illustrating the base unit 100 of a string winding and unwinding apparatus according to another embodiment of the present disclosure. As described above, the restoring string RS may sequentially pass through one of the first lateral apertures 121 of the base unit 100, the first aperture 331 of the rotating unit 300, and the other of the first lateral apertures 121. Here, the restoring string RS may have a closed loop shape in which opposing ends are tied or engaged. In this case, residual portions of the restoring string RS (the portions outside of the base unit), excluding the portion thereof sequentially passing through any one of the first lateral apertures 121, the first aperture 331, and the other of the first lateral apertures 121, may be exposed to the outside of the base unit 100. In this case, the restoring string RS may be damaged by an external impact, which, thus, may need to be protected.

To avoid the damage, in the string winding and unwinding apparatus according to the present embodiment, the base unit 100 has a shielding unit 125. Thus, a tunnel formed within the shielding unit 125 shields at least a portion of the residual portions of the restoring string RS, serving to prevent damage to the restoring string RS.

In FIG. 21, it is illustrated that the shielding unit 125 is positioned in a portion in which the base plate 110 of the base unit 100 and the lower housing 120 meet and a space defined by an inner surface of the shielding unit 125, an outer surface of the lower housing 120, and an outer surface of the base plate 110 is a tunnel. However, the present disclosure is not limited thereto and the tunnel may be defined by the inner surface of the shielding unit 125 in contact with at least any one of the outer surface of the lower housing 120 and the outer surface of the base plate 110. Alternatively, the tunnel may be formed within the lower housing 120 or within the base plate 110. Also, if necessary, the tunnel may be formed as an open trench with an open upper portion.

Figure 22:
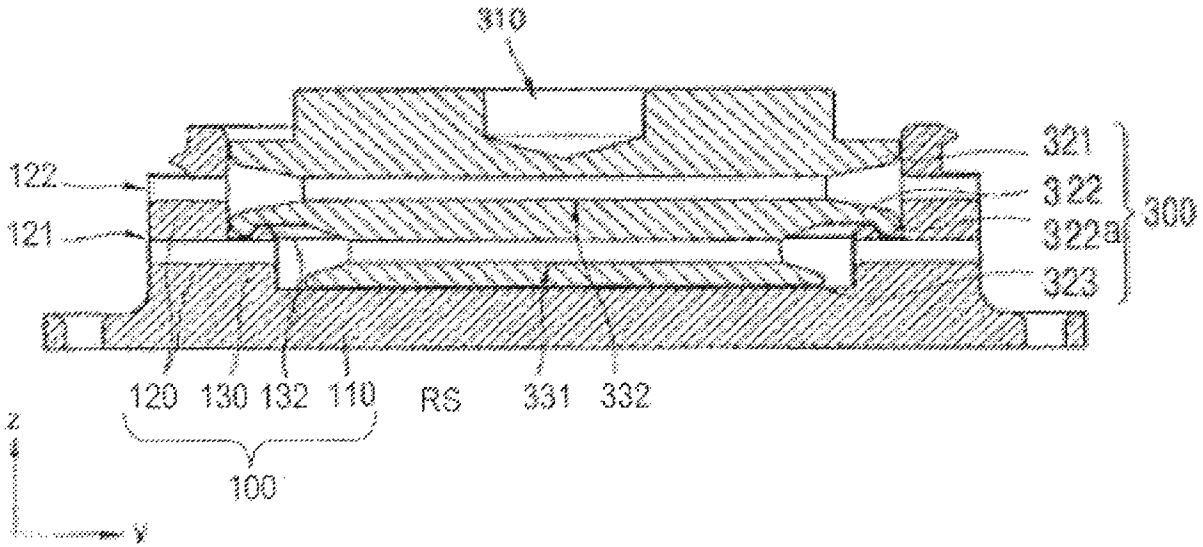
FIG. 22 is a cross-sectional view schematically illustrating a base unit and a rotating unit of a string winding and unwinding apparatus according to another embodiment of the present disclosure.

FIG. 22 is a cross-sectional view schematically illustrating the base unit 100 and the rotating unit 300 of a string winding and unwinding apparatus according to another embodiment of the present disclosure. The string winding and unwinding apparatus according to the present embodiment is different from the string winding and unwinding apparatus according to the previous embodiment described above with reference to FIG. 2, in that the second lateral apertures 122 are positioned to be closer to the base plate 110 than the first lateral apertures 121 in the base unit 100 and that the second aperture 332 is positioned to be closer to the base plate 110 than the first aperture 331 in the rotating unit 300. In this case, a string of footwear, or the like, may sequentially pass through any one of the second lateral apertures 122 positioned in the lower portion, the second aperture 332, and the other of the second lateral apertures 122 positioned in the lower portion, so as to be wound around an outer circumferential surface of the rotating unit 300 in the space between the second wing part 322 and the third wing part 323, or may be unwound therefrom. The restoring string RS of the restoring unit may sequentially pass through any one of the first lateral apertures 121 positioned in the upper portion, the first aperture 331, and the other of the first lateral apertures 121 positioned in the upper portion.

In the string winding and unwinding apparatus according to the present embodiment, the string of footwear, or the like, passes through the lowermost end portion of the string winding and unwinding apparatus. Thus, the string of footwear, or the like, is effectively prevented from being separated in a direction away from the surface of footwear, or the like, or a degree to which the string is separated from the surface of footwear, or the like, may be minimized. If the string of footwear, or the like, is separated significantly from the surface of footwear, or the like, the string of footwear, or the like, may be caught by an external object or damaged when used. However, the string winding and unwinding apparatus according to the present embodiment may prevent or minimize generation of such a problem.

That is, according to the technical concept of the present invention, as in the embodiment described above with reference to FIG. 2, the string may be wound around in the space between the first wing part 321 and the second wing part 322 and the restoring string may be wound in the space between the second wing part 322 and the third wing part 323, and also, as in the embodiment described above with reference to FIG. 22, the restoring string may be wound in the space between the first wing part 321 and the second wing part 322 and the string to be wound may be wound around in the space between the second wing part 322 and the third wing part 323.

Figure 23:
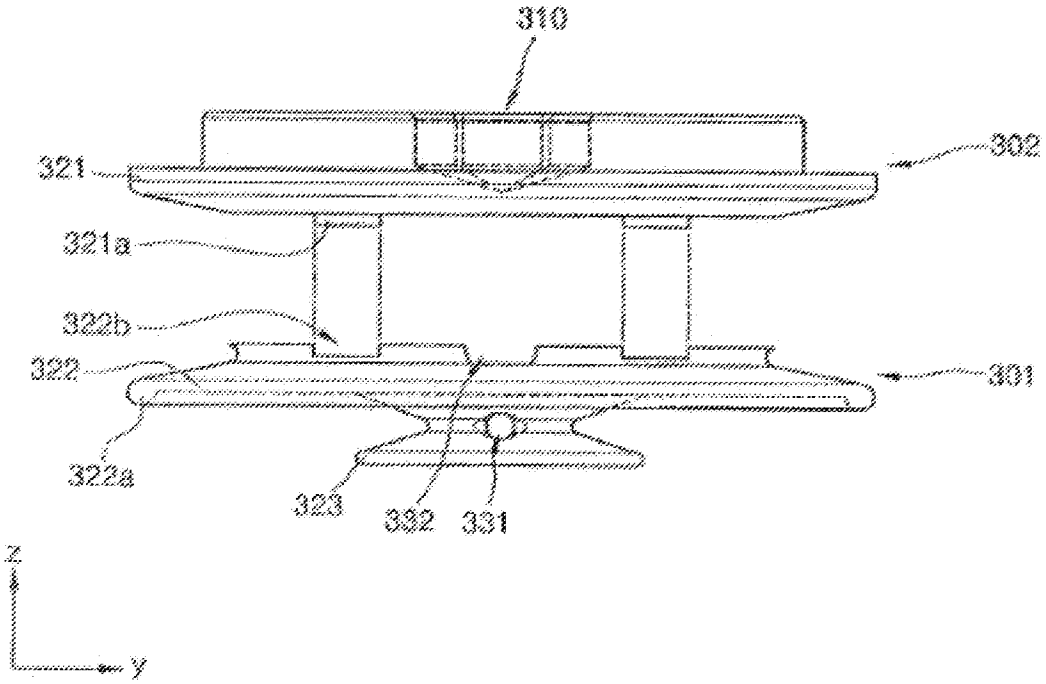
FIG. 23 is an exploded side view schematically illustrating a rotating unit of a string winding and unwinding apparatus according to another embodiment of the present disclosure.

FIG. 23 is an exploded side view schematically illustrating the rotating unit 300 of a string winding and unwinding apparatus according to another embodiment of the present disclosure. The rotating unit 300 of the string winding and unwinding apparatus according to the present embodiment has a first rotating portion 301 and a second rotating portion 302 that may be detachably coupled. The first rotating part 301 may have a second wing part 322 and a third wing part 323, and the second rotating part 302 may have a first wing part 321. The first rotating part 301 and the second rotating part 302 may be fastened to each other as a coupling concave portion **322*b* of an upper surface of the second wing part 322 of the first rotating part 301 and a coupling protrusion portion 321*a* of a lower surface of the first wing part 321 of the second rotating part 302** are engaged with each other.

The first rotating part 301 has a first aperture 331 allowing the restoring string RS to pass therethrough. When the first rotating part 301 and the second rotating part 302 are coupled, a second aperture 332 is formed therebetween. The second aperture 332 formed thusly corresponds to the second lateral apertures 122 of the lower housing 120 of the base unit 100. A string of footwear, or the like, may sequentially pass through one of the second lateral apertures 122, the second aperture 332 formed as the first rotating part 301 and the second rotating part 302 are coupled, and the other of the second lateral apertures 122. The string may be wound around an outer circumferential surface of the rotating unit 300 or unwound therefrom according to rotation of the rotating unit 300.

The string winding and unwinding apparatus according to the present embodiment may be easily connected to an external string and very easy in maintenance and repair. For example, when the string winding and unwinding apparatus according to the present embodiment is intended to be installed in footwear, or the like, the base unit 100 in which the first rotating part 301 is positioned may be installed in the footwear, or the like, an upper portion of the first rotating part 301 may be positioned to allow a string to pass therethrough, and the second rotating part 302 may subsequently be coupled to the first rotating part 301, whereby the string of the footwear, or the like, may be connected to the rotating unit 300. When the string of the footwear, or the like, is damaged while in use, so it is required to be replaced, the second rotating part 302 may be separated from the first rotating part 301, the string of the footwear, or the like, may be replaced, and the second rotating part 302 may subsequently be coupled to the first rotating part 301, and thus, maintenance and repair may also be easily performed. In addition, in the case of the string winding and unwinding apparatus according to the present embodiment, a specialized skill or a specific tool is not required for maintenance and repair. That is, a component installed between the middle unit 200 and the base unit 100 may be easily disassembled and replaced through simple screw fitting, bolt-nut coupling, or clip coupling. Also, for example, since maintenance and repair is performed by simply inserting a replacement unit like the second rotating part 302, users may directly perform maintenance and repair easily for use.

In FIG. 23, it is illustrated that the second rotating part 302 is positioned above the first rotating part 301, but the present disclosure is not limited thereto. For example, the first rotating part 301 may have the first wing part 321 and the second wing part 322 and have the first aperture 331 formed between the first wing part 321 and the second wing part 322 and allowing the restoring string RS of the restoring unit to pass therethrough. The second rotating part 302 may be positioned below (−z direction) the first rotating part 301. In addition, when the upper first rotating part 301 and the lower second rotating part 302 are coupled to each other, the second aperture 332 may be formed therebetween. That is, in the rotating unit 300 having the configuration such as described above with reference to FIG. 10, a portion including the third wing part 323 may be detachably coupled to the portion including the first wing part 321 and the second wing part 322.

Figure 24:
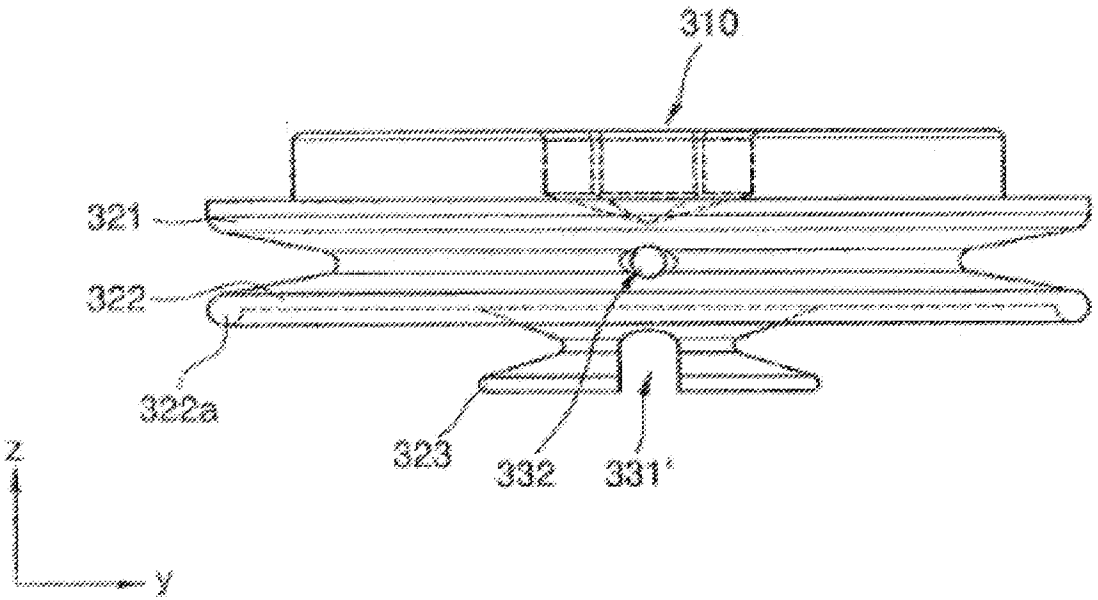
FIG. 24 is a side view schematically illustrating a rotating unit of a string winding and unwinding apparatus according to another embodiment of the present disclosure.

FIG. 24 is a side view schematically illustrating the rotating unit 300 of a string winding and unwinding apparatus according to another embodiment of the present disclosure. The rotating unit 300 according to the present embodiment has a trench 331' formed in a surface thereof in the direction (−z direction) toward the base plate 110. The restoring string RS included in the restoring unit may pass through the trench 331' so as to be fixed to the base unit 100 in both ends thereof. Also, in this case, the lower housing 120 may have the first lateral apertures 121, and the restoring string RS of the restoring unit may sequentially pass through one of the first lateral apertures 121, the trench 331', and the other of the first lateral apertures 121.

In the case of the string winding and unwinding apparatus according to the present embodiment, in order to couple the restoring string RS included in the restoring unit and the rotating unit 300, the restoring string RS may be fixed to the base unit 100 and, in this state, the rotating unit 300 may be simply moved in a direction toward the base plate 110, and thus, ease of manufacturing or maintenance and repair of the string winding and unwinding apparatus may be significantly enhanced.

Even when the rotating unit 300 has the trench 331' as in the present embodiment, a tunnel may protect the restoring string RS as in the embodiments and the modified examples thereof described above with reference to FIG. 21. The rotating unit 300 may have a second aperture 332 extending in a direction intersecting a rotation axis (z axis) of the rotating unit 300, so the string that sequentially passes through any one of the second lateral apertures 122 of the lower housing 120, the second aperture 332, and the other of the second lateral apertures 122 may be wound around the outer circumferential surface of the rotating unit 300 or may be unwound therefrom.

The string winding and unwinding apparatus according to the present embodiment may also have the configuration in which the rotating unit 300 is divided into the first rotating part and the second rotating part as illustrated in FIG. 23. That is, in the rotating unit 300 having the configuration such as described above with reference to FIG. 23, the first rotating part 301 positioned in the lower portion may have the trench 331' such as illustrated in FIG. 24, instead of the first aperture 331. In this case, the rotating unit 330 may have the first rotating part 301 having the trench 331' and the second rotating part 302 positioned above the first rotating part 301, detachably coupled to the first rotating part 301, and forming the second aperture 332 with the first rotating part 301 when coupled to the first rotating part 301.

Figure 25:
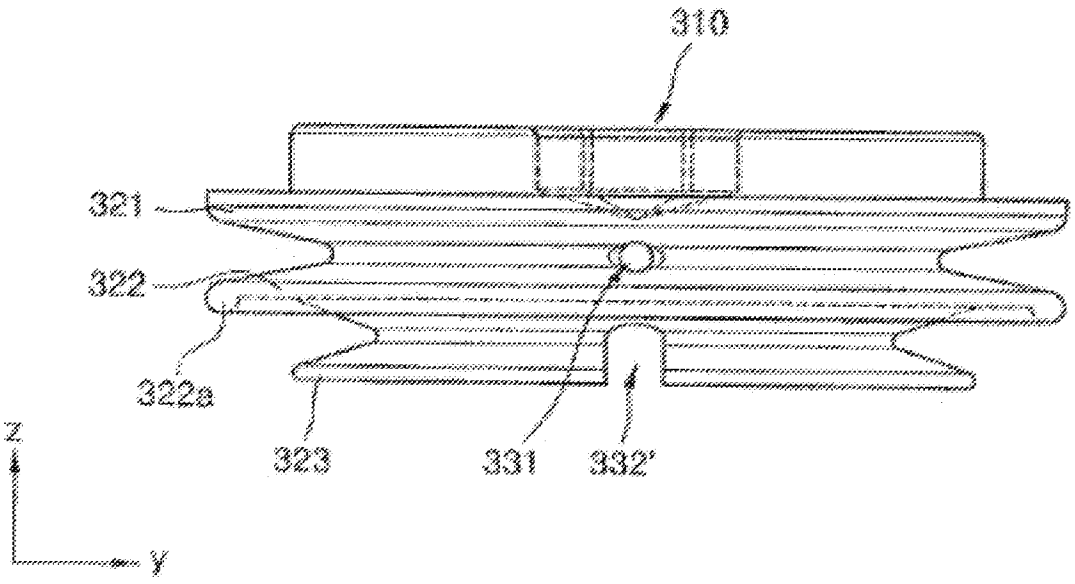
FIG. 25 is a side view schematically illustrating a rotating unit of a string winding and unwinding apparatus according to another embodiment of the present disclosure.

FIG. 25 is a side view schematically illustrating the rotating unit 300 of a string winding and unwinding apparatus according to another embodiment of the present disclosure. The string winding and unwinding apparatus according to the present embodiment is different from the string winding and unwinding apparatus according to the previous embodiment described above with reference to FIG. 24, in that the aperture formed between the first wing part 321 and the second wing part 322 is the first aperture through which the restoring string RS passes and the trench 332' formed on the surface of the rotating unit 300 in the direction (−z direction) toward the base plate 110 is used for the purpose of allowing the string of footwear, or the like, passing through the second lateral apertures 122 to pass therethrough. Here, the restoring string RS may be fixed to the base unit 100 in both ends thereof, while passing through the first aperture 331, or may pass through the first lateral apertures 121 of the base unit 100.

The string winding and unwinding apparatus according to the present embodiment may have such a configuration in which the rotating unit 300 is modified to include the first rotating part 301 and the second rotating part 302 as that of the string winding and unwinding apparatus according to the previous embodiment described above with reference to FIG. 23. That is, the rotating unit 300 may have the first rotating part having the trench 332' and the second rotating part positioned above (+z direction) of the first rotating part, detachably coupled to the first rotating part, and forming the first aperture 331 with the first rotating part when coupled to the first rotating part.

Figure 26:
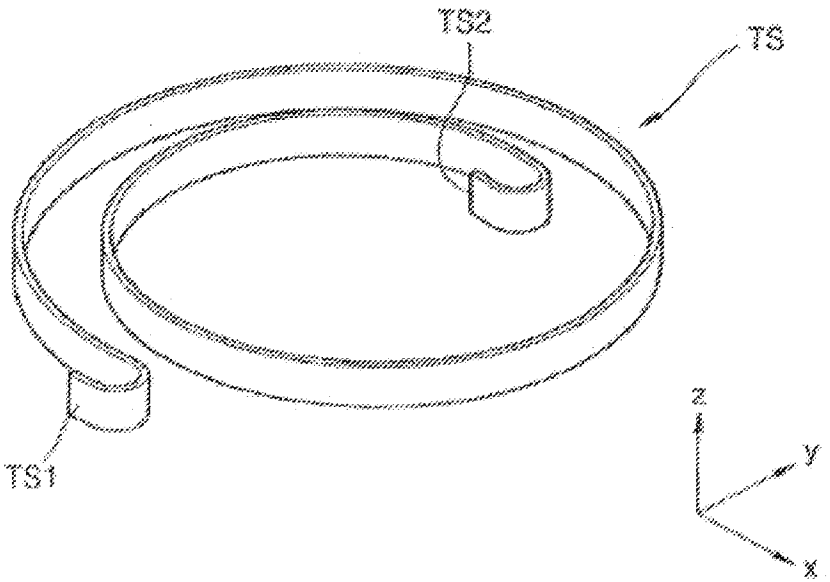
FIG. 26 is a perspective view schematically illustrating a restoring unit of a string winding and unwinding apparatus according to another embodiment of the present disclosure.

FIG. 26 is a perspective view schematically illustrating a restoring unit of a string winding and unwinding apparatus according to another embodiment of the present disclosure. So far, the case in which the restoring unit is the restoring string RS having elasticity has been described, but the present disclosure is not limited thereto and any unit may be used as the restoring unit as long as it includes an elastic member. Such an elastic member may include a spiral spring TS, a tension spring, or a rubber band. For example, as illustrated in FIG. 26, the restoring unit may have a spiral spring TS. The spiral spring TS may be fixed to a first fixing portion such as a recess or a protrusion portion of the base unit 100 in one end TS1 thereof and fixed to a second fixing portion such as a recess or a protrusion portion of the rotating unit 300 in the other end TS2 thereof. Thus, in a state in which the rotating unit 300 is engaged with the cover unit 400 and rotated in one direction (for example, clockwise direction centered on the −z direction) so the string is wound around the outer circumferential surface of the rotating unit 300, when the cover unit 400 is separated from the rotating unit 300, the spiral spring TS may restore the rotating unit 300 to be rotated in the other direction (counterclockwise direction centered on −z direction), the opposite direction of the one direction).

In the embodiments illustrated in FIGS. 1 through 13, the user presses the cover unit 400 (−z direction) in order to wind a string. Here, the stoppage portion elements 410, 221, and 222 and the reverse rotation preventing portion elements 460 and 250 between the cover unit 400 and the middle unit 200, the engaging portion elements 450 and 310 between the cover unit 400 and the rotating unit 300, and the string winding portion elements 321 and 322 of the rotating unit 300 operate together to allow the string to be wound or unwound. Various embodiments may be implemented depending on how these four components are disposed. Here, in particular, an embodiment for lowering an overall height of the apparatus will be mainly described. An overall height of an apparatus is a very critical factor in increasing utilization of products. For example, when the product is installed in bags or backpacks, a height of the product may not be significant, but in order to be installed in footwear, girdles, or other garments, or the like, it is preferred for the product to be produced with a height as low as possible.

Figure 27:
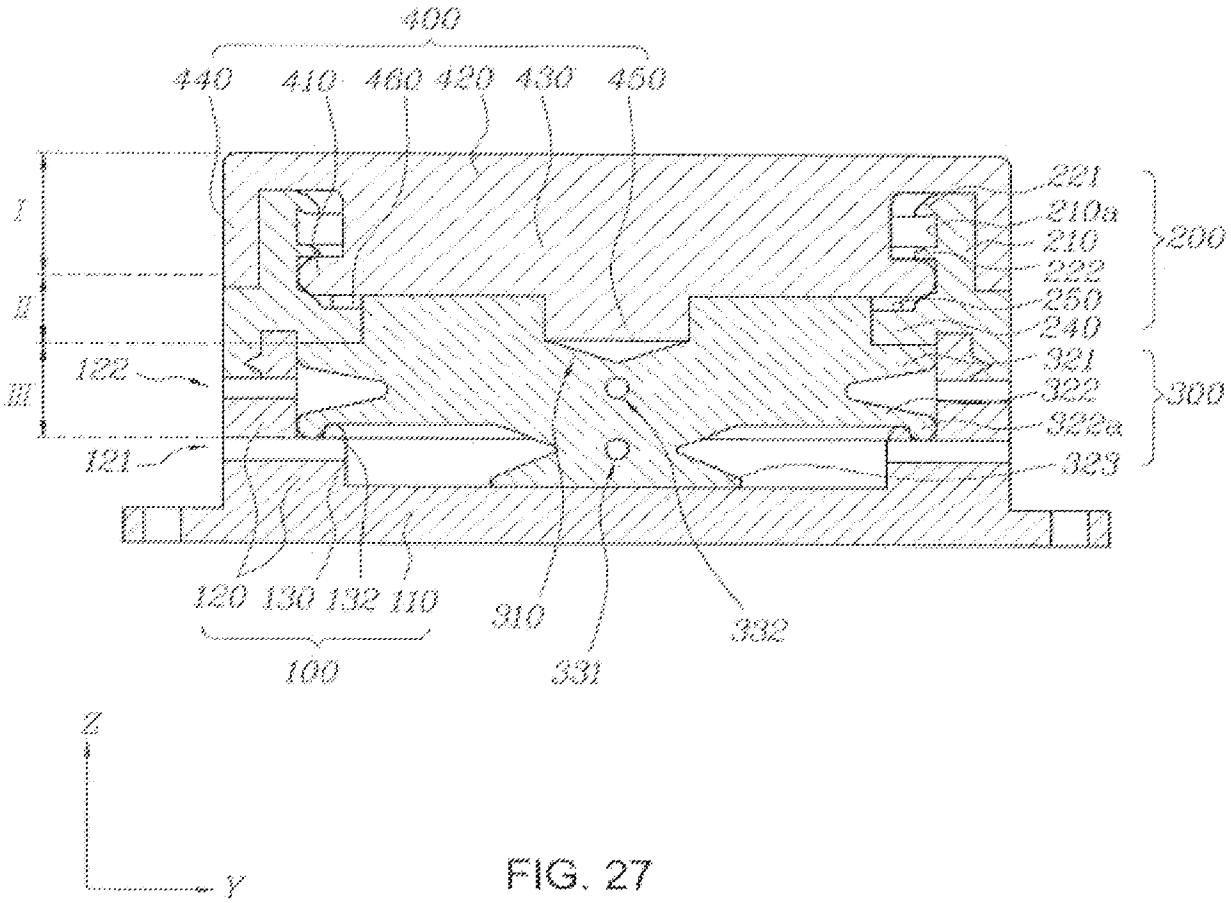
FIG. 27 is a cross-sectional view illustrating that the embodiment of FIG. 2 has a 3-stage configuration.

FIG. 27 is a cross-sectional view illustrating that the embodiment of FIG. 2 has a 3-stage configuration, which corresponds to a case in which the apparatus is the tallest. In detail, the engaging portion elements 410, 221, and 222 between the cover unit 400 and the middle unit 200 are included in a first stage (I), the reverse rotation preventing portion elements 460 and 250 between the cover unit 400 and the middle unit 200 and the engaging portion elements 450 and 310 between the cover unit 400 and the rotating unit 300 are included in a second stage (II), and the string winding portion elements 321 and 322 of the rotating unit 300 are included in a third stage (III). That is, since four components form the configuration of 3 stages present in different areas with respect to the z-axis direction, the overall height of the apparatus increases.

Figure 28:
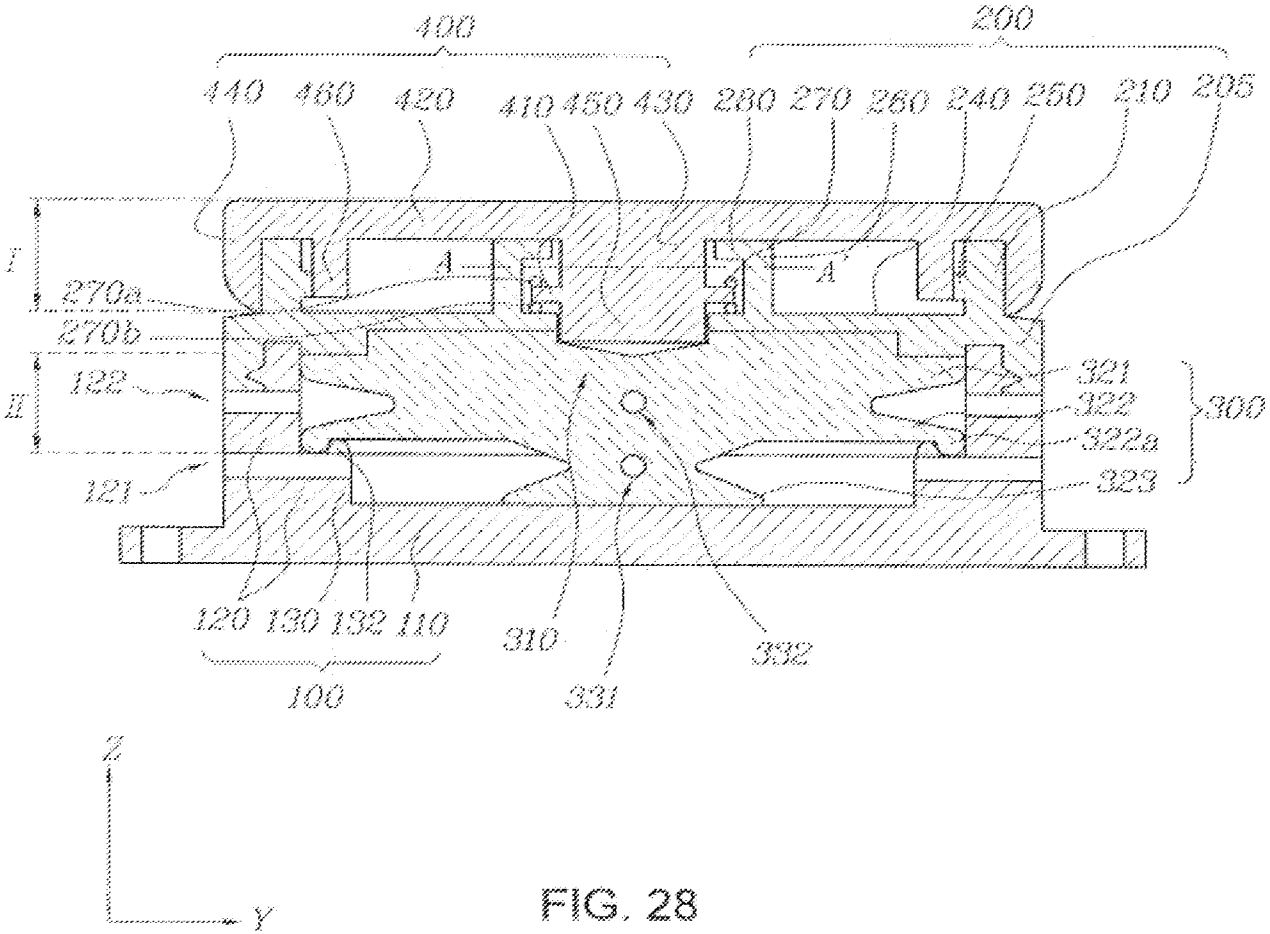
FIG. 28 is a cross-sectional view illustrating a wound state of a first embodiment having a 2-stage configuration to reduce an overall height of the apparatus according to the present disclosure.
Figure 29B:
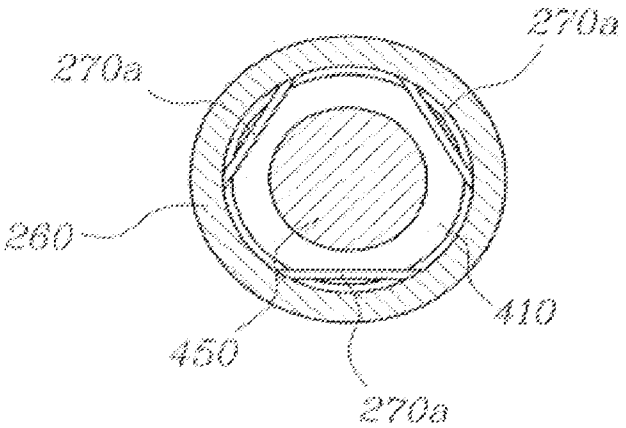
FIG. 29B is an alternative embodiment of the portion shown in FIG. 29A.
Figure 29A:
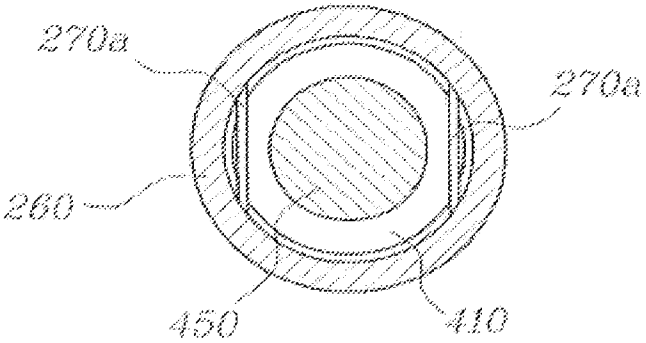
FIG. 29A is a cross-sectional view taken along line A-A' of FIG. 28.
Figure 30:
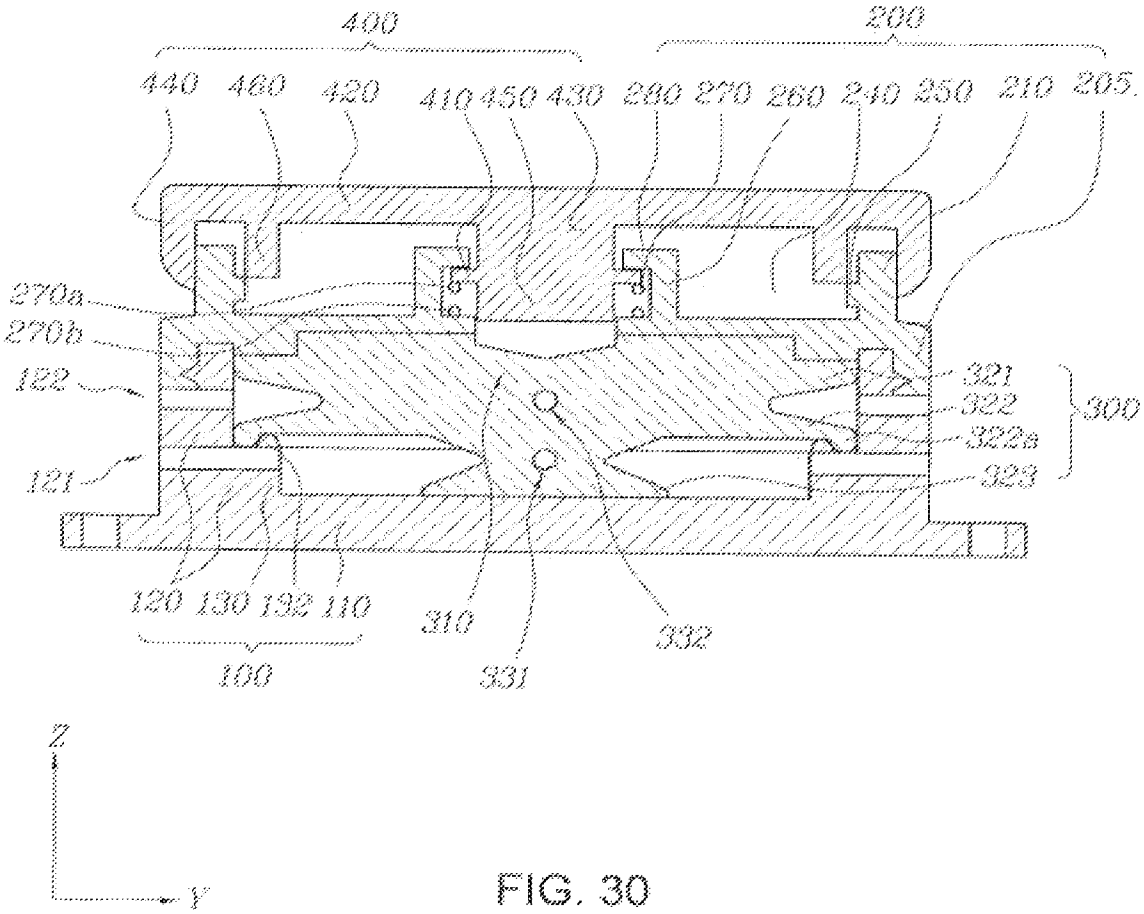
FIG. 30 is a cross-sectional view illustrating a winding-released state of the first embodiment having the 2-stage configuration illustrated in FIG. 28.

In another embodiment of the present disclosure illustrated in FIGS. 28 through 30, the overall apparatus has a 2-stage configuration, and thus, a height thereof may be lowered. In detail, the stoppage portion elements 410 and 270 and the reverse rotation preventing portion elements 460 and 250 between the cover unit 400 and the middle unit 200, and the engaging portion elements 450 and 310 between the cover unit 400 and the rotating unit 300 are all included in a first stage (I), and the string winding portion elements 321 and 322 of the rotating unit 300 are included in a second stage (II). As a result, the height of the apparatus may be lowered, relative to the 3-stage configuration of FIG. 27.

Hereinafter, the elements will be described in even further detail. First, in the reverse rotation preventing portion elements 460 and 250, the responsive protrusion 250 of the middle unit 200 is formed on the upper housing 210 extending upwardly from the partition 240. This is differentiated from the configuration in which the responsive protrusion 250 is formed on the lower partition 240 (+z direction) of the middle unit 200 in FIG. 2. In this manner, in the present embodiment, since the responsive protrusion 250 is positioned on the upper housing 210, the response protrusion 250 is present in the first stage (I), the same area in which the engaging portion elements 410 and 270 are included.

As for the engaging portion elements 410 and 270, the cover unit 400 has the central shaft 430, and the responsive stoppage portion 410 has a disk shape extending from the central shaft 430 in a radial direction. As the responsive stoppage portion 410 and the elastic stoppage portion 270 of the middle unit 200 mutually perform a grasping operation, the cover unit 400 may be rotatably coupled to the middle unit 200. The elastic stoppage portion 270 of the middle unit 200 is configured as a wire-formed line spring (or spring clip) or an elastic flexure. The wire-formed line spring or the elastic flexure may be used to form the upper stoppage portion and the lower stoppage portion included in all of the embodiments described above.

FIG. 29A is a cross-sectional view taken along line A-A' of FIG. 28, in which embodiments of the elastic stoppage portion 270 are illustrated. As illustrated in FIGS. 29A and the alternative embodiment of 29B, elastic stoppage portions 270*a* may be fixedly installed to be spaced apart by a predetermined interval in two rows when viewed from the x-y plane in an installation protrusion 260 formed separately within the middle unit 200 (FIG. 29A), or may be fixedly installed in a triangular shape (FIG. 29B). In another embodiment of the present invention, the elastic stoppage portion 270 may be installed only at one side in FIG. 29A, and may be fixedly installed to have various other shapes such as a polygonal shape or a curved or bent line shape, as well as the triangular shape in the alternative embodiment shown in FIG. 29B. In this manner, the use of the elastic stoppage portion 270 formed of a line spring or an elastic flexure allows the stopping and releasing operation to be performed more smoothly and enhances durability.

Also, in this embodiment, the stoppage portion elements 410, 221, and 222 having various shapes described above with reference to FIGS. 8 through 13 may be employed.

Also, an upper elastic stoppage portion 270*a* and a lower elastic stoppage portion 270*b* of the elastic stoppage portion 270 are disposed to be spaced apart from one another in the z direction. According to relative positions of the responsive stoppage portion 410 with respect to the upper elastic stoppage portion 270*a* and the lower elastic stoppage portion 270*b*, a distance of the cover unit 400 to the base unit 100 may be varied such that the cover unit 400 is engaged with the rotating unit 300 or engagement of the cover unit 400 with the rotating unit 300 is released.

That is, as illustrated in FIG. 28, when the responsive stoppage portion 410 is positioned between the upper elastic stoppage portion 270*a* and the lower elastic stoppage portion 270*b*, the engaging portions 450 and 310 are engaged with each other and the reverse rotation preventing portions 460 and 250 are also coupled to each other. As a result, when the user rotates the cover unit 400, the rotating unit 300 engaged with the cover unit 400 is rotated to wind the string. Here, the cover unit 400 is prevented from being rotated reversely by the reverse rotation preventing portions 460 and 250, whereby the string wound by a predetermined length may not be unwound.

As illustrated in FIG. 30, when the cover unit 400 is pulled upwardly so the responsive stoppage portion 410 is positioned above the upper elastic stoppage portion 270*a*, the engaging portions 450 and 310 are disengaged from each other and coupling of the reverse rotation preventing portions 460 and 250 is also released. Here, in order to prevent the responsive stoppage portion 410 from being completely separated, a step 280 is formed in an upper end of the installation protrusion 260. In this manner, when the coupling of the cover unit 400 and the rotating unit 300 is released, the string wound around the rotating unit 300 is naturally unwound by virtue of restoring force of the string.

Figure 31:
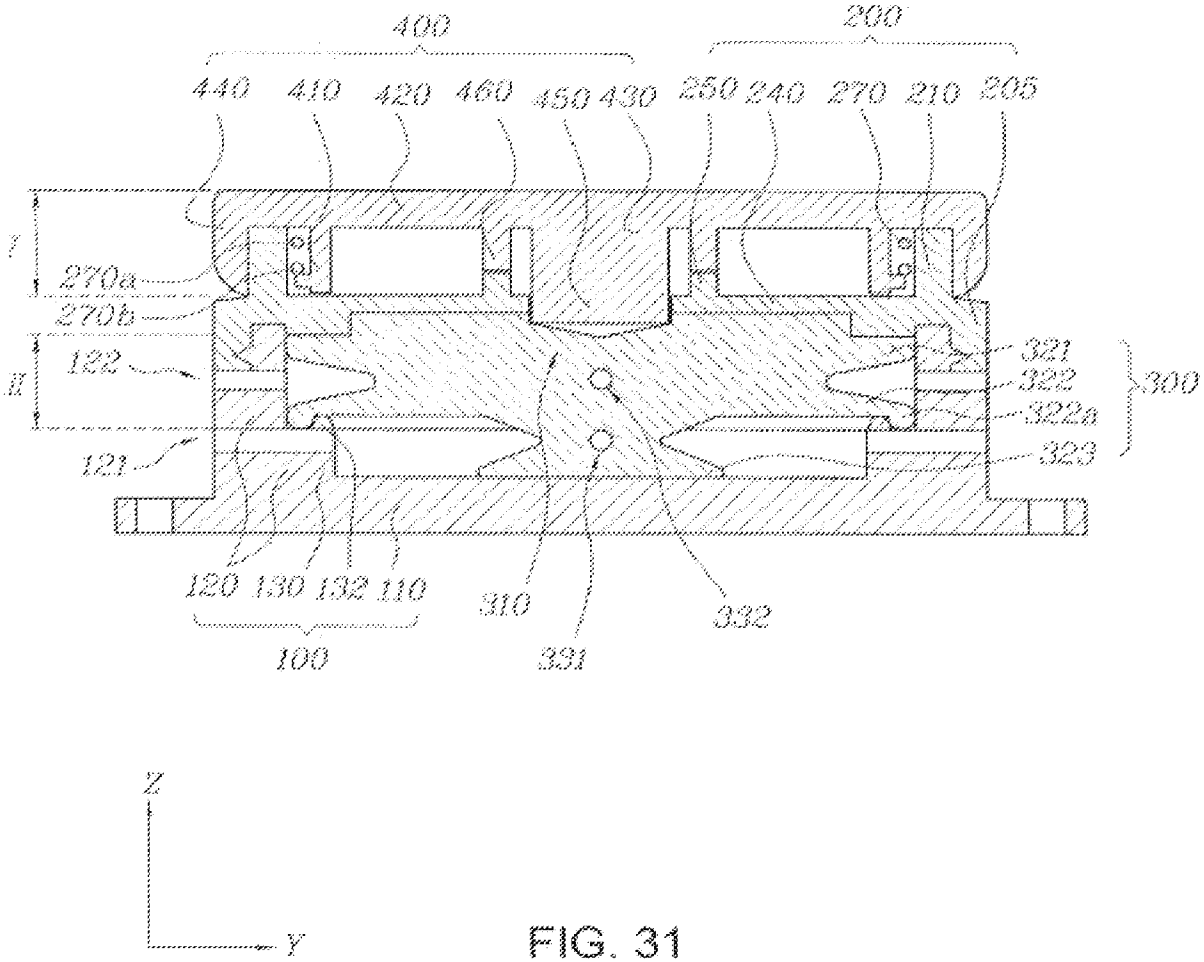
FIG. 31 is a cross-sectional view illustrating a wound state of a second embodiment having a 2-stage configuration to reduce an overall height of the apparatus according to the present disclosure.
Figure 32:
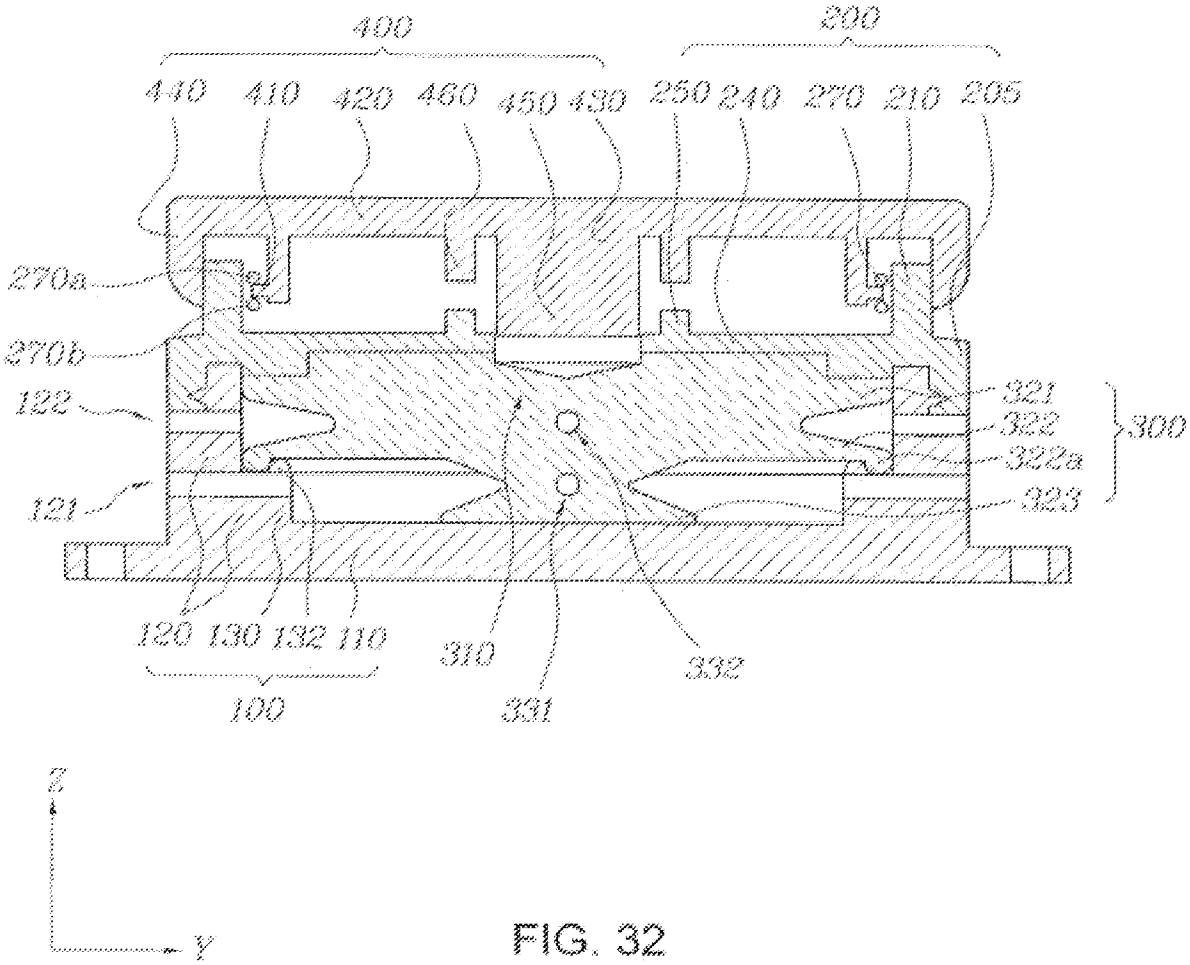
FIG. 32 is a cross-sectional view illustrating a winding-released state of the second embodiment having the 2-stage configuration illustrated in FIG. 31.

According to another embodiment (second embodiment having a 2-stage configuration) of the present disclosure illustrated in FIGS. 31 and 32, like the embodiment of FIGS. 28 through 30, the stoppage portion elements 410 and 270 and the reverse rotation preventing portion elements 460 and 250 between the cover unit 400 and the middle unit 200, and the engaging portion elements 450 and 310 between the cover unit 400 and the rotating unit 300 are all included in a first stage (I), and the string winding portion elements 321 and 322 of the rotating unit 300 are included in a second stage (II). As a result, the height of the apparatus may be lowered, relative to the 3-stage configuration of FIG. 27.

Hereinafter, the elements will be described in even further detail. First, in the reverse rotation preventing portion elements 460 and 250, the responsive protrusion 250 of the middle unit 200 is formed on the partition 240 (in the +z direction). Here, compared with the partition 240 of the middle unit 200 formed relatively at a lower side in FIG. 2, the partition 240 of the present embodiment is formed at an upper side. As a result, the responsive protrusion 250 formed on the partition 240 is present within the first stage (I), the same area in which the stoppage portions elements 410 and 270 are included.

The stoppage portion elements 410 and 270 are differentiated in that the responsive stoppage portion 410 of the cover unit 400 is formed on a side surface of a separate protrusion protruding from the cover unit 400 toward the base unit 100, rather than being formed on the central shaft 430. The responsive stoppage portion 410 performs a mutual grasping operation with the elastic stoppage portion 270 formed on the upper housing 210 of the middle unit 200, whereby the cover unit 400 may be rotatably coupled to the middle unit 200. The elastic stoppage portion 270 of the middle unit 200 is formed as a wire-formed line spring or an elastic flexure and fixedly installed in two rows or in a triangular shape when viewed from the x-y plane as mentioned above with reference to FIG. 29A.

Also, in the present embodiment, the stoppage portion elements 410, 221, and 222 having various shapes described above with reference to FIGS. 8 through 13 may be employed.

Also, an upper elastic stoppage portion 270*a* and a lower elastic stoppage portion 270*b* of the elastic stoppage portion 270 are disposed to be spaced apart from one another in the z direction, and here, according to relative positions of the responsive stoppage portion 410 with respect to the upper elastic stoppage portion 270*a* and the lower elastic stoppage portion 270*b*, a distance of the cover unit 400 to the base unit 100 may be varied such that the cover unit 400 is engaged with the rotating unit 300 or engagement of the cover unit 400 with the rotating unit 300 is released.

That is, as illustrated in FIG. 31, when the responsive stoppage portion 410 is positioned below the lower elastic stoppage portion 270*b*, the engaging portions 450 and 310 are engaged with each other and the reverse rotation preventing portions 460 and 250 are also coupled to each other. As a result, when the user rotates the cover unit 400, the rotating unit 300 engaged with the cover unit 400 is rotated to wind the string. Here, the cover unit 400 is prevented from being rotated reversely by the reverse rotation preventing portions 460 and 250, whereby the string wound by a predetermined length may not be unwound.

As illustrated in FIG. 32, when the cover unit 400 is pulled upwardly so the responsive stoppage portion 410 is positioned between the upper elastic stoppage portion 270*a* and the lower elastic stoppage portion 270*b*, the engaging portions 450 and 310 (see FIG. 5 and FIG. 7) are disengaged from each other and coupling of the reverse rotation preventing portions 460 and 250 is also released. In this manner, when the coupling of the cover unit 400 and the rotating unit 300 is released, the string wound around the rotating unit 300 is naturally unwound by virtue of restoring force of the string.

Figure 33:
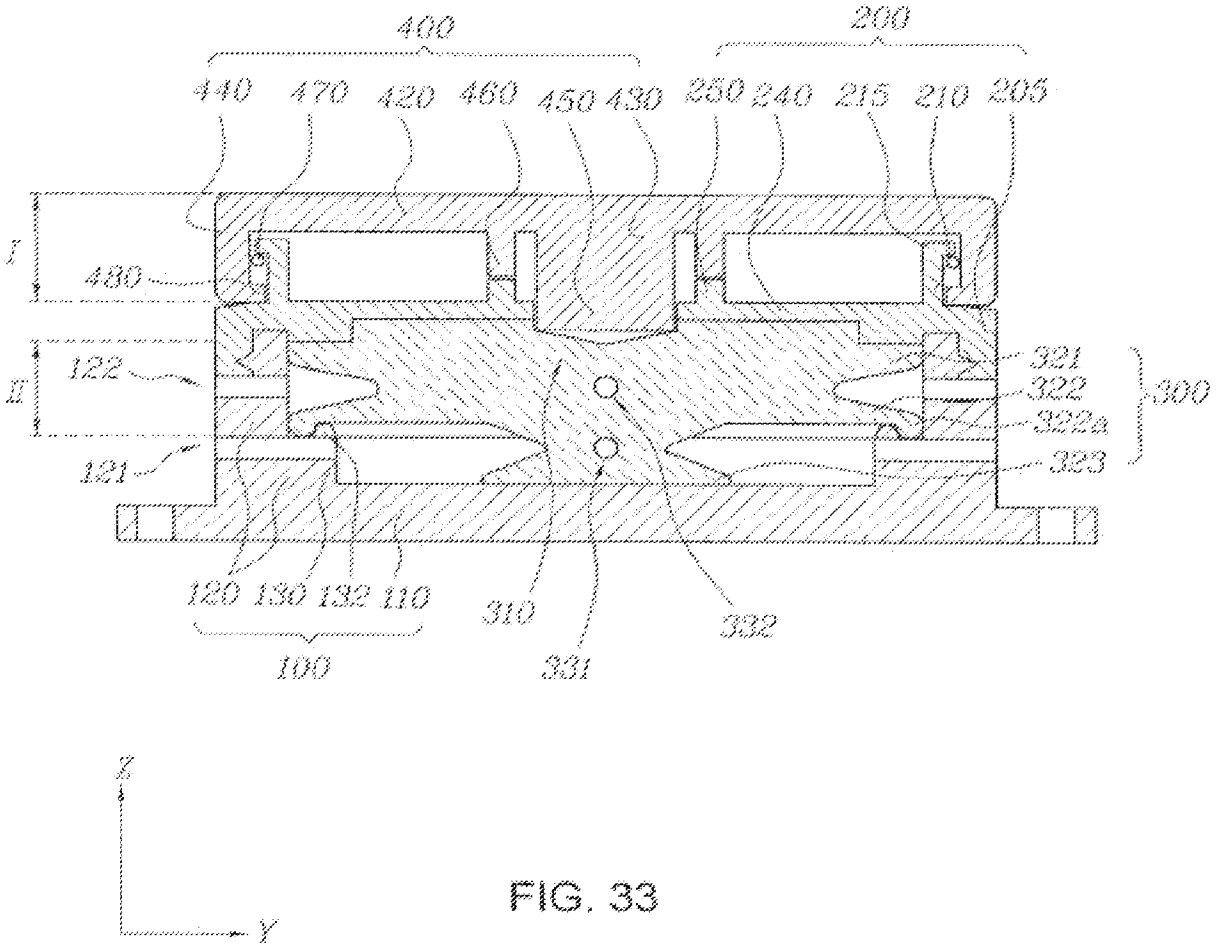
FIG. 33 is a cross-sectional view illustrating a wound state of a third embodiment having a 2-stage configuration to reduce an overall height of the apparatus according to the present disclosure.
Figure 34:
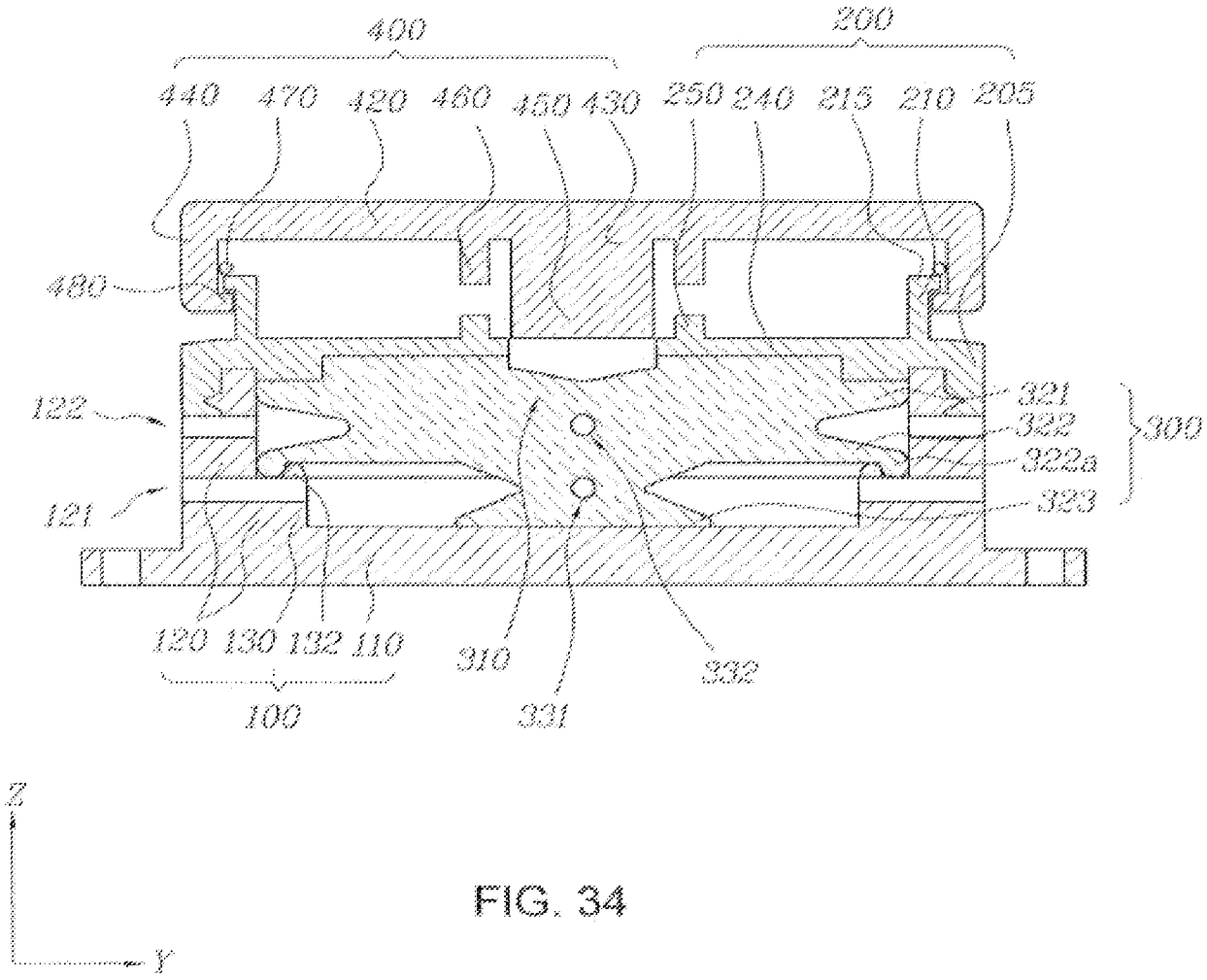
FIG. 34 is a cross-sectional view illustrating a winding-released state of the third embodiment having the 2-stage configuration illustrated in FIG. 33.

According to another embodiment (third embodiment having a 2-stage configuration) of the present disclosure illustrated in FIGS. 33 and 34, like the embodiment of FIGS. 28 through 30, the stoppage portion elements 410 and 270 and the reverse rotation preventing portion elements 460 and 250 between the cover unit 400 and the middle unit 200, and the engaging portion elements 450 and 310 between the cover unit 400 and the rotating unit 300 are all included in a first stage (I), and the string winding portion elements 321 and 322 of the rotating unit 300 are included in a second stage (II). As a result, the height of the apparatus may be lowered, relative to the 3-stage configuration of FIG. 27.

Compared with the embodiments described above, the present embodiment has the following differences. First, among the stoppage portion elements 470 and 215, the elastic stoppage portion 470 is formed in the cover unit 400, rather than in the middle unit 200, and the responsive protrusion portion 215 is formed in the middle unit 200, rather than in the cover unit 400. Also, the single elastic stoppage portion 470 is installed in a vertical direction, compared with the two elastic stoppage portions 270*a* and 270*b* always installed in the vertical direction according to the other embodiments described above. Whether to install a single elastic stoppage portion or whether to install two elastic stoppage portions up and down may be selectively applied according to specific configurations of an application, and the technical concept of the present invention may include all of the modifications.

Here, in order to prevent the responsive stoppage portion 410 from being completely separated, a step 480 is formed in a lower end of a lateral plate 440 of the cover unit 400.

The responsive stoppage portion 215 performs a mutual grasping operation with the elastic stoppage portion 470 formed on an inner circumferential surface of the cover unit 400, whereby the cover unit 400 may be rotatably coupled to the middle unit 200. The elastic stoppage portion 270 of the middle unit 200 is formed as a line spring or an elastic flexure and fixedly installed in two rows or in a triangular shape when viewed from the x-y plane as mentioned above with reference to FIG. 29A.

Also, in the present embodiment, the stoppage portion elements 410, 221, and 222 having various shapes described above with reference to FIGS. 8 through 13 may be employed.

In the case of the reverse rotation preventing portion elements 460 and 250, like the embodiment of FIG. 31, the responsive protrusion 250 of the middle unit 200 is formed on the partition 240 (in the +z direction).

As illustrated in FIG. 33, when the responsive stoppage portion 215 is positioned above the elastic stoppage portion 270, the engaging portions 450 and 310 are engaged with each other and the reverse rotation preventing portions 460 and 250 are also coupled to each other. As a result, when the user rotates the cover unit 400, the rotating unit 300 engaged with the cover unit 400 is rotated to wind the string. Here, the cover unit 400 is prevented from being rotated reversely by the reverse rotation preventing portions 460 and 250, whereby the string wound by a predetermined length may not be unwound.

As illustrated in FIG. 34, when the cover unit 400 is pulled upwardly so the responsive stoppage portion 215 is positioned below the elastic stoppage portion 270, the engaging portions 450 and 310 are disengaged from each other and coupling of the reverse rotation preventing portions 460 and 250 is also released. In this manner, when the coupling of the cover unit 400 and the rotating unit 300 is released, the string wound around the rotating unit 300 is naturally unwound by virtue of restoring force of the string.

Figure 35:
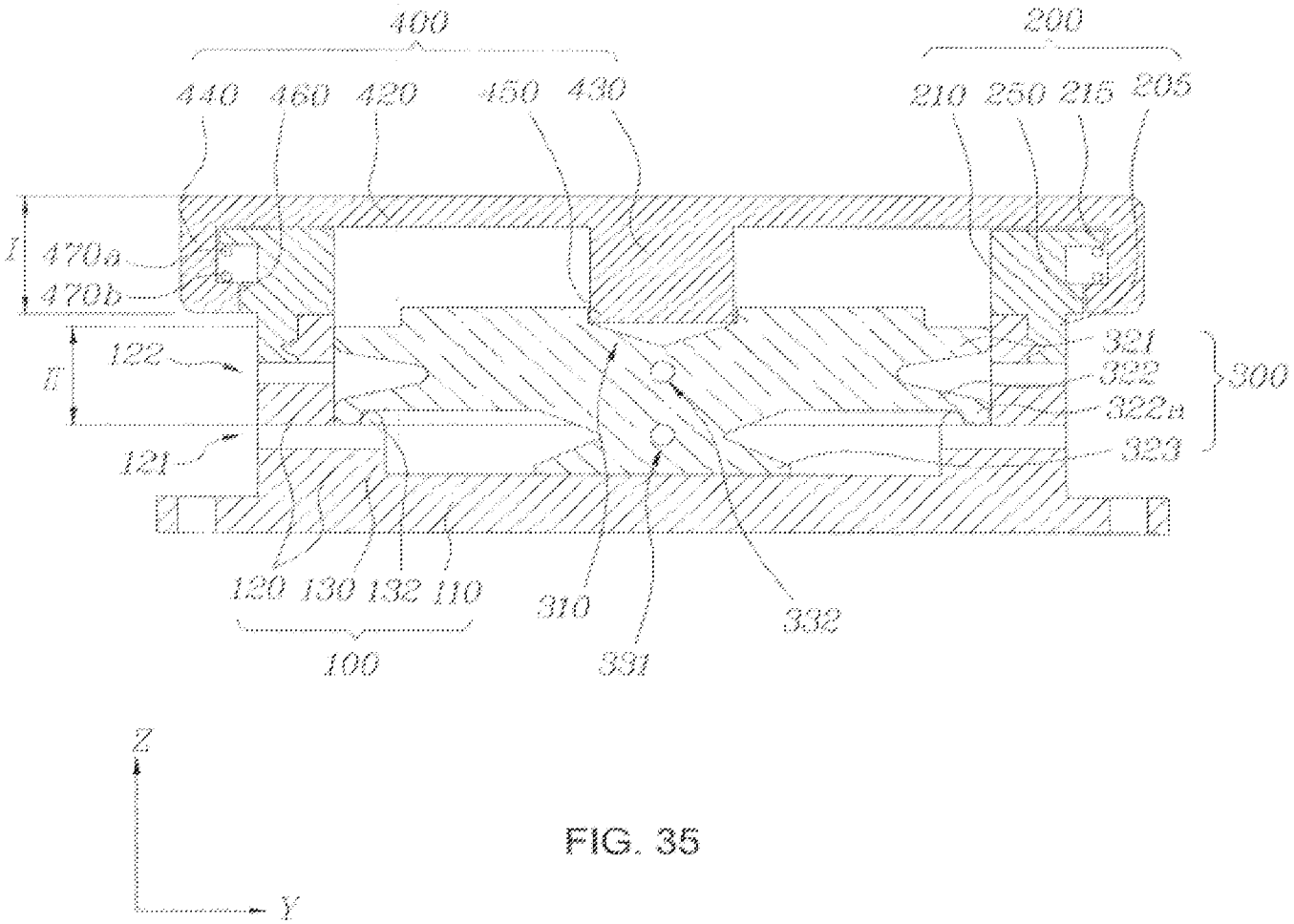
FIG. 35 is a cross-sectional view illustrating a wound state of a fourth embodiment having a 2-stage configuration to reduce an overall height of the apparatus according to the present disclosure.
Figure 36:
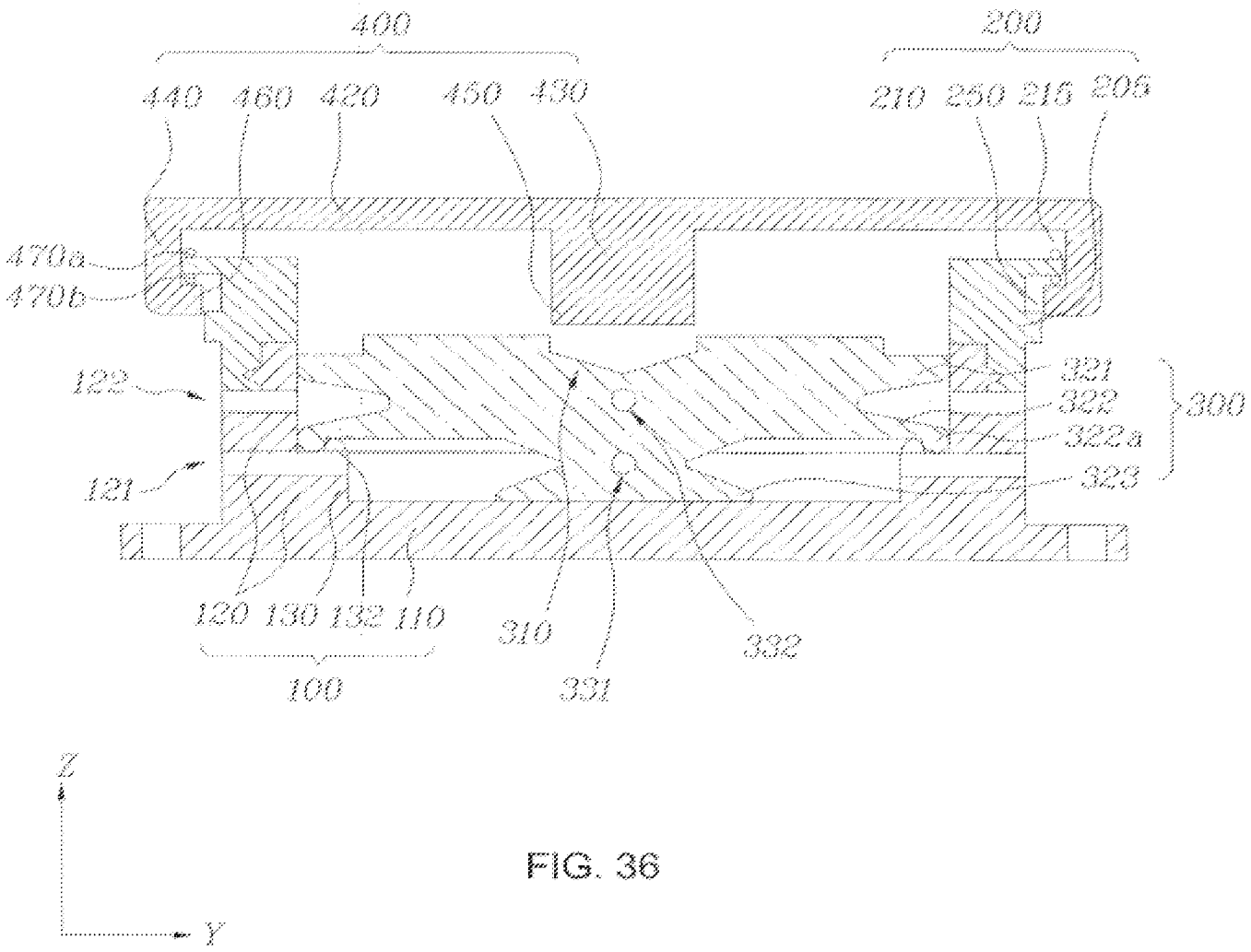
FIG. 36 is a cross-sectional view illustrating a winding-released state of the fourth embodiment having the 2-stage configuration illustrated in FIG. 35.

According to another embodiment (fourth embodiment having a 2-stage configuration) of the present disclosure illustrated in FIGS. 35 and 36, like the embodiment of FIGS. 28 through 30, the stoppage portion elements 410 and 270 and the reverse rotation preventing portion elements 460 and 250 between the cover unit 400 and the middle unit 200, and the engaging portion elements 450 and 310 between the cover unit 400 and the rotating unit 300 are all included in a first stage (I), and the string winding portion elements 321 and 322 of the rotating unit 300 are included in a second stage (II). As a result, the height of the apparatus may be lowered, relative to the 3-stage configuration of FIG. 27.

In the present embodiment, like the embodiment of FIG. 33 described above, among the stoppage portion elements 470 and 215, the elastic stoppage portion 470 is formed in the cover unit 400, rather than in the middle unit 200, and the responsive protrusion portion 215 is formed in the middle unit 200, rather than in the cover unit 400. Here, two elastic stoppage portions 470*a* and 470*b* are installed in a vertical direction, compared with the embodiment of FIG. 33. Whether to install a single elastic stoppage portion or whether to install two elastic stoppage portions up and down may be selectively determined, and both may be included in the technical concept of the present invention. Thus, in all the embodiments of the present disclosure, the number of the elastic stoppage portions may be one or two.

Also, among the reverse rotation preventing portion elements 460 and 250, the ratchet protrusion 460 of the cover unit 400 is formed in a lower end of the lateral plate 440 serving as a handle of the cover unit 400, and the responsive protrusion 250 of the middle unit 200 is formed to face the ratchet protrusion 460 on the upper housing 210. In this manner, when the reverse rotation preventing portion elements 460 and 250 are positioned in the outermost portion of the cover unit 400, there is no need to install a separate partition within the middle unit 200, unlike the previous embodiments, further reducing the overall height of the apparatus.

According to the present embodiment configured as described above, the responsive stoppage portion 215 performs a mutual grasping operation with the elastic stoppage portion 470 formed on an inner circumferential surface of the cover unit 400, whereby the cover unit 400 may be rotatably coupled to the middle unit 200. The elastic stoppage portion 270 of the middle unit 200 is formed as a line spring or an elastic flexure and fixedly installed in two rows or in a triangular shape when viewed from the x-y plane as mentioned above with reference to FIG. 29A or FIG. 29B.

Also, in the present embodiment, the stoppage portion elements 410, 221, and 222 (see FIG. 4 and FIG. 7) having various shapes described above with reference to FIGS. 8 through 13 may be employed.

As illustrated in FIG. 35, when the responsive stoppage portion 215 is positioned above the elastic stoppage portion 470*a*, the engaging portions 450 and 310 are engaged with each other and the reverse rotation preventing portions 460 and 250 are also coupled to each other. As a result, when the user rotates the cover unit 400, the rotating unit 300 engaged with the cover unit 400 is rotated to wind the string. Here, the cover unit 400 is prevented from being rotated reversely by the reverse rotation preventing portions 460 and 250, whereby the string wound by a predetermined length may not be unwound.

As illustrated in FIG. 36, when the cover unit 400 is pulled upwardly so the responsive stoppage portion 215 is positioned between the upper elastic stoppage portion 470*a* and the lower elastic stoppage portion 470*b*, the engaging portions 450 and 310 are disengaged from each other and coupling of the reverse rotation preventing portions 460 and 250 is also released. In this manner, when the coupling of the cover unit 400 and the rotating unit 300 is released, the string wound around the rotating unit 300 is naturally unwound by virtue of restoring force of the string.

Figure 37:
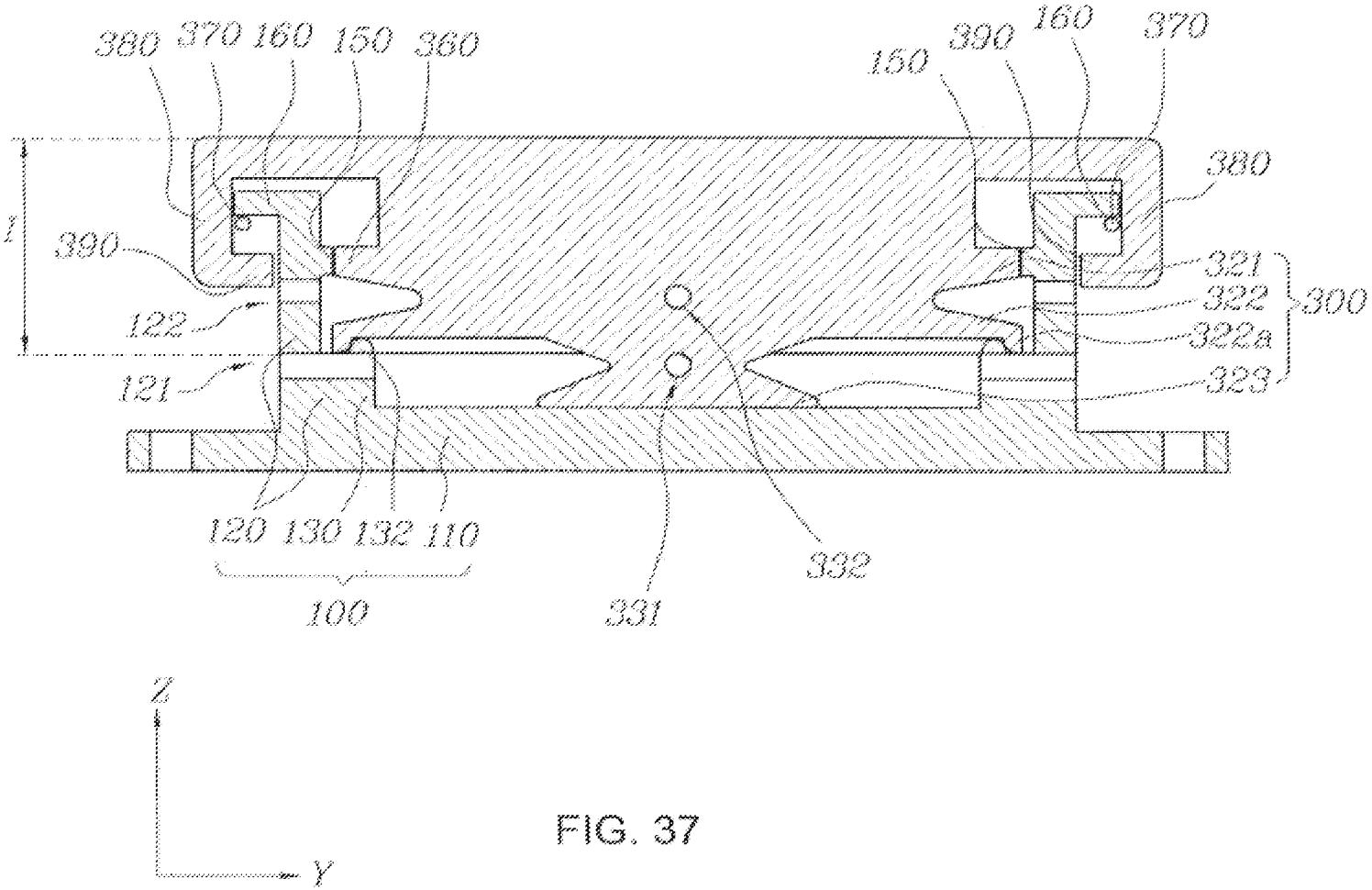
FIG. 37 is a cross-sectional view illustrating a wound state of a fifth embodiment having a 1-stage configuration to reduce an overall height of the apparatus according to the present disclosure.
Figure 38:
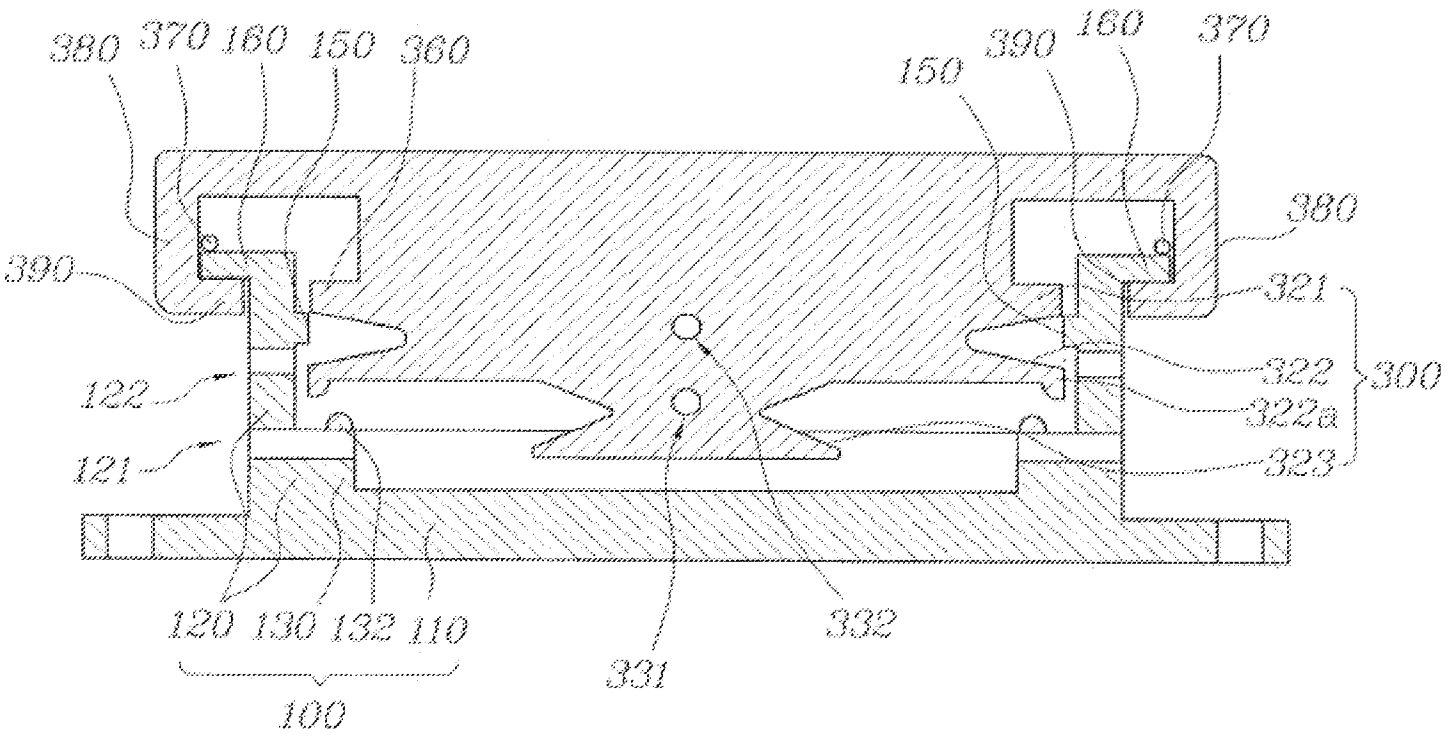
FIG. 38 is a cross-sectional view illustrating a winding-released state of the fifth embodiment having the 1-stage configuration illustrated in FIG. 37.

According to another embodiment (fifth embodiment having a 1-stage configuration) of the present disclosure illustrated in FIGS. 37 and 38, all of the stoppage portion elements, the reverse rotation preventing portion elements, and the string winding portion elements described above are included in the first stage (I). As a result, a height of the apparatus may be significantly lowered, compared with those of the embodiments described above.

Significant differences of the present embodiment to the other embodiment lie in that a middle unit and a base unit are combined to be used as a single middle-base composite unit 100 and a rotating unit and a cover unit are combined to be used as a single rotating-cover composite unit 300. As a result, the engaging portion elements between the existing cover unit and rotating unit are omitted. Also, according to the present embodiment, reverse rotation preventing portions 150 and 360 are formed between the first wing part 321 of the rotating-cover composite unit 300 and an upper inner side surface of the middle-base composite unit 100. In this manner, in the present embodiment, the string winding portion elements 321 and 322, the stoppage portion elements 160 and 370, and the reverse rotation preventing portion elements 150 and 360 are integrally installed on the rotating-cover composite unit 300, thereby significantly lowering a height of the apparatus.

Hereinafter, the components will be described in even further detail. The responsive stoppage portion 160 of the middle-base composite unit 100 performs a mutual grasping operation with the elastic stoppage portion 370 formed on an inner circumferential surface of an upper lateral plate 380 of the rotating-cover composite unit 300, whereby the rotating-cover composite unit 300 may be rotatably coupled to the middle-base composite unit 100. In order to prevent the responsive stoppage portion 160 from being completely released, a step 390 is formed in a lower end of the lateral plate 380 of the rotating-cover composite unit 300. Meanwhile, according to another embodiment of the present disclosure, conversely from the case of FIG. 37, the responsive stoppage portion may be formed in the rotating-cover composite unit 300 and the elastic stoppage portion may be formed in the middle-base composite unit 100.

The elastic stoppage portion 370 of the rotating-cover composite unit 300 is formed as a wire-formed line spring or an elastic flexure and fixedly installed in two rows or in a triangular shape when viewed from the x-y plane as mentioned above with reference to FIG. 29A.

Also, in the present embodiment, the stoppage portion elements 410, 221, and 222 having various shapes described above with reference to FIGS. 8 through 13 may be employed.

As illustrated in FIG. 37, when the responsive stoppage portion 160 is positioned above the elastic stoppage portion 370, the reverse rotation preventing portions 150 and 360 are also coupled to each other. As a result, when the user rotates the rotating-cover composite unit 300, a string is wound. Here, the rotating-cover composite unit 300 is prevented from being rotated reversely by the reverse rotation preventing portions 150 and 360, whereby the string wound by a predetermined length may not be unwound.

As illustrated in FIG. 38, when the rotating-cover composite unit 300 is pulled upwardly so the responsive stoppage portion 160 is positioned below the elastic stoppage portion 370, coupling of the reverse rotation preventing portions 150 and 360 is released. In this manner, when the coupling of the rotating-cover composite unit 300 and the middle-base composite unit 100 is released, the string wound around the rotating-cover composite unit 300 is naturally unwound by virtue of restoring force of the string.

Figure 39:
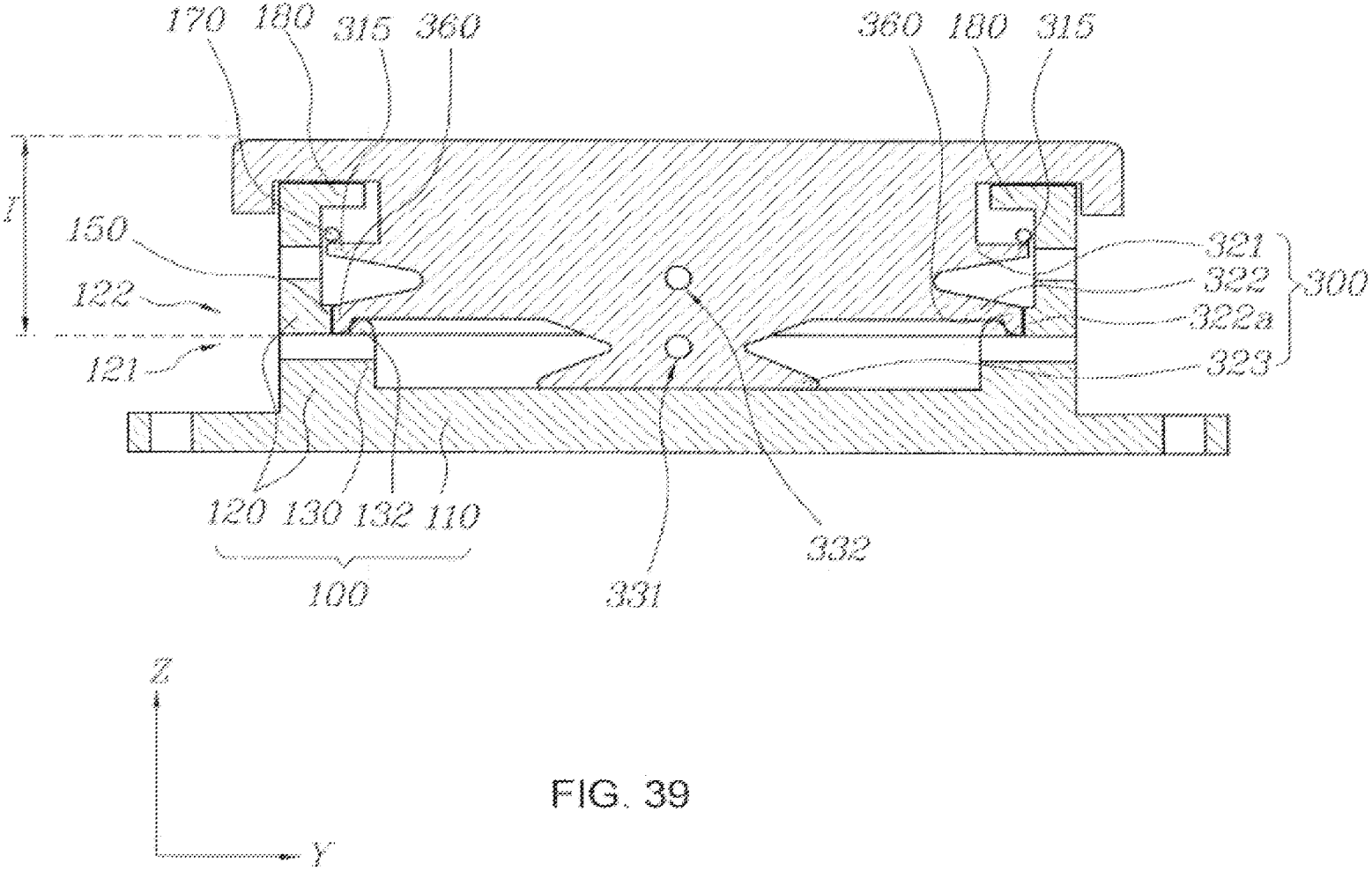
FIG. 39 is a cross-sectional view illustrating a wound state of a sixth embodiment having a 1-stage configuration to reduce an overall height of the apparatus according to the present disclosure.
Figure 40:
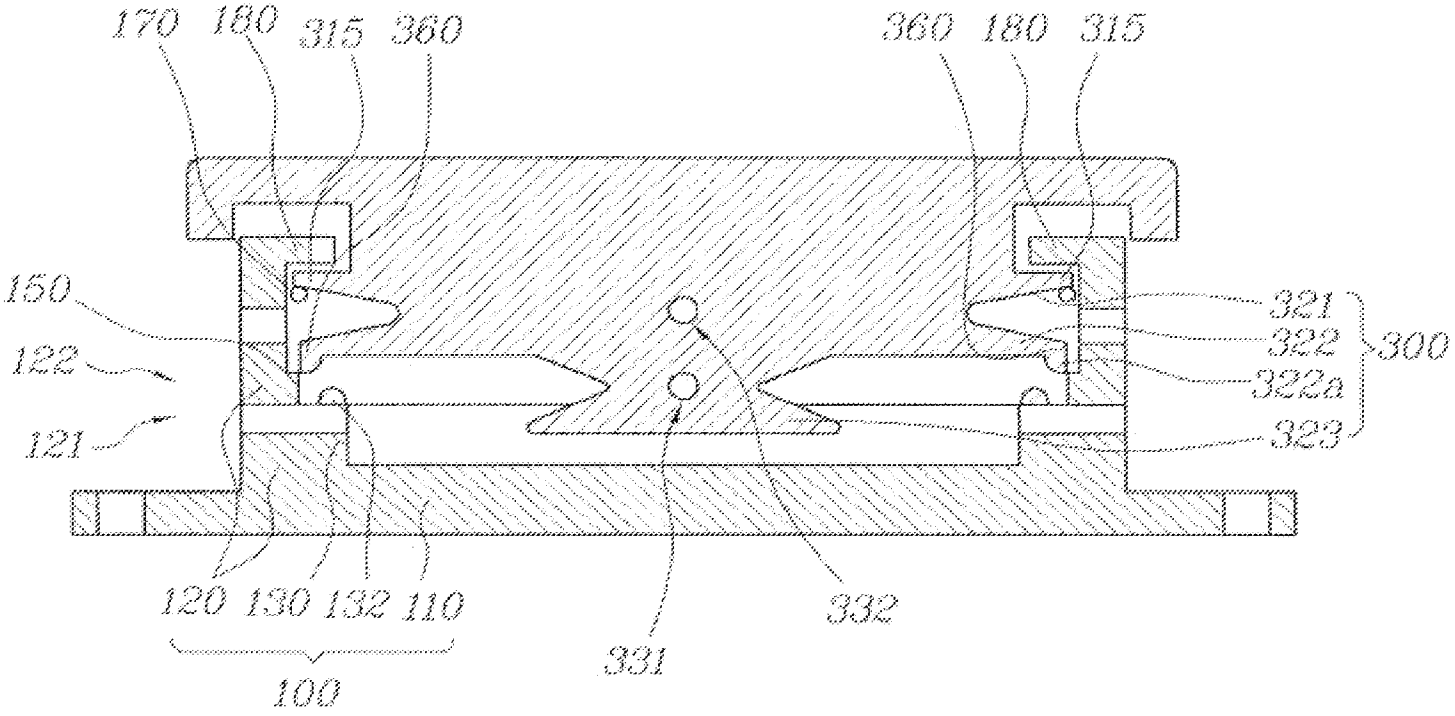
FIG. 40 is a cross-sectional view illustrating a winding-released state of the sixth embodiment having the 1-stage configuration illustrated in FIG. 39.

According to another embodiment (sixth embodiment having a 1-stage configuration) of the present disclosure illustrated in FIGS. 39 and 40, all of the stoppage portion elements, the reverse rotation preventing portion elements, and the string winding portion elements described above are included in the first stage (I). As a result, a height of the apparatus may be significantly lowered, compared with those of the embodiments described above.

The present embodiment is the same as the embodiment described above with reference to FIGS. 37 and 38, in that a middle unit and a base unit are combined to be used as a single middle-base composite unit 100, and a rotating unit and a cover unit are combined to be used as a single rotating-cover composite unit 300. As a result, the engaging portion elements between the existing cover unit and rotating unit are omitted.

The present embodiment is different from the embodiment described above with reference to FIGS. 37 and 38, in that all of the reverse rotation preventing portion elements 150 and 360 and the stoppage portion elements 170 and 315 are installed in the first wing part 321 and the second wing part 322 of the rotating-cover composite unit 300. In FIGS. 39 and 40, it is illustrated that the stoppage portion elements 170 and 315 are formed in the first wing part 321 of the rotating-cover composite unit 300 and the reverse rotation preventing portion elements 150 and 360 are installed in the second wing part 322. However, the technical concept of the present invention is not limited thereto, and conversely, the reverse rotation preventing portion elements may be formed in the first wing part 321 of the rotating-cover composite unit 300 and the stoppage portion elements may be installed in the second wing part 322 of the rotating-cover composite unit 300.

In the present embodiment, the string winding portion elements 321 and 322, the stoppage portion elements 170 and 315, and the reverse rotation preventing portion elements 150 and 360 are integrally installed between the first wing part 321 and the second wing part 322 of the rotating-cover composite unit 300, whereby a height of the apparatus may be lowest.

Hereinafter, the components will be described in even further detail. The responsive stoppage portion 315 formed in the first wing part 321 of the rotating-cover composite unit 300 performs a mutual grasping operation with the elastic stoppage portion 170 of the of the middle-base composite unit 100, whereby the rotating-cover composite unit 300 may be rotatably coupled to the middle-base composite unit 100. In order to prevent the responsive stoppage portion 315 from being completely released, a step 180 is formed in an upper end of a side surface of the middle-base composite unit 100.

Meanwhile, according to another embodiment of the present disclosure, conversely from the case of FIG. 39, the responsive stoppage portion may be formed in the rotating-cover composite unit 300 and the elastic stoppage portion may be formed in the middle-base composite unit 100.

The elastic stoppage portion 170 of the middle-base composite unit 100 is formed as a wire-formed line spring or an elastic flexure and fixedly installed in two rows or in a triangular shape when viewed from the x-y plane as mentioned above with reference to FIG. 29A.

Also, in the present embodiment, the stoppage portion elements 410, 221, and 222 (see FIG. 4 and FIG. 7) having various shapes described above with reference to FIGS. 8 through 13 may be employed.

As illustrated in FIG. 39, when the responsive stoppage portion 315 is positioned below the elastic stoppage portion 170, the reverse rotation preventing portions 150 and 360 are also coupled to each other. As a result, when the user rotates the rotating-cover composite unit 300, a string is wound. Here, the rotating-cover composite unit 300 is prevented from being rotated reversely by the reverse rotation preventing portions 150 and 360, whereby the string wound by a predetermined length may not be unwound.

As illustrated in FIG. 40, when the rotating-cover composite unit 300 is pulled upwardly so the responsive stoppage portion 315 is positioned above the elastic stoppage portion 170, coupling of the reverse rotation preventing portions 150 and 360 is released. In this manner, when the coupling of the rotating-cover composite unit 300 and the middle-base composite unit 100 is released, the string wound around the rotating-cover composite unit 300 is naturally unwound by virtue of restoring force of the string.

Figure 41:
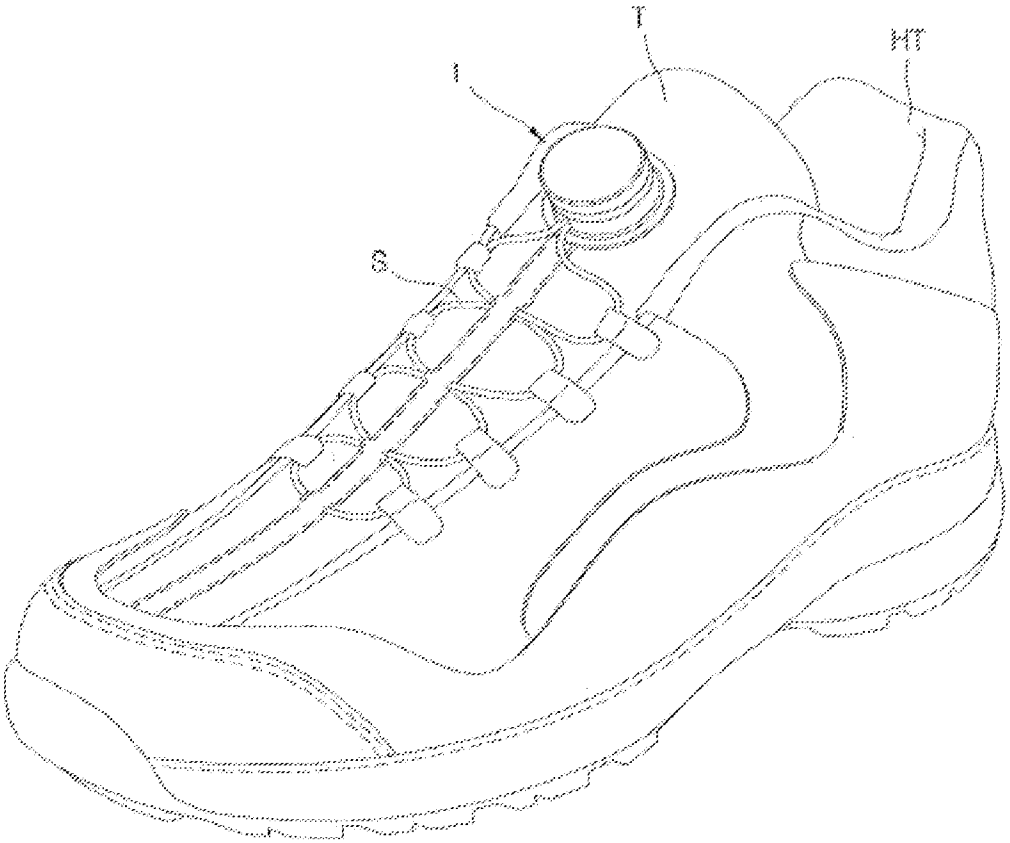
FIG. 41 is a perspective view schematically illustrating footwear according to another embodiment of the present disclosure.

FIG. 41 is a perspective view schematically illustrating footwear according to another embodiment of the present disclosure. As illustrated in FIG. 41, the footwear according to the present embodiment has a string winding and unwinding apparatus 1 according to any one of the embodiments described above or modified examples thereof. For example, the string winding and unwinding apparatus 1 may be attached to a tongue T of the footwear to allow a string S to be connected to the string winding and unwinding apparatus 1. The string winding and unwinding apparatus 1 may also be attached to other portion such as a side surface or a portion of a heel of a rear surface of the footwear. That is, the string S of the footwear may pass through any one of the second lateral apertures 122 of the base unit 100, penetrate through the second aperture 332 of the rotating unit 300, and pass through the other of the second lateral apertures 122. Accordingly, when the rotating unit 300 is engaged with the cover unit 400 and rotated in one direction, the string is wound around the rotating unit 300. As the string S is wound in this manner, the footwear may be tightly attached to the foot of the user. In this state, when the rotating unit 300 is separated from the cover unit 400, the rotating unit 300 may be rotated in the other direction (the loosening direction) and accordingly, the string S wound around the rotating unit 300 may be unwound from an outer circumferential surface of the rotating unit 300.

In FIG. 41, the footwear is illustrated, but the string winding and unwinding apparatus according to the embodiments described above and the modified examples thereof may be installed to be used in a variety of articles requiring locking by a string, such as hats, belts, watches, bags, and clothes, and various articles in which the string winding and unwinding apparatus according to the embodiments described above and the modified examples thereof should also be within the scope of the present invention.

Figure 42:
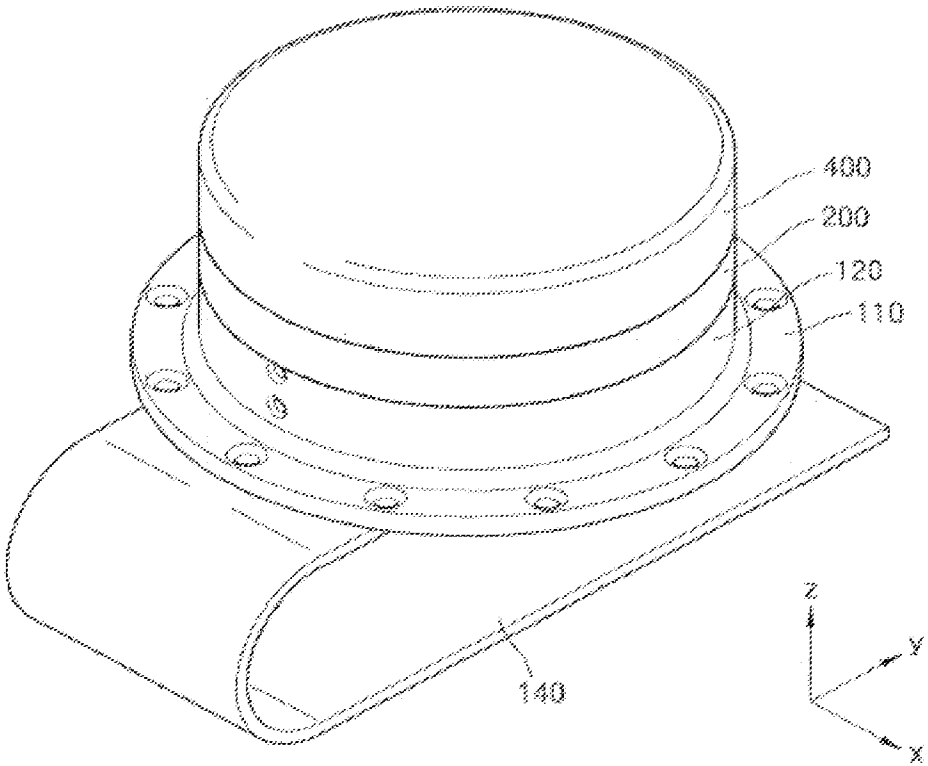
FIG. 42 is a perspective view schematically illustrating a string winding and unwinding apparatus according to another embodiment of the present disclosure.

FIG. 42 is a perspective view schematically illustrating a string winding and unwinding apparatus according to another embodiment of the present disclosure. Referring to FIG. 42, the base unit 100 of the string winding and unwinding apparatus according to the present embodiment further includes a clip unit 140. The clip unit 140 corresponds to the base plate 110 and extends from the base plate 110 such that a space is present between the clip unit 140 and the base plate 110. To this end, as illustrated in FIG. 42, the clip unit 140 may extend from the base plate 110 and may be bent to have a portion substantially parallel to the base plate 110. The clip unit 140 may be integrated with the base plate 110 (one body), or may be formed as a separate component and fixed to the base plate 110. The clip unit 140 may include, for example, a resin, plastic, or a metal plate to have flexibility.

The a string winding and unwinding apparatus according to the present embodiment may be easily attached to or detached from an article in which the string winding and unwinding apparatus is desired to be used, by using the space between the base plate 110 and the clip unit 140. For example, in the case of the footwear illustrated in FIG. 41, the space between the base plate 110 and the clip unit 140 may be inserted into a heel tap HT or the tongue T (see FIG. 41), a portion adjacent to the ankle, or the rear portion of the footwear, whereby the string winding and unwinding apparatus may be easily detachably attached to the footwear.

Figure 43:
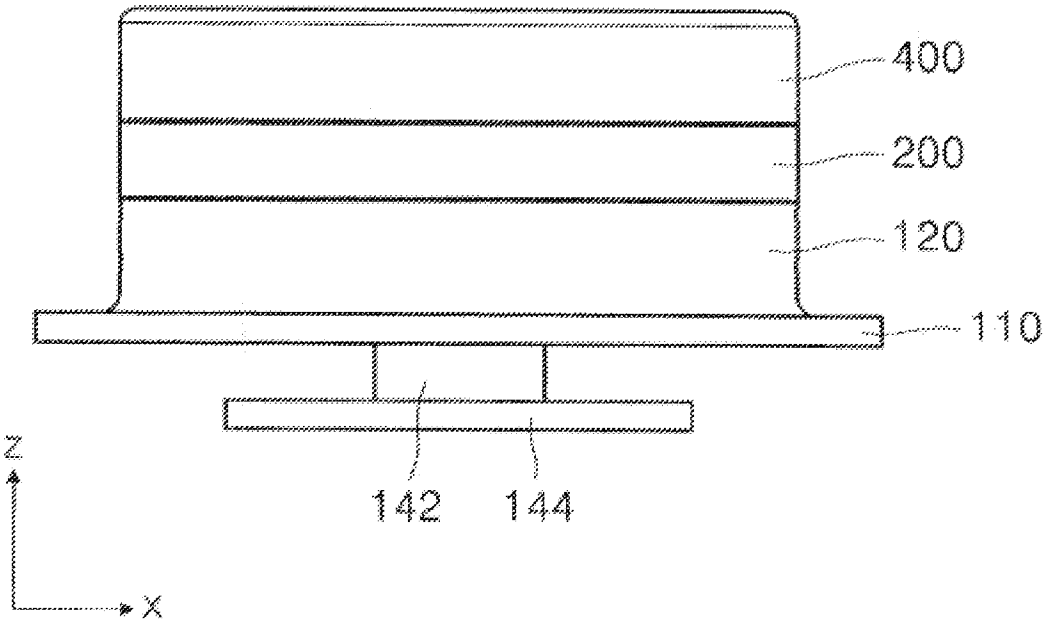
FIG. 43 is a perspective view schematically illustrating a string winding and unwinding apparatus according to another embodiment of the present disclosure.

FIG. 43 is a perspective view schematically illustrating a string winding and unwinding apparatus according to another embodiment of the present disclosure. Unlike the embodiment described above with reference to FIG. 42, the base unit 100 according to the present embodiment may further include a rail 144 positioned on a lower surface of the base plate 110 (−z direction) and extending in one direction (y-axis direction). A connection portion 142 connecting the rail 144 to the base plate 110 and having a width narrower than that of the rail 144 (in the x-axis direction) may be provided to allow a space to be present between the rail 144 and the base plate 110.

Figure 44:
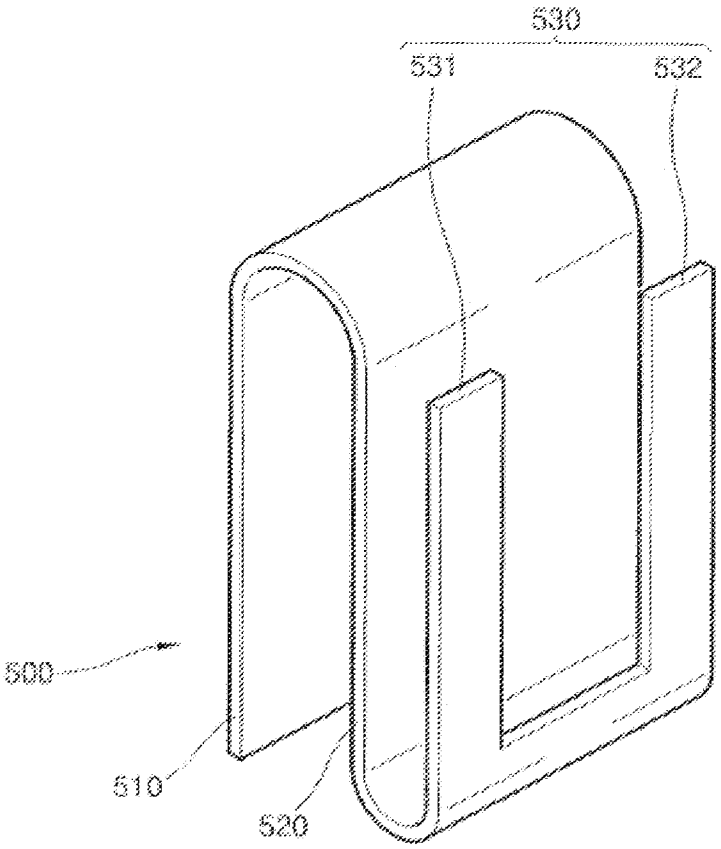
FIG. 44 is a perspective view schematically illustrating a fastening clip that may be coupled to the string winding and unwinding apparatus of FIG. 43.

The string winding and unwinding apparatus according to the present embodiment may be used together with a fastening clip 500 illustrated in FIG. 44. The fastening clip 500 may have a shape bent or curved one or more times as illustrated in FIG. 44. In FIG. 44, it is illustrated that the fastening clip 500 is bent twice, mutually adjacent first portion 510 and second portion 520 are substantially parallel to each other and allow a space to be present therebetween, and a third portion 530 is adjacent to the second portion 520, is positioned on the opposite side of the first portion 510, and is substantially parallel to the second portion 520 to allow a space to be present therebetween. Here, the third portion 530 has a first guide rail 531 and a second guide rail 532 positioned to be coplanar, spaced apart from one another, and parallel to each other.

The fastening clip 500 may enable the string winding and unwinding apparatus according to the present embodiment to be easily detachably attached to a variety of articles. For example, in the case of the footwear illustrated in FIG. 41, the space between the first portion 510 and the second portion 520 of the fastening clip 500 illustrated in FIG. 44 may be inserted into a heel tap HT or the tongue T, a portion adjacent to the ankle, or the rear portion of the footwear, whereby the string winding and unwinding apparatus may be installed in the footwear such that the third portion 530 is positioned outside of the footwear. Thereafter, the rail 144 of the string winding and unwinding apparatus according to the present embodiment illustrated in FIG. 43 may be inserted into the space between the first guide rail 531 and the second guide rail 532 of the fastening clip 500 and the second portion 520, whereby the rail 144 may be easily installed in the fastening clip 500.

Meanwhile, the connection portion 142 may extend in one direction (y-axis direction) like the rail 144. A shape of the connection portion 142 corresponds to a shape of the space between the first guide rail 531 and the second guide rail 532 of the fastening clip 500, and the connection portion 142 allows a relative position of the string winding and unwinding apparatus with respect to the fastening clip 500 to be fixed, rather than being changed, while the string winding and unwinding apparatus is in use such that the user rotates the cover unit 400, or the like. The shape of the connection portion 142 may be varied in various manners, without being limited thereto.

According to the embodiments of the present disclosure described above, the string winding and unwinding apparatus may be implemented to have a simple configuration and facilitate maintenance and repair. However, the scope of the present invention is not limited thereto.

While the invention has been particularly shown and described in conjunction with exemplary embodiments, it will be appreciated that variations and modifications will occur to those skilled in the art. In particular regard to the various functions performed by the above described components (assemblies, devices, circuits, etc.) the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A string winding apparatus, comprising:

a base unit;

a middle unit coupled to the base unit;

a rotating unit positioned between the base unit and the middle unit, wherein the rotating unit is configured and disposed to be rotatable with respect to the base unit, wherein the rotating unit comprises a first engaging portion formed thereon and a first wing part and a second wing part, and wherein the first wing part and the second wing part comprise a space therebetween for winding a string; and a cover unit coupled to the middle unit, wherein the cover unit comprises a second engaging portion inserted into or separated from the first engaging portion;

wherein the middle unit comprises a responsive protrusion, wherein the cover unit comprises a ratchet protrusion for limiting rotation in one direction in response to the responsive protrusion, wherein the responsive protrusion and the ratchet protrusion are arranged in a direction parallel to the rotation axis of the cover unit and engaged with each other, wherein the responsive protrusion is disposed on an upper surface of a partition extending from a side surface of the middle unit towards a central axis of the string winding apparatus, wherein the responsive protrusion protrudes in a perpendicular direction from the upper surface of the partition, wherein the ratchet protrusion protrudes in a perpendicular direction from a bottom surface of the cover unit towards the responsive protrusion, and wherein the second engaging portion is integral with the cover unit and only engages with the first engaging portion.

2. The string winding apparatus of claim 1, wherein a stoppage portion is disposed between the middle unit and the cover unit;

wherein the stoppage portion includes an elastic stoppage portion and a responsive stoppage portion corresponding to the elastic stoppage portion, and wherein the elastic stoppage portion is disposed on one side of the middle unit, and wherein the responsive stoppage portion is formed on a side surface of the cover unit and protrudes toward an outer surface of the middle unit.

3. A string winding apparatus, comprising:

a base unit;

a middle unit coupled to the base unit;

a rotating unit positioned between the base unit and middle unit, wherein the rotating unit is configured and disposed to be rotatable with respect to the base unit, wherein the rotating unit comprises a first engaging portion formed thereon and a first wing part and a second wing part, and wherein the first wing part and the second wing part provide a space therebetween for winding a string; and a cover unit coupled to the middle unit, wherein the cover unit comprises a second engaging portion inserted into or separated from the first engaging portion;

wherein the middle unit comprises a ratchet protrusion for limiting rotation in one direction, wherein the cover unit comprises a responsive protrusion corresponding to the ratchet protrusion, wherein the responsive protrusion and the ratchet protrusion are arranged in a direction parallel to the rotation axis of the cover unit and engaged with each other, wherein the ratchet protrusion is disposed on an upper surface of a partition extending from a side surface of the middle unit towards a central axis of the string winding apparatus, wherein the ratchet protrusion protrudes in a perpendicular direction from the upper surface of the partition, wherein the responsive protrusion protrudes in a perpendicular direction from a bottom surface of the cover unit towards the ratchet protrusion, and wherein the second engaging portion is integral with the cover unit and only engages with the first engaging portion.

4. The string winding apparatus of claim 3, wherein a stoppage portion is disposed between the middle unit and the cover unit;

wherein the stoppage portion includes an elastic stoppage portion and a responsive stoppage portion corresponding to the elastic stoppage portion, and the elastic stoppage portion is disposed on one side of the middle unit, and the responsive stoppage portion is formed on a side surface of the cover unit and protrudes toward an outer surface of the middle unit.

* * * * *